US007878034B2

(12) United States Patent
Alber et al.

(10) Patent No.: US 7,878,034 B2
(45) Date of Patent: Feb. 1, 2011

(54) LOCKING ARRANGEMENT FOR A HINGED PANEL

(75) Inventors: Helmut Alber, Schlanders (BZ); Oliver Erich Rudolf Schuberth, Laas (BZ); Christian Josef Stephan Zeus, Stilfs (BZ); Dan Mattrisch, Fort Atkinson, WI (US); Eric Stoutenborough, Fort Atkinson, WI (US); Matt Taylor, Madison, WI (US)

(73) Assignee: HOPPE Holding AG, Mustair (CH)

( * ) Notice: Subject to any disclaimer, the term of this patent is extended or adjusted under 35 U.S.C. 154(b) by 833 days.

(21) Appl. No.: 11/701,914

(22) Filed: Feb. 2, 2007

(65) Prior Publication Data

US 2008/0184749 A1 Aug. 7, 2008

(51) Int. Cl.
*E05B 59/00* (2006.01)

(52) U.S. Cl. ..... 70/107; 70/108; 70/120; 292/39; 292/142; 292/172; 292/336.3; 292/DIG. 21

(58) Field of Classification Search ..... 70/107, 70/108, 113, 118, 120; 292/39, 142, 172, 292/332–335, 336.3, DIG. 21
See application file for complete search history.

(56) References Cited

U.S. PATENT DOCUMENTS 4,962,653 A 10/1990 Kaup
5,265,920 A * 11/1993 Kaup et al. ..... 292/40
5,290,077 A 3/1994 Fleming
5,394,718 A 3/1995 Hötzl
5,404,737 A 4/1995 Hötzl
5,603,534 A 2/1997 Fuller
5,620,216 A 4/1997 Fuller
5,752,727 A 5/1998 Zues et al.
5,775,745 A 7/1998 Hoppe et al.
5,782,114 A 7/1998 Zeus et al.
5,819,562 A 10/1998 Christ
5,820,173 A 10/1998 Fuller
5,878,606 A 3/1999 Chaput et al.
5,890,753 A 4/1999 Fuller
5,896,763 A * 4/1999 Dinkelborg et al. ..... 70/93
5,992,188 A 11/1999 Saunders
6,050,115 A * 4/2000 Schroter et al. ..... 70/107
6,209,364 B1 4/2001 Collet et al.
6,209,931 B1 4/2001 Von Stoutenborough et al.
6,217,087 B1 4/2001 Fuller
6,282,929 B1 9/2001 Eller et al.

(Continued)

*Primary Examiner*—Suzanne D Barrett
(74) *Attorney, Agent, or Firm*—Reinhart Boerner Van Deuren s.c.

(57) ABSTRACT

An intuitively operable door locking arrangement and a method include, a lock-point arming input element that is connected directly to a handle-operated control element of the locking arrangement, rather than being connected directly to a lock-point of the door locking arrangement. The locking arrangement and method may be used in hinged single or multiple-panel installations, having single, and/or multiple lock-points, may allow keyless locking from outside, and may include a latching arrangement. In active door locking apparatuses, the lock-point is movable only through operation of the handle-operated control element. The lock point arming element is selectively moveable between an armed and a disarmed position thereof, and is configured and connected to the handle-operated control element in such a manner that the handle-operated control element may be used to move the lock-point to the locked position thereof only when the lock-point arming input element is in the armed position thereof.

48 Claims, 37 Drawing Sheets

U.S. PATENT DOCUMENTS

| | | | | |
|---|---|---|---|---|
| 6,327,881 | B1 | 12/2001 | Gründler et al. | |
| 6,564,596 | B2 | 5/2003 | Huang | |
| 6,651,466 | B1 | 11/2003 | Shih | |
| 6,810,699 | B2 * | 11/2004 | Nagy | 70/107 |
| 6,813,915 | B2 | 11/2004 | Chang | |
| 6,871,451 | B2 | 3/2005 | Harger et al. | |
| 6,971,686 | B2 | 12/2005 | Becken | |
| 7,025,394 | B1 | 4/2006 | Hunt | |
| 7,353,674 | B2 * | 4/2008 | Raatikainen et al. | 70/277 |
| 7,363,784 | B2 * | 4/2008 | Shvarts | 70/107 |
| 7,752,875 | B2 * | 7/2010 | Constantinou et al. | 70/107 |
| 2002/0104339 | A1 | 8/2002 | Saner | |
| 2003/0159478 | A1 * | 8/2003 | Nagy | 70/107 |
| 2005/0092042 | A1 | 5/2005 | Constantinou et al. | |
| 2005/0103066 | A1 | 5/2005 | Botha et al. | |
| 2005/0166647 | A1 | 8/2005 | Walls et al. | |
| 2006/0196236 | A1 | 9/2006 | Gruenendahl | |
| 2008/0156049 | A1 * | 7/2008 | Topfer | 70/107 |

* cited by examiner

LOCKING ARRANGEMENT FOR A HINGED PANEL

FIELD OF THE INVENTION

This invention relates generally to locking of hinged panels, such as doors or windows or the like, and more particularly to a locking arrangement, and a method for operating a locking arrangement, for securing single or multiple hinged panels to a frame, other panels, or a jamb, using one or more lock-points.

BACKGROUND OF THE INVENTION

Through the centuries, many devices and methods have been used for locking, or otherwise securing, hinged panels, such as single or double swinging doors, windows, or shutters in a frame, or jamb, to preclude entry into, or egress from, one space from another, to thereby provide security and/or protection from the elements. A number of factors must be taken into consideration in the design of such locking arrangements and their manner of operation.

A primary consideration is that the locking arrangement must, indeed, provide adequate security against forcible entry, when the locking arrangement is deployed. Through the years, it has thus become known to provide locking arrangements having more than one lock-point, in the form of dead-bolts, shoot-bolts, locking tongues, and/or hook-type latches, and the like, for engaging the jamb or frame surrounding the hinged panel, or for engaging an adjacent panel in a French door arrangement. It has also become common practice to include some form of latch mechanism, in the locking arrangement, for holding a door, or doors, in a closed but unlocked state, to provide protection from the elements, or entry of insects, or other vermin, into a space protected by the closed panel.

Another primary consideration, in the design of locking arrangements, is that they be conveniently and intuitively operable. For example, it is desirable that a locking arrangement be operable through manipulation of a minimal number of input elements, such as handles, thumb-turns, or keyed lock cylinders. This is particularly true with regard to locking arrangements having multiple lock-points in single or double-hinged panel arrangements. In a locking arrangement having multiple lock-points, for example, it is desirable that operation of all lock-points can be accomplished through manipulation of one, or at most two, input elements, given the fact that a person operating the locking arrangement has only two hands with which to simultaneously operate various input elements such as handles and thumb-turns. Intuitive operation of a minimum number of input elements can be especially critical in emergency situations, where a person, inside of a space secured by the locking arrangement, may need to quickly exit the space in the dark, or in reduced visibility situations caused by smoke in the case of a fire within the space, for example.

Applications of locking arrangements in double panel installations, such as French doors, require additional design considerations. In such installations, one of the hinged panels is typically a so-called active panel, through which primary ingress and egress takes place, and the other hinged panel is a so-called inactive panel which generally is secured to the jamb or frame surrounding the inactive panel in a manner allowing the inactive panel to be opened only when it is desirable to have a bigger opening than is provided by the active panel alone. In prior double door arrangements, for example, locking arrangements in inactive panels have sometimes included separately operable shoot-bolt-type latches located at the top and/or bottom of the inactive panel which can be individually actuated to engage corresponding holes or anchor points in the door jamb and the floor adjacent the inactive panel. Alternatively, such shoot-bolt-type locking arrangements, in an inactive panel, have been connected to a centrally operable actuation handle of the locking arrangement in the inactive panel.

Where double panel arrangements are utilized, it is desirable to provide some means for precluding improper operation of the locking arrangements in both the inactive and active panels. For example, it is desirable to preclude operation of any lock-points in the locking arrangement of an active panel which engages an inactive panel, without the lock-points of the inactive panel having been previously engaged with the frame. If a dead-bolt in the active panel is engaged with an inactive panel that has not been previously secured to the jamb, force applied to the outside of the panels may be capable of causing the panels to open, possibly with damage to the locking arrangement and/or one or both of the panels, even though it appears that the doors are securely locked. By configuring the locking arrangement such that normal operation of the input elements (such has handles and thumb-turns or key cylinders) in the active panel is inhibited until the inactive panel is securely locked in place, a person operating the door is alerted to the fact that the inactive panel is not properly secured.

It is also desirable that lock-points and latch components of the locking arrangement which extend beyond the edges of the panels in a locked state, be precluded from movement to that extended locked state, prior to the panels being properly positioned in a closed position, within the frame and with respect to one another, in order to preclude inadvertent contact of the latches and/or lock-points with the frame or the panels in a manner that would cause damage to the locking arrangement, the panels, the frame, or trim around the panel opening.

Another consideration, applicable to double-panel applications of locking arrangements, is that the operation of the input elements for controlling the locking arrangement in both the active and inactive panels be such that a person unfamiliar with the locking arrangement will intuitively be able to tell which one of the double panels is the active panel, particularly in an emergency exit situation, when both panels are locked. This is so because, typically, the active panel must be opened before the inactive panel can be opened in most common double-panel installations. Where the input controls on the active and inactive doors have a similar appearance, or feel, a person attempting to escape through the panels in an emergency situation might otherwise waste valuable time in a vain attempt to open the inactive panel rather than the active panel.

Another highly desirable feature would be providing the capability to lock the locking arrangement from outside of the panel or panels without using a key.

Prior locking arrangements and methods have not been entirely satisfactory in meeting the requirements and desired functionality discussed above, or have been found to be inadequate in other respects.

It is desirable, therefore, to provide an improved locking arrangement, and method, for operating a locking arrangement in hinged single-panel or multiple-panel installations. It is also desirable that such an improved locking arrangement and method be applicable in embodiments having single, and/or multiple lock-points. It is further desirable that such an improved locking arrangement and method be usable in forms that include a latch arrangement.

BRIEF SUMMARY OF THE INVENTION

The invention provides an improved panel locking arrangement, and method for operating a locking arrangement, through use of a lock-point arming input element that is connected directly to a handle-operated control element of the locking arrangement, rather than being connected directly to a lock-point of the panel locking arrangement. The lock-point is movable only through operation of the handle-operated control element.

In one form of the invention, the lock point arming element is selectively moveable between an armed and a disarmed position thereof, and is configured and connected to the handle-operated control element in such a manner that the handle-operated control element may be used to move the lock-point to the locked position thereof only when the lock-point arming input element is in the armed position thereof.

In some forms of the invention, the lock-point arming input element may include or take the form of a thumb-turn and/or keyed cylinder, and the handle-operated control element may include or be adapted for attachment thereto of a door handle. In stark contrast to prior locking arrangements, however, such a thumb-turn or key-operated cylinder is not operatively connected directly to the deadbolt or other lock point. In the present invention, one or more lock-points are moveable from the unlocked to the locked position thereof only by first turning the thumb-turn or key-operated cylinder to the armed position thereof, and then using the door handle attached to the handle-operated control element for moving the one or more lock-points from the unlocked to the locked positions thereof.

In one form of the invention, the lock-point arming input element is selectively moveable between an armed and a disarmed position thereof, and is configured and connected to the handle-operated control element in such a manner that the handle-operated control element may only be used to move the lock-point to the locked position thereof when the lock-point arming input element is in the disarmed position thereof.

In various forms of the invention, a locking arrangement and method are provided, for use in hinged single-panel or multiple-panel installations. A locking arrangement and/or method, according to the invention, may be applicable in forms having single, and/or multiple lock-points. Some forms of a locking arrangement and/or method, according to the invention, may include a latching arrangement.

Terms such as "door" and "panel," as used herein, are contemplated to be generally interchangeable, and to be inclusive rather than limiting, with those having skill in the art readily understanding that the invention may be practiced with a wide variety of hinge-mounted, panel-like elements, including: doors, windows, shutters, and the like.

In one form of the invention, a door locking arrangement includes a door locking apparatus for moving at least one lock-point between a locked and an unlocked position thereof. The lock-point apparatus includes a handle-actuated control element, a lock-point actuation apparatus adapted for attachment thereto of the at least one lock-point, and a lock-point arming input element that is selectively moveable between an armed and a disarmed position thereof. The handle-operated control element is selectively moveable between first and second angular positions thereof, and an intermediate angular position thereof disposed between the first and second angular positions. The door locking apparatus is configured such that moving the at least one lock-point from the unlocked to the locked position thereof is accomplished only by, first moving the lock-point arming input element from the disarmed to the armed position thereof, and then moving the handle-actuated control element from the intermediate position thereof to the second position thereof.

A door locking apparatus, according to the invention, may include an inside handle-actuated control element, an outside handle-operated control element, a lock-point actuation apparatus having at least one lock-point that is moveable between a locked and an unlocked position thereof, and a lock-point arming input element that is selectively moveable between an armed and a disarmed position thereof. The handle-operated control elements are selectively moveable between respective first and second angular positions thereof, and respective intermediate angular positions thereof disposed between the first and second angular positions. The door locking apparatus is configured such that moving the at least one lock-point from the unlocked to the locked position thereof is accomplished only by first moving the lock-point arming input element from the disarmed to the armed position thereof, and then moving one of the handle-actuated control elements from the intermediate position to the second position thereof.

A door locking apparatus, according to the invention, may further include one or more of the group consisting substantially of: an inside handle operatively connected to the inside handle-actuated control element; an outside handle operatively connected to the outside handle-actuated control element; a thumb-turn operatively connected to the lock-point arming input element; a lock cylinder operatively connected to the lock-point arming input element; multiple lock-points; connecting and mounting elements for operatively connecting multiple lock-points to one another; and decorative hardware.

In some forms of the invention, a door locking apparatus may be configured such that, moving an inside handle-actuated control element from the intermediate position thereof to the first angular position thereof retracts the at least one lock-point and moves the lock-point arming input element from the armed to the disarmed position thereof.

In some forms of the invention, a door locking apparatus may be configured such that, once the lock-point arming device has been moved to the armed position, moving the outside handle-actuated control element from the intermediate to the second angular position thereof extends the at least one lock point. In this manner, the door may be locked from the outside without a key by sequentially moving the lock-point arming input element to the armed position while the door is standing open, closing the door, and raising the outside handle-actuated control element to the second position thereof.

A door locking apparatus, according to the invention, may be configured such that an outside handle-actuated control element is blocked against movement from the intermediate position thereof to the first position thereof when the lock-point arming control element is in the armed position. The door locking apparatus may also be configured such that, moving the inside handle-actuated input element from the intermediate position thereof to the first angular position thereof retracts the at least one lock-point and moves the lock-point arming input element from the armed to the disarmed position thereof.

In some forms of a door locking arrangement, according to the invention, having inside and outside handle-actuated control elements, the door locking arrangement may be selectively reconfigured in such a manner that the inside handle-actuated control element becomes an outside handle-actuated control element, and the outside handle-actuated control element becomes an inside handle-actuated control element.

Some forms of a locking arrangement, according to the invention, may further include a latch that is selectively moveable between a fully extended latch position thereof and a retracted position thereof through movement of either of an inside or an outside handle-actuated input element from the intermediate to the first position thereof, when the lock-point arming input element is in the disarmed position thereof, and through movement of only the inside handle-actuated input element from the intermediate to the first position thereof, when the lock-point arming input element is in the armed position thereof. A door locking apparatus, according to the invention, may be further configured such that movement of the inside and outside handle-actuated input elements from the intermediate to the second positions thereof can only move the at least one lock lock-point from the unlocked to the locked position there of when the latch is substantially in a fully extended latched position thereof.

In a door locking arrangement, according to the invention, a door locking apparatus may be either an active door locking apparatus, or an inactive door locking apparatus, and in some forms of the invention, a door locking arrangement may include both an active door locking apparatus and an inactive door locking apparatus.

An inactive door locking apparatus, according to the invention, may include one or more of the elements of a group consisting substantially of: an inside handle operatively connected to the inactive door handle-actuated control element; an outside handle operatively connected to the inactive door handle-actuated control element; a thumb-turn operatively connected to the inactive door lock-point arming input element; multiple inactive door lock-points; connecting and mounting elements for operatively connecting multiple inactive door lock-points to one another; and decorative hardware.

In a door locking arrangement, according to the invention, having both an active and an inactive door locking apparatus, the inactive door apparatus may include a latch receptacle and a latch blocker. The latch receptacle is configured for receiving therein the latch of the active door locking apparatus, and the latch blocker is moveably disposed in the latch receptacle. The latch blocker is operatively connected to the inactive door lock-point in such a manner that the latch of the active door locking apparatus is precluded from extending substantially fully into the latch receptacle when the inactive door lock-point is not in the locked position thereof. Where the active door locking apparatus includes multiple lock-points, the multiple active door lock-points may all be blocked against movement to their respective lock positions when the inactive door lock-point is not in the locked position thereof.

An inactive door locking apparatus, according to the invention, may have at least one inactive door lock-point, an inactive door lock-point actuation apparatus, a latch receptacle configured for receiving therein a latch of an active door locking apparatus, according to the invention, and a latch blocker moveably disposed in the latch receptacle. The at least one inactive door lock-point is operatively connected to the inactive door lock-point actuation arrangement for selectively moving the at least one inactive door lock-point between the locked and unlocked positions thereof. The latch blocker is operatively connected to the inactive door lock-point in such a manner that the latch of the active door locking apparatus is precluded from extending substantially fully into the latch receptacle when the inactive door lock-point is not in the locked position thereof.

In a door locking arrangement having both an active and an inactive door locking apparatus, according to the invention, the inactive door locking apparatus may include at least one inactive door lock-point, an inactive door lock-point actuation apparatus, an active door latch receptacle configured for receiving therein a latch of the active door locking apparatus, and an active door latch blocker moveably disposed in the latch receptacle. The at least one inactive door lock-point is operatively connected to the inactive door lock-point actuation apparatus for selectively moving the at least one inactive door lock-point between the locked and an unlocked position thereof. The active door latch blocker is operatively configured and connected to the inactive door lock-point actuation apparatus in such a manner that the lock-point of the inactive door locking apparatus is precluded from movement from the locked to the unlocked position thereof when the active door latch is in the latched position thereof. Where an inactive door locking apparatus, according to the invention, includes multiple door lock-points, all of the multiple inactive door lock-points may be blocked against movement from their respective locked positions to their respective unlocked positions, when the active door latch is in the latched position thereof.

An inactive door locking apparatus, according to the invention, may further include a handle-controlled actuation apparatus, selectively moveable between a first position thereof, a second position thereof, and an intermediate position thereof disposed between the first and second positions of the handle-controlled actuation apparatus, and an inactive door lock-point arming arrangement, including an inactive door lock-point arming input element that is moveable from an armed to a disarmed position thereof. The handle-controlled actuation apparatus and inactive door lock-point arming input device are configured and operatively connected such that, to move the inactive door lock-point from the unlocked to the locked position thereof, the handle-actuated input element is moved from the intermediate position to the second position thereof.

An inactive door handle-controlled actuation apparatus and inactive door lock-point arming device, according to the invention, may be further configured and operatively connected such that movement of the inactive door lock-point to the locked position thereof urges the inactive door lock-point arming input element to move to the armed position thereof and secure the inactive door lock-point in the locked position thereof. The inactive door handle-controlled actuation apparatus and inactive door lock-point arming arrangement may also be configured and operatively connected such that, with the inactive door lock-point in the locked position, moving the inactive door lock-point arming input element to the disarmed position thereof does not move the inactive door lock-point to the unlocked position thereof. The inactive door lock point arming input element may be spring-biased in such a manner that it is urged to move to the armed position thereof, such that, when the inactive door lock-point is moved to the locked position, or is in the locked position, the inactive door lock-point arming input element is biased to move toward the armed position thereof.

An inactive door locking apparatus, according to the invention, may be configured such that, to move the inactive door lock-point from the locked to the unlocked position thereof, the inactive door lock-point arming input element must be moved to, and held in, the disarmed position thereof, while the inactive door handle-controlled input element is moved to the second position thereof.

In a door locking arrangement, according to the invention, the active and inactive door locking apparatuses may be cooperatively configured, such that the inactive door handle-controlled input element is blocked against movement from the intermediate position thereof whenever a latch or a lock-point of the active door locking apparatus is disposed within a corresponding receptacle of the inactive door locking apparatus.

A door locking apparatus, according to the invention, may be a primary lock apparatus adapted for operative attachment to a door hinged to a door jamb for swinging motion about a door hinge axis, from a closed to an open position of the door, with the door defining an inside and outside surface thereof joined by oppositely disposed lock-side and hinge-side door edges, with the door having a longitudinal door length extending in a direction substantially parallel to the door hinge axis, a transverse door with extending substantially between the lock-side and hinge-side door edges, and a door thickness extending between the inside and outside surfaces of the door. The primary lock apparatus may be an active door lock apparatus, including an active door lock frame having operatively attached thereto: a lock-point actuation apparatus, including the at least one lock-point; independently operable first and second handle-operated actuation apparatuses, respectively including the first and second handle-controlled input elements; and a handle motion control apparatus, including the lock-point arming input element. The primary lock frame defines mutually orthogonally-directed longitudinal, transverse, and thickness axes of the active door lock apparatus, with the longitudinal active door lock axis extending substantially parallel to the door hinge axis and the transverse active door lock axis aligning respectively parallel to the door hinge axis and the width of the door when the active door lockset is operatively attached to the active door.

The lock-point actuation apparatus is operatively connected to the first and second handle-operable actuation apparatuses, and includes a lock-point actuation slide that is moveable along a substantially linear path in a direction substantially parallel to the longitudinal axis of the primary lock apparatus between a locked and an unlocked position of the lock-point actuation slide. The configuration and interconnection of the first and second handle-operated actuation apparatuses with the lock-point actuation apparatus is such that the lock-point actuation slide is urged to move from the locked to the unlocked positions thereof by movement of the input element of either of the first and second handle-operated input elements to the first position thereof, and such that the lock-point actuation slide is urged to move from the unlocked to the locked position thereof by movement of the input element of either of the first and the second handle-operated input elements to the second position thereof. The configuration and interconnection of the handle-motion control apparatus and the first and second handle-operated control apparatuses is also such that movement of the lock-point arming element between the armed and disarmed positions thereof controls selective movement of the input elements from the first and second handle-controlled actuation apparatuses, to thereby control movement of the lock-point actuation slide, and is yet further such that movement of the lock-point arming element between the armed and disarmed positions thereof does not move the lock-point actuation slide.

The first and second handle-controlled actuation apparatuses of a primary locking apparatus, according to the invention, may respectively take the form of first and second input hubs respectively forming the first and second handle-controlled input elements and first and second handle-motion control slides. The first and second input hubs may be rotatably mounted for independent rotation about a common input hub axis extending substantially parallel to the thickness axis.

The first handle-motion control slide is connected in gear mesh relationship with the first input hub, in such a manner that application of torque in a first direction to the first input hub urges angular motion of the first input hub in the first direction, to thereby impart linear motion in a first direction to the first handle-motion control slide and, such that application of torque in a second direction to the first input hub urges angular motion of the first input hub in the second direction, to thereby impart linear motion in a second direction to the first handle-motion control slide.

In similar fashion, the second handle-motion control slide is connected in gear mesh relationship with the second input hub in such a manner that application of torque in a first direction to the second input hub urges angular motion of the second input hub in the first direction, to thereby impart linear motion in a first direction to the second handle-motion control slide, and, such that application of torque in a second direction to the second input hub urges angular motion of the second input hub in the second direction, to thereby impart linear motion in a second direction to the second handle-motion control slide.

The first and second handle-motion control slides are both operatively connected to the lock-point actuation slide in such a manner that the lock-point actuation slide is urged to move from the locked to the unlocked position thereof by movement of the input hub of either of the first and second handle-motion control apparatuses to the first position thereof, and, such that the lock-point actuation slide is urged to move from the unlocked to the locked position thereof by movement of the input hub of either of the first and second handle-motion control apparatuses to the second position thereof.

The lock-point arming input element is operatively connected to both the first and second lock-point actuation slides in such a manner that: both the first and second lock-point actuation slides are precluded from moving to the second position thereof, when the lock-point arming input element is in the disarmed position thereof; and both the first and second lock-point actuation slides may be selectively and independently moved to the first position thereof, when the lock-point arming input element is in the disarmed position thereof.

The lock-point arming apparatus may be operatively connected to the frame, and include a lock-point arming input element in the form of an arming hub operatively attached to the frame for selective rotation about an arming hub axis extending substantially parallel to the thickness axis, for selective rotation from an armed to a disarmed angular position of the arming hub. The lock-point arming apparatus may further include: a traveling rack element, a handle-motion-control-slide stop-pivot element; a torsion spring; a pivotable gear sector element; and first and second selectively moveable handle-motion control slide pin-stops. The traveling rack element is connected in a gear mesh relationship with the arming hub, and slideably mounted in the frame for substantially linear movement between armed and disarmed linear positions of the traveling rack corresponding respectively to the armed and disarmed positions of the arming hub, in such a manner that moving the arming hub between the armed and disarmed positions of the arming hub urges a corresponding movement of the traveling rack element between the armed and disarmed positions thereof.

The stop pivot element is pivotably attached to the frame for pivotable movement between armed and disarmed angular positions thereof, and configured such that, when positioned in the disarmed position, the stop-pivot engages and precludes movement of either of the first and/or second handle-controlled slides to the respective second positions of the handle-control slides. The stop pivot element is further pivotably attached and configured such that, when positioned in the armed position thereof, the stop-pivot element disengages from, and does not preclude movement of, either of the first and/or the second handle-control slides to the respective second positions of the handle-control slides.

The traveling rack element and stop-pivot element are cooperatively configured and mounted for sliding engagement with one another, such that movement of the traveling rack element toward the disarmed position thereof urges the stop-pivot element to engage with the first and second handle-motion control slides, in such that movement of the traveling rack element toward the armed position thereof urges the stop-pivot element to disengage from the first and second handle-motion control slides.

The stop-pivot return spring is operatively connected between the frame and the stop-pivot element to provide a biasing force for urging the stop-pivot toward a position of sliding engagement with the traveling rack element.

The pivotable gear sector element is pivotably mounted to the frame and operatively connected in a gear mesh relationship to the arming hub in such a manner that movement of the arming hub to the armed position thereof moves the pivotable gear sector to an armed position thereof. The pivotable gear sector includes a stop-pin support arm adapted for removable attachment thereto of the first stop-pin, and configured for bringing the first stop-pin into alignment with a notch in one of the first and/or second handle-motion control slides, when the pivotable sector gear is in the armed position thereof, for precluding linear movement of the slide to the first position thereof. The second stop-pin is attached to the traveling rack element for operative engagement with the other of the first and/or second handle-motion control slides in such a manner that the other of the slides may move to the second position thereof without urging movement of the traveling rack element, but such that movement of the other of the slides to the first position thereof moves the traveling rack element linearly in such a manner that the gear mesh relationships between the traveling rack element and the arming hub rotates the arming hub from the armed to the disarmed positions thereof. Rotation of the arming hub simultaneously pivots the pivotable gear sector element from the armed to the disarmed positions thereof.

In some forms of the invention, the first and second stop-pins are mounted on opposite sides of the traveling rack element and gear sector arm to define the inside and outside handle actuator mechanisms.

The invention may also take the form of a method for constructing and/or operating a door locking apparatus, according to the invention. In a method for operating a door locking apparatus, according to the invention, wherein the locking apparatus includes an inside handle-actuated control element, an outside handle-operated control element, a lock-point actuation apparatus having at least one lock-point that is moveable from a locked to an unlocked position, and a lock-point arming input element that is selectively moveable between an armed and a disarmed position thereof, with the handle operated control elements being selectively moveable between first and second angular positions thereof, and intermediate angular positions thereof disposed between the first and second angular positions, a method, according to the invention, may include: moving the lock-point arming input element from the disarmed to the armed position thereof, and then moving at least one of the at least one lock-points from the unlocked to the locked position thereof by moving one of the handle-actuated control elements from the intermediate position thereof to the second position thereof. A method, according to the invention, may further include retracting the at least one lock-point and moving the lock-point arming input element from the armed to the disarmed position thereof by moving the inside handle-actuated control element from the intermediate position thereof to the first angular position thereof. A method, according to the invention, may also include, blocking the outside handle-actuated control element against movement from the intermediate position thereof to the first position thereof when the lock-point arming control element is in the armed position.

Other aspects, objectives and advantages of the invention will be apparent from the following detailed description of exemplary embodiments when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain exemplary embodiments, there is no intent to limit it to those embodiments. On the contrary, the intent is to cover all alternatives, modifications and equivalents as included within the spirit and scope of the invention as defined by the appended claims.

It will also be understood, that in order to facilitate description and understanding of the exemplary embodiments of the invention, relative terms such as upper and lower are utilized in the following description. It will be understood that where such terminology is utilized, that terminology applies strictly only to the orientation of elements in the figures, or to the particular application of the invention being discussed, and does not in any way constitute a limitation on the scope of the invention. For example, it is contemplated that the invention may be utilized in hinged panels having a hinge axis oriented vertically, horizontally, or at some angle other than vertical or horizontal.

DETAILED DESCRIPTION OF THE INVENTION

Figure 1:
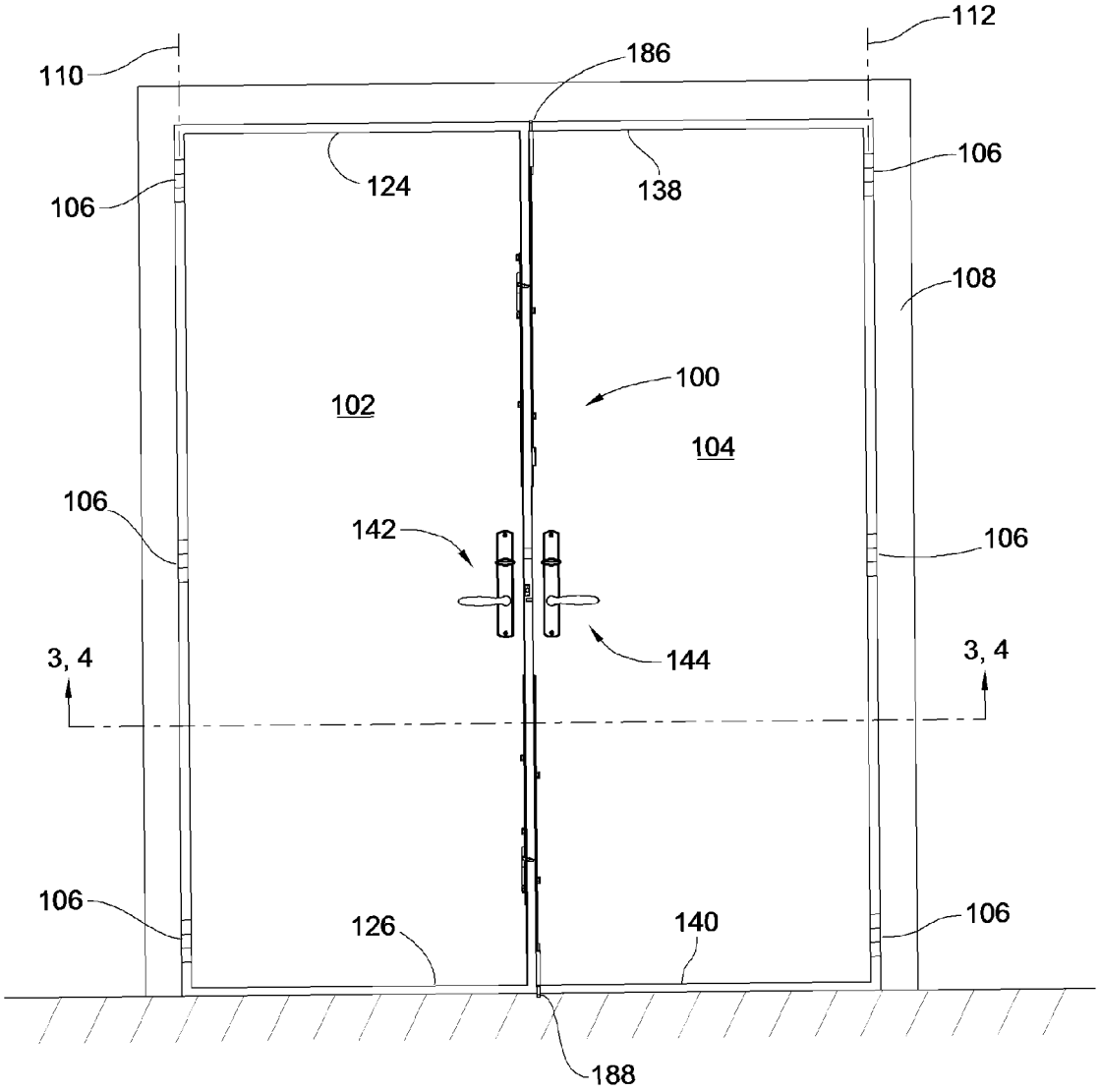
FIGS. 1 and 2 are inside and outside views, respectively, of an exemplary embodiment of a door-locking arrangement, according to the invention, utilized in a double-door arrangement.
Figure 2:
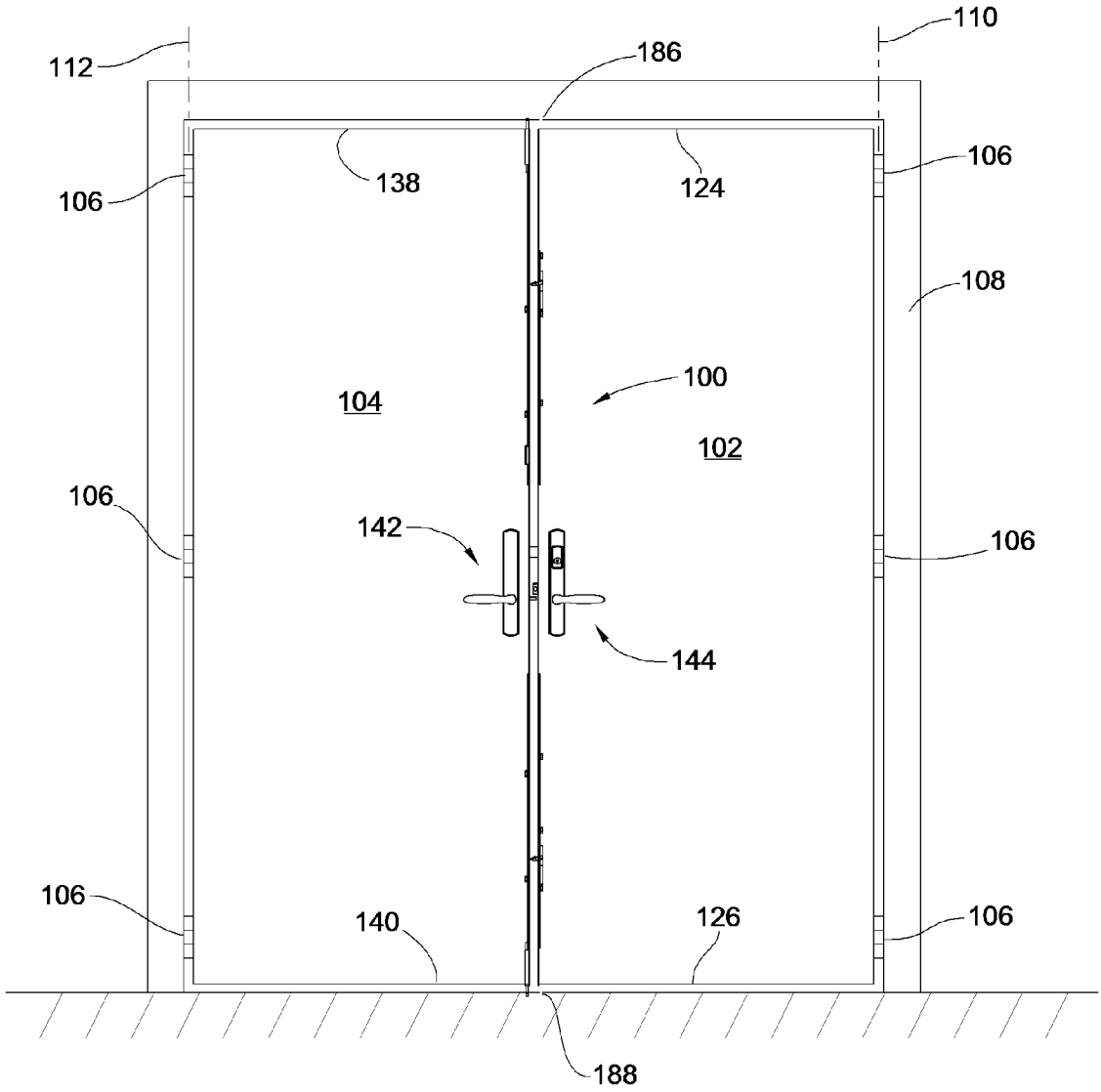

FIGS. 1 and 2 show a first exemplary embodiment in the form of a multi-point door-locking arrangement 100 installed in a double-door application, having an active door panel 102 and an inactive door panel 104 mounted by hinges 106 to a door frame 108. FIG. 1 shows the exemplary embodiment of the door locking arrangement 100, as viewed from inside of a space to be closed through operation of the doors 102, 104, and FIG. 2 shows the exemplary embodiment of the door locking arrangement 100 from outside of a space closed by the active and inactive doors 102, 104. Those having skill in the art will recognize that, although FIGS. 1-4 do not include any astragal for clarity of illustration, other embodiments of the invention having double doors may include an astragal.

Figure 3:
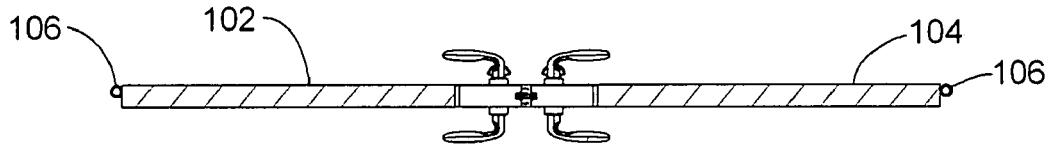
FIGS. 3 and 4, respectively, are cross-sectional views, taken along lines 3-3 and 4-4, as illustrated in FIG. 1, respectively showing the double doors in a closed and an open position thereof.
Figure 4:
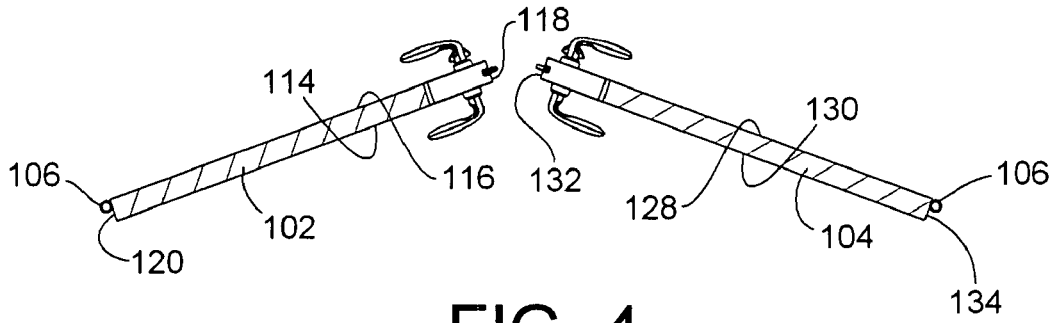

The active door panel 102 is attached by a set of the hinges 106 to the frame 108 for swinging motion about an active panel hinge axis 110 from a closed position of the active door, as shown in FIG. 3, to an open position of the active door 102, as shown in FIG. 4. In similar fashion, the inactive door panel 104 is attached by a second set of the hinges 106 to the door frame 108 for swing motion of the inactive door 104 from a closed position thereof, as shown in FIG. 3, to an open position of the inactive door 104, as shown in FIG. 4, about an inactive panel hinge axis 112.

As shown in FIG. 4, the active door 102 defines inside and outside surfaces 116, 114 thereof, joined by oppositely disposed lock-side and hinge-side door edges 118, 120. The active door 102 also has a longitudinal door length extending from a top edge 124 (as shown in FIG. 1) to a bottom edge 126 of the active door 102 in a direction substantially parallel to the active door hinge axis 110 (i.e. substantially vertically as shown in FIG. 1). The active door 102 also defines a transverse door width, extending substantially between the lock-side and hinge-side door edges, and a door thickness extending between the inside and outside surfaces 114, 116 of the door 102, with the longitudinal door length, transverse door width, and door thickness, all being substantially orthogonally directed with respect to one another. inside and outside surfaces 128, 130 thereof, joined by oppositely disposed lock-side and In similar fashion, the inactive door 104 defines hinge-side door edges 132, 134. The inactive door 104 also has a longitudinal door length extending from a top edge 138 (as shown in FIG. 1) to a bottom edge 140 of the inactive door 104 in a direction substantially parallel to the active door hinge axis 110 (i.e. substantially vertically as shown in FIG. 1). The inactive door 104 also defines a transverse door width extending substantially between the lock-side and hinge-side door edges, and a door thickness extending between the inside and outside surfaces 128, 130 of the door 104, with the longitudinal door length, transverse door width, and door thickness, all being substantially orthogonally directed with respect to one another.

As shown in FIGS. 1 and 2, the exemplary embodiment of the multi-point door-locking arrangement 100 includes a multi-point active door-locking arrangement 142 and a multi-point inactive door-locking arrangement 144.

Figure 5:
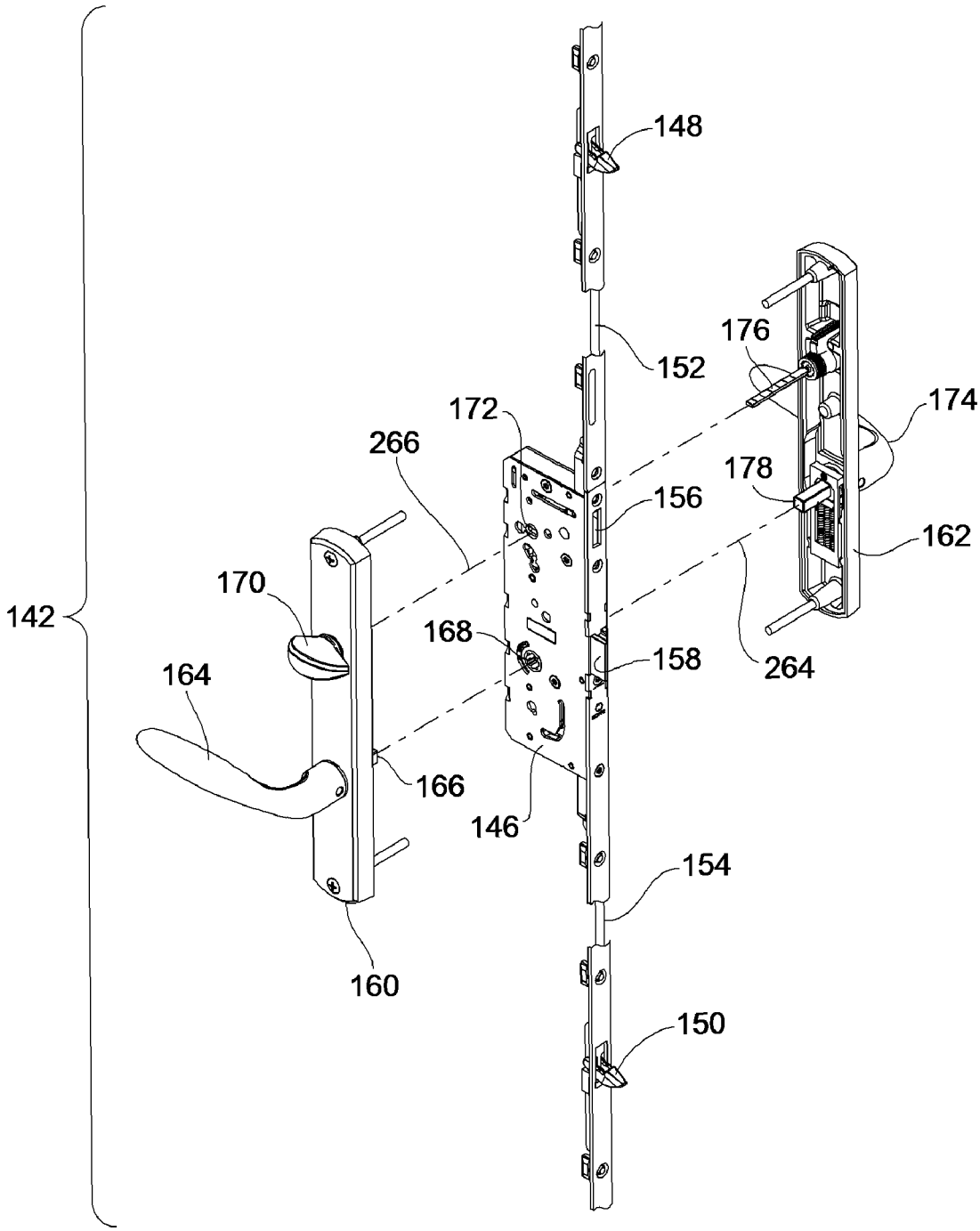
FIG. 5 is a partially exploded perspective view of an active door-locking apparatus, of the exemplary embodiment of the door-locking arrangement of FIG. 1.

As shown in FIG. 5, the multi-point active door locking arrangement 142 includes a primary locking apparatus 146, and upper and lower secondary locking apparatuses, in the form of upper and lower tongue lock-points 148, 150. The active door locking arrangement 142 also includes upper and lower lock-point drive rails 152, 154, for operatively connecting the primary locking apparatus 146 to both the upper and lower tongue lock points 148, 150, respectively.

The primary locking apparatus 146, of the exemplary embodiment 100, includes both a primary lock-point, in the form of a deadbolt 156, and a latch 158. In the exemplary embodiment of the locking arrangement 100, the primary active door locking apparatus 146, the upper and lower tongue lock points 148, 150, and the upper and lower secondary lock point drive rails 152, 154 are all mounted within grooves or mortises (not shown) cut into the lock-side edge 118 of the active door 102, in a manner known in the art. The active door locking arrangement 142 also includes mounting elements and decorative trim (not shown) for securing the components of the active door locking arrangement within their respective mortises, and for partially closing the opening of the mortises for a pleasing aesthetic appearance.

The active door locking arrangement 142 also includes an inside handle assembly 160, and an outside handle assembly 162.

Figure 6:
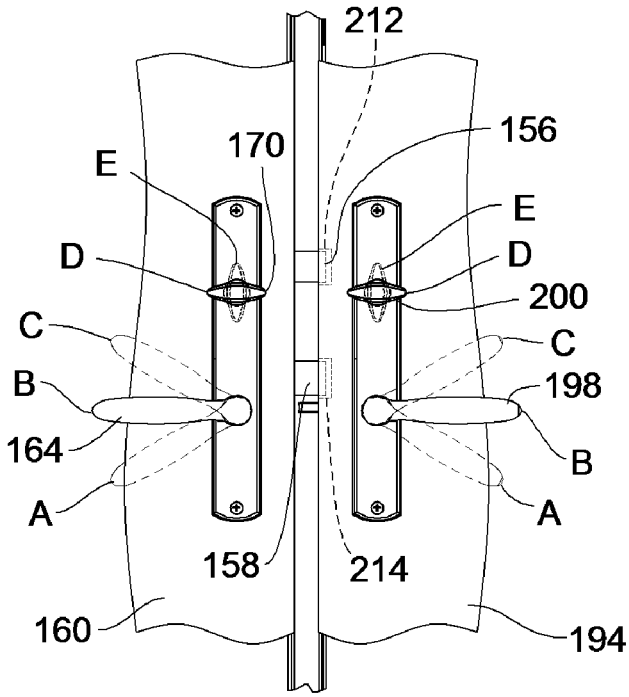
FIGS. 6 and 7 are enlarged schematic views of the inside and outside lock control hardware, respectively, for the inside and outside of the double doors shown in FIGS. 1 and 2.

As shown in FIG. 5, the inside handle assembly 160, of the active door locking arrangement 142 includes an inside handle 164, a handle return spring cartridge (not shown) and a thumb turn 170. As shown in FIG. 6, the active door inside handle 164 is angularly rotatable downward to a first position thereof, as indicated at A in FIG. 6, from a substantially horizontally oriented intermediate position, indicated at B in FIG. 6, or alternatively rotated upward to a second position thereof, as indicated at C in FIG. 6. The thumb turn 170 is angularly rotatable from an armed position thereof, as indicated by D in FIG. 6 to a disarmed position thereof, as indicated by E in FIG. 6.

As shown in FIG. 5, the inside handle 164 of the active door locking arrangement 142 has a square shaft 166 protruding therefrom, and adapted for engaging a first handle-actuated input hub 168 of the primary locking apparatus 146 of the active door locking arrangement 142.

Figure 7:
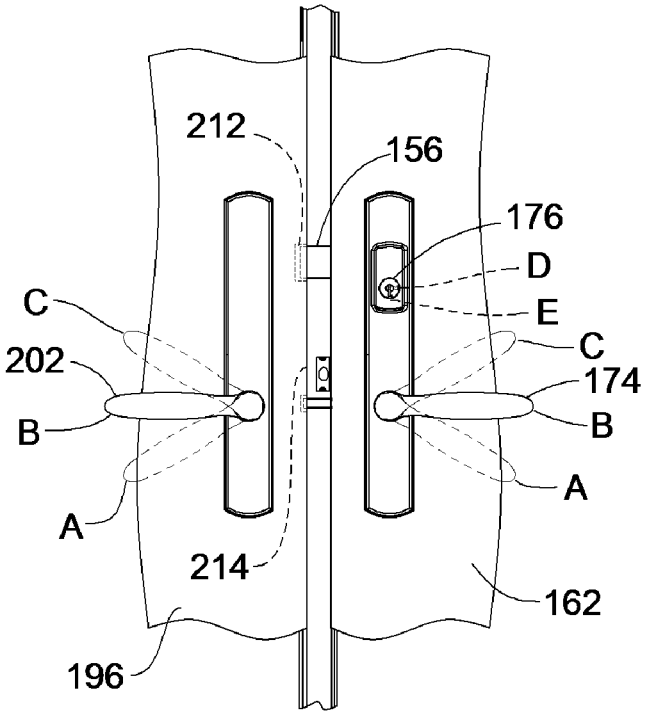

As shown in FIGS. 5 and 7, the outside handle assembly 162 of the active door locking arrangement 142 includes an outside handle 174, a handle return spring cartridge (not shown) and a keyed lock-cylinder 176. As shown in FIG. 7, the active door outside handle 174 is angularly rotatable downward to a first position thereof, as indicated at A in FIG. 7, from a substantially horizontally oriented intermediate position, indicated at B in FIG. 7, or alternatively rotated upward to a second position thereof, as indicated at C in FIG. 7. The tailpiece 178 of the keyed lock-cylinder 176 is angularly rotatable from an armed position thereof, as indicated by D in FIG. 6 to a disarmed position thereof, as indicated by E in FIG. 7.

Figure 9:
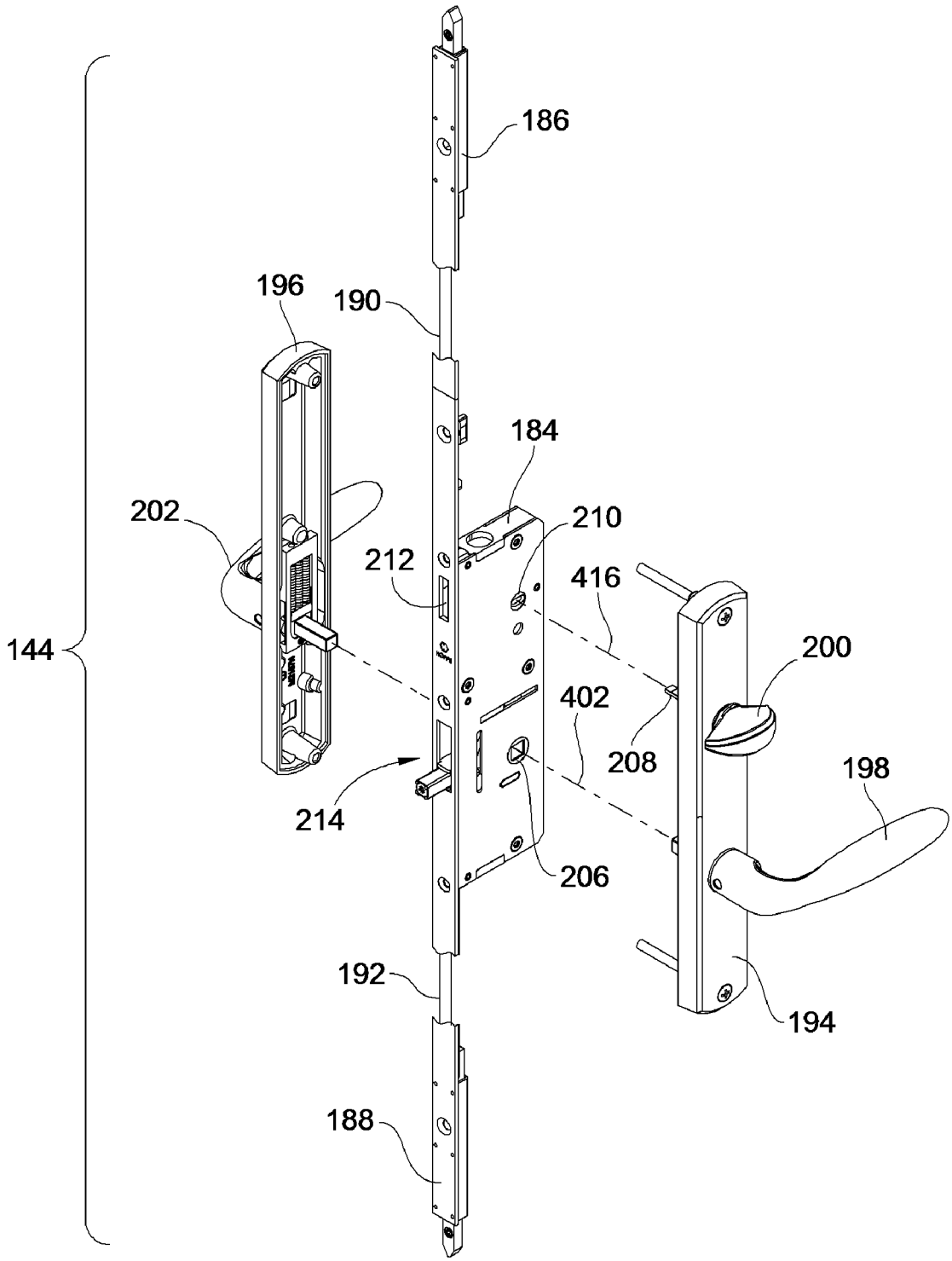
FIG. 9 is a partially exploded perspective illustration of the inactive door-locking apparatus, of the exemplary embodiment of the locking arrangement, according to the invention, shown in FIGS. 1 and 2.

As shown in FIG. 9, the inactive door locking arrangement 144, of the exemplary embodiment of the door locking arrangement 100, includes a primary inactive door-locking apparatus 184, and upper and lower shoot-bolt lock-points 186, 188, for engaging a header and a sill of the door frame 108, above and below the inactive door 104, in the manner illustrated in FIGS. 1 and 2. The upper and lower shoot-bolts 186, 188 are connected to the primary inactive door locking apparatus 184 via upper and lower shoot-bolt drive rails 190, 192.

The multi-point inactive door-locking arrangement 144 also includes inside and outside inactive door handle assemblies 194, 196.

As shown in FIG. 9, the inside handle assembly, of the multi-point inactive door-locking apparatus 144 includes an inside handle 198, and a thumb turn 200.

The outside handle assembly 196, for the multi-point inactive door-locking apparatus 144, includes an outside handle 202 of the inactive door 104. The inside and outside door handles 198, 202 may be either mounted on opposite ends of a common handle shaft 204 passing through a square hole in a handle-actuated-input-element 206 of the primary inactive door locking apparatus 184, or mounted on independent handle shafts (not shown) that both engage the square opening as is known in the art, in such a manner that when either the inside or outside handles 198, 202 of the inactive door 104 are moved downward to a first position, designated as A in FIGS. 6 and 7 from an intermediate position, designated as B in FIGS. 6 and 7, or to a second position, designated as C in FIGS. 6 and 7, the other of the inside and outside handles 198, 202 of the inactive door 104 is moved in a similar fashion.

As shown in FIG. 9, the thumb turn 200, of the inside handle assembly 194 of the inactive door 104 has extending therefrom a rectangular drive tang 208 configured for operatively engaging a slot in a lock-point-arming-input element 210 of the primary inactive door locking apparatus 184.

As shown in FIGS. 6, 7 and 9, the primary inactive door locking apparatus 184 also defines a deadbolt receptacle 212, and a latch receptacle 214 for respectively receiving therein the deadbolt 156 and latch 158 of the primary active door locking apparatus 142, under certain operating conditions described in greater detail below.

Active Door-Locking Apparatus

Figure 11A:
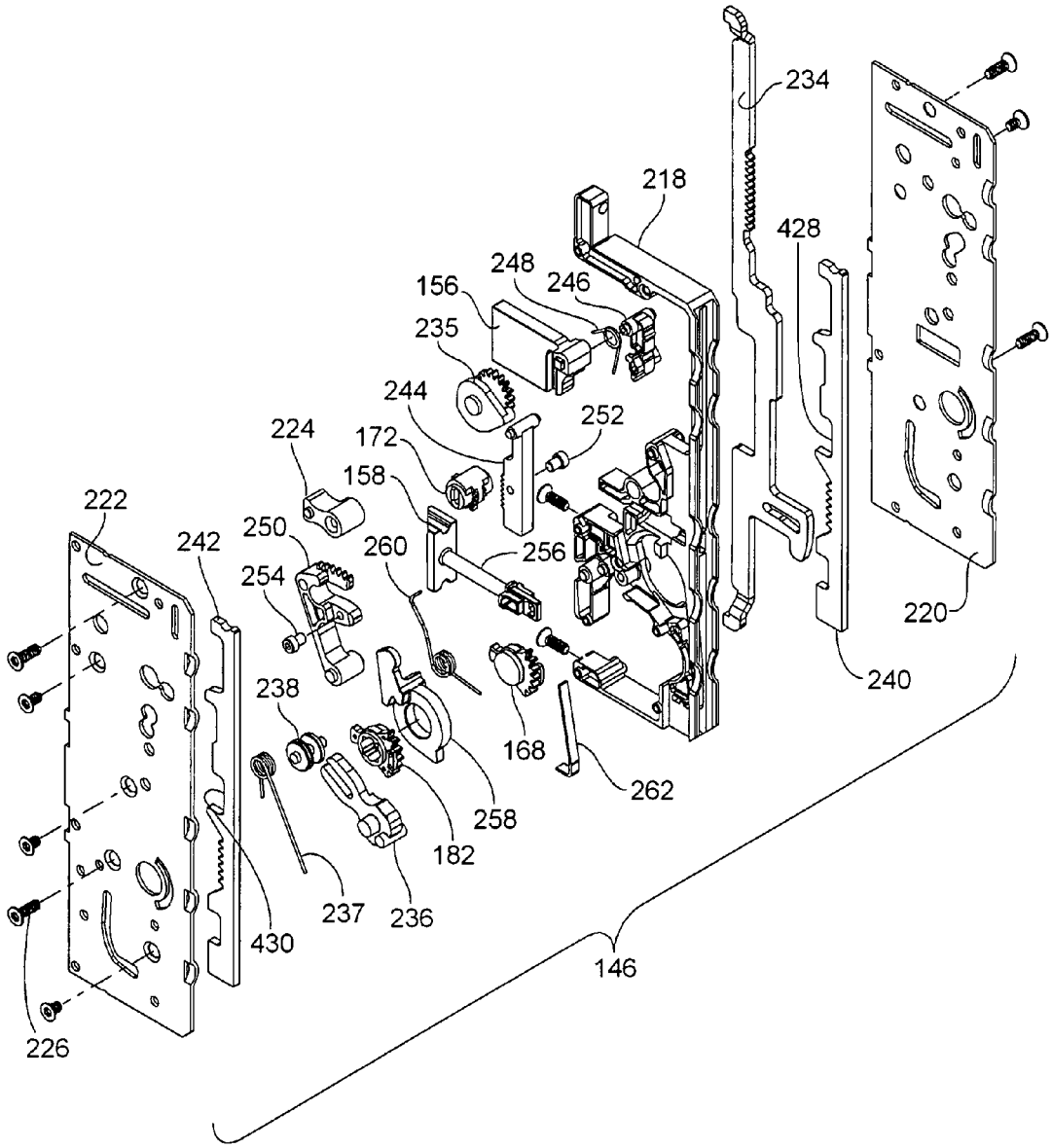
FIGS. 11A-11D are exploded perspective illustrations of the exemplary embodiment of the primary active door-locking apparatus, shown in FIG. 8, illustrating various details of the construction and interconnection of the components of the primary active door-locking apparatus.

As shown in FIG. 11A, the exemplary embodiment of the active door primary locking apparatus 146 includes an active door lock frame 216, including a center frame member 218, first and second mirror-imaged frame side plates 220, 222, and a frame spacer 224. The first and second frame side plates 220, 222, and the frame spacer 224, are joined together by a series of countersunk-head screws 226, with only one machine screw 226 being given a reference numeral and leader in FIG. 11A, for clarity of illustration. The center frame member 218, and the first and second frame side plates 220, 222 include a plurality of holes, and slots extending therethrough, which serve to position and guide internal components of the primary active door lock apparatus 146, in a manner which will be described in greater detail below.

Figure 8:
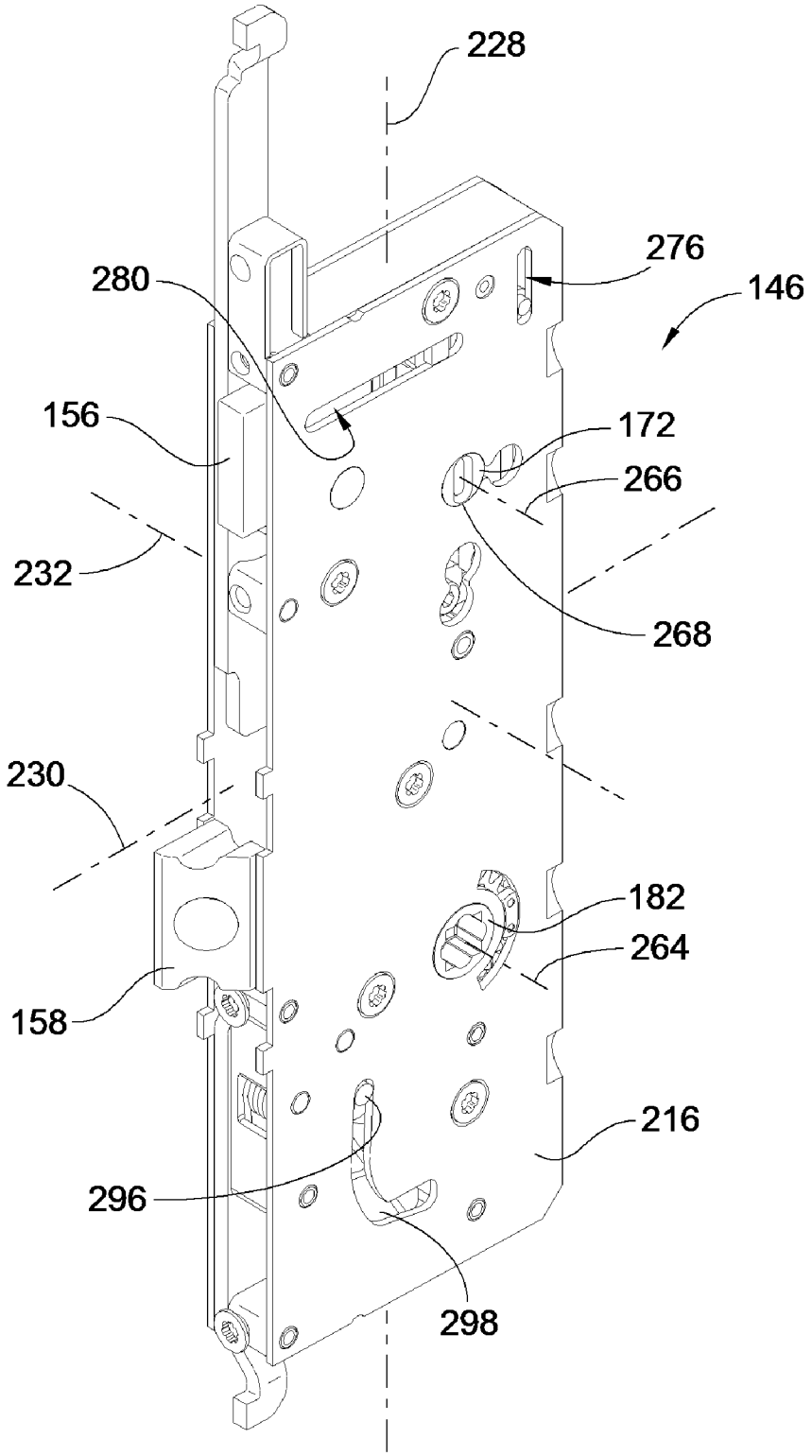
FIG. 8 is a perspective view of a primary active door-locking apparatus, of the active door locking arrangement of FIG. 5.

As shown in FIG. 8, the active door lock frame 216 for the primary door lock apparatus 146 defines mutually orthogonally directed longitudinal, transverse and thickness axes 228, 230, 232, with the longitudinal active door lock axis 228 extending substantially parallel to the active door hinge axis 110 (see FIG. 1), and the transverse active door lock axis 230 aligning respectively perpendicular to the active door hinge axis 110, and parallel to the width of the active door, when the active door locking arrangement 142 is operatively attached to the active door 102.

The primary active door locking apparatus 146 includes five major sub-groupings of active components operatively connected to the active door lock frame 216, with these sub-groups including: a lock-point actuation apparatus; a first independently operable handle-controlled actuation apparatus; a second independently operable handle-controlled actuation apparatus; a lock-point arming apparatus; and a latch apparatus. To facilitate an understanding of the construction and operation of the exemplary embodiment of the primary active door locking apparatus 146, the various components included in each of the five sub-groupings set out above, will initially be identified with reference to FIG. 11A, and then the configuration and interconnections of the various components and sub-groupings thereof will be described in more detail below, with reference to additional drawing figures.

As shown in FIG. 11A, the lock-point actuation apparatus sub-group includes: a lock-point actuation slide 234; the deadbolt 156; the deadbolt actuator 235; a lock-point drive lever 236; and a lock-point drive-pin 238.

The first independently operable handle-controlled actuation apparatus sub-group includes: the first handle actuated control element, in the form of a first input hub 168, and a first handle-motion-control-slide 240. In similar fashion, the second independently operable handle-controlled actuation apparatus sub-group includes the second handle-actuated control element, in the form of a second input hub 182, and a second handle-motion-control-slide 242.

The lock-point arming apparatus sub-group includes: the lock-point arming input element, in the form of an arming hub 172; a traveling rack element 244; a handle-motion-control-slide stop-pivot element 246; a torsion spring 248; a pivotable-gear-sector element 250; a first selectively moveable handle-motion-control-slide stop-pin 252; and a second selectively moveable handle-motion-control-slide stop-pin 254.

The latch apparatus sub-group includes: a latch element 256; a latch drive 258; a latch return spring 260; and a latch drive return spring 262.

Figure 11B:
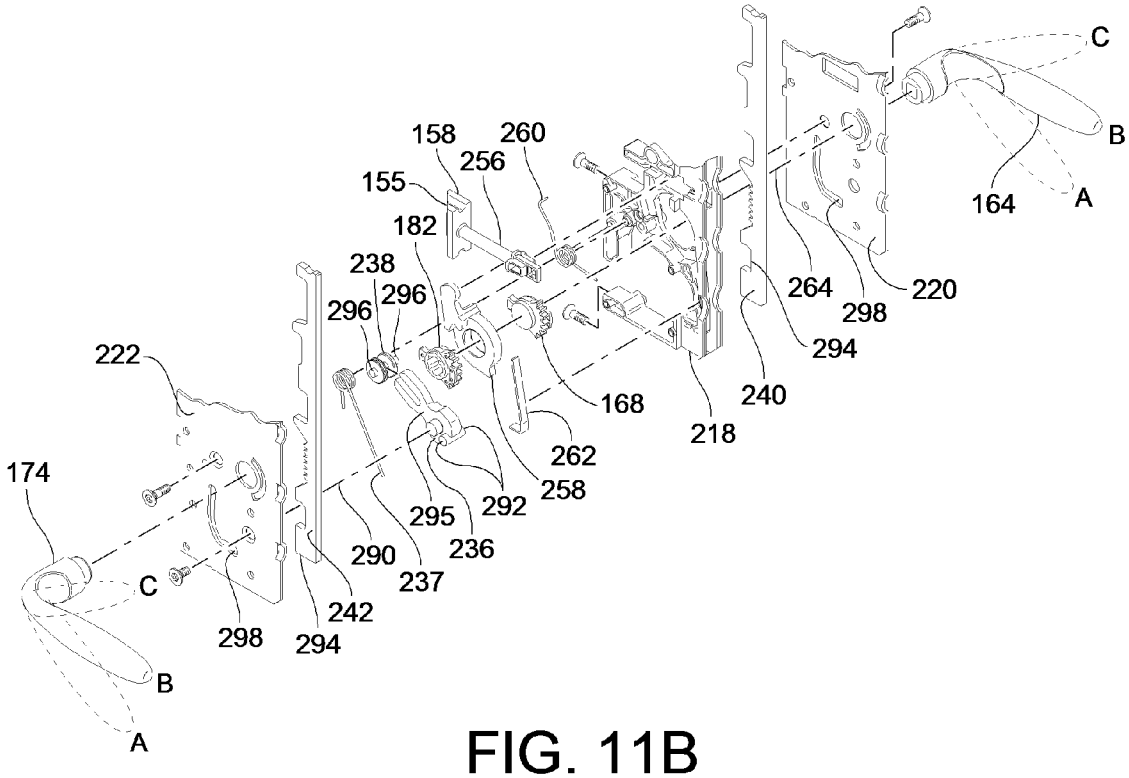

As shown in FIGS. 8 and 11B, the first and second handle-actuated input hubs 168, 182, and the latch drive 258 are mounted within the frame 216 for rotation about a common axis 264. The inside handle 164 is connected to the first input hub 168, for rotating the first input hub 168 about the common axis 264 between the first, intermediate, and second angular positions A, B, C of the handle 164. In similar fashion, the outside handle 174 is connected to the second input hub 182 for independently rotating the second input hub 182 about the common axis 264 between the first, intermediate, and second angular positions A, B, C of the outside handle 174.

Figure 11D:
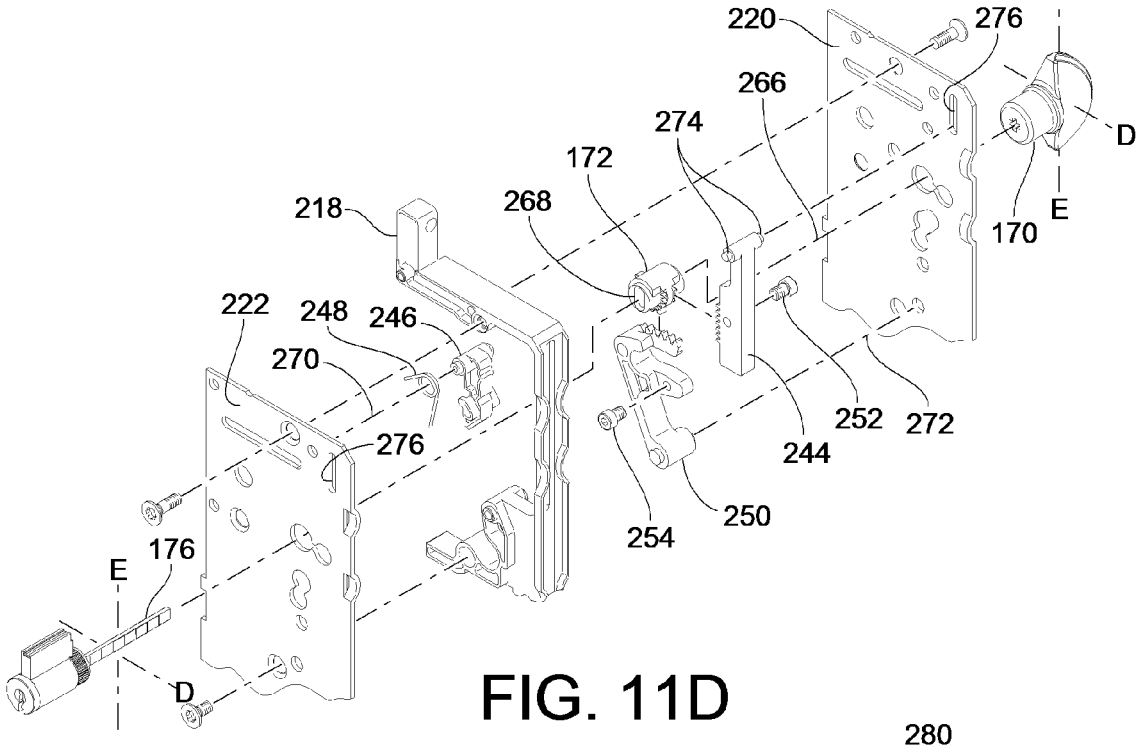

As shown in FIGS. 8 and 11D, the lock-point arming input hub 172 is mounted within the frame 216 for rotation about an axis 266. As illustrated in FIGS. 5 and 11D, the thumb turn 170 and the keyed lock cylinder 176 are interconnected to engage the lock-point arming hub 172 along the axis 266, in such a manner that the lock-point arming hub 172 can be rotated about the axis 266 by either the thumb turn 170 or the keyed cylinder 176 of the active door locking apparatus 142 to thereby rotate the lock-point arming hub 172 between an armed position D thereof, whereat a slot 268 in the arming hub 172 is substantially horizontally oriented at the disarmed position E thereof, whereat the slot 268 in the arming hub 172 of the active lock apparatus 146 is oriented substantially parallel to the longitudinal axis 228 of the active door locking apparatus 146.

As shown in FIG. 11D, the handle-motion-control-slide stop-pivot 246 is pivotably attached at an upper end thereof (as shown in the drawings of the exemplary embodiment) pivotably attached to the frame 216 about a stop-pivot axis 270, and the pivotable gear sector element 250 is pivotably attached at a lower end thereof, to the frame 216, for pivoting motion about a gear sector axis 272 which extends substantially parallel to the transverse axis 232 of the active door lock apparatus 146.

Figure 11C:
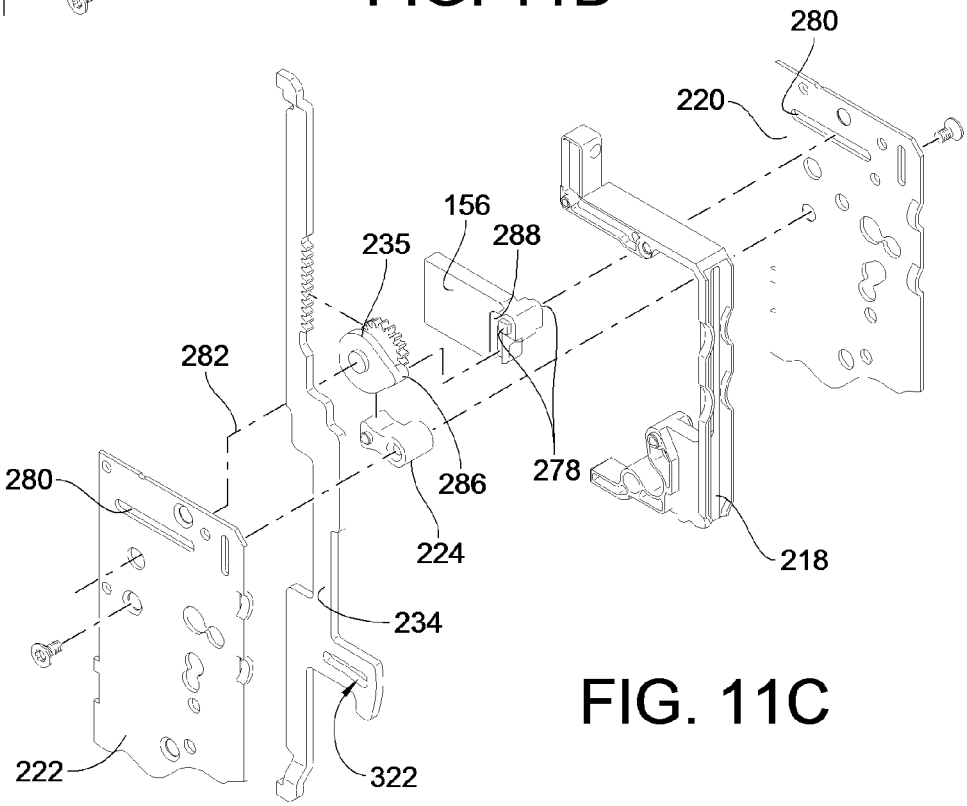
Figure 12:
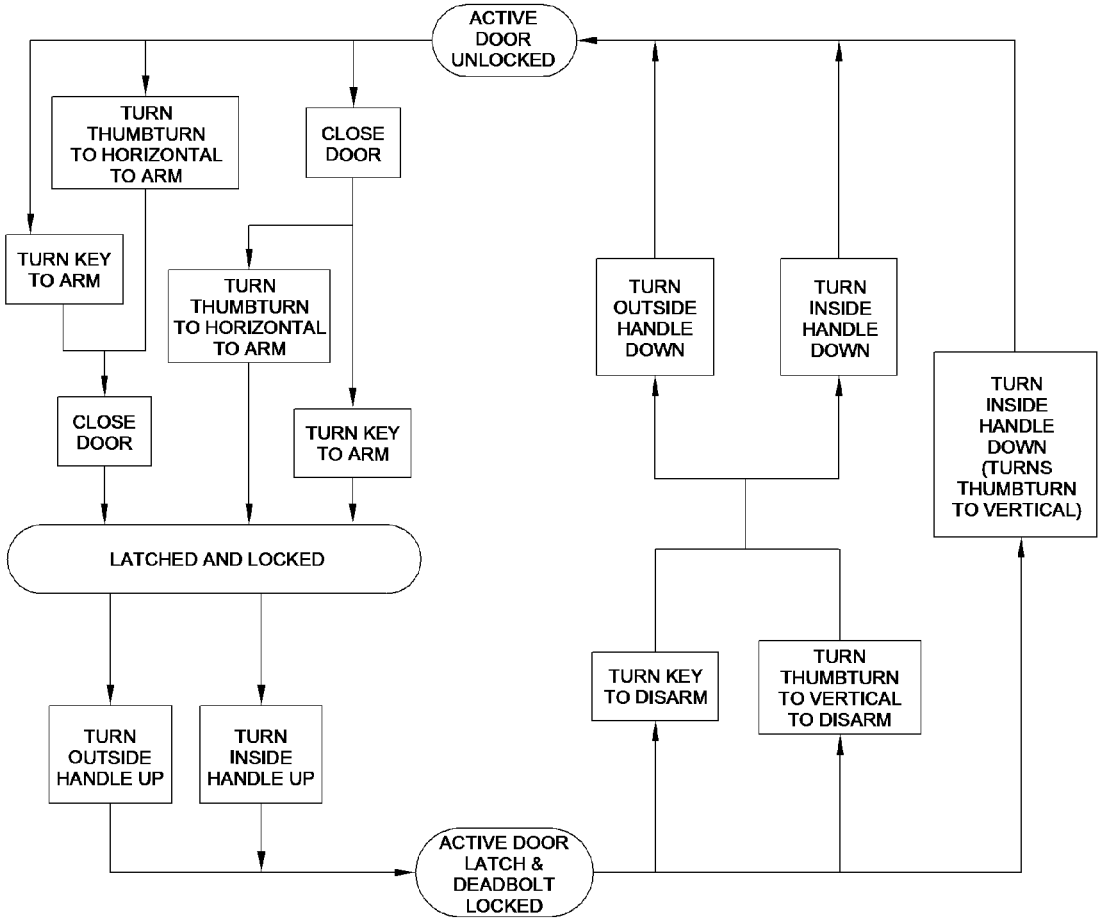
FIG. 12 is a block-diagram illustrating operation of the primary active door locking apparatus of FIG. 8 and FIGS. 11A-11D.

As shown in FIG. 11D, a pair of guide pins 274 of the traveling rack 244 operatively engaged slots 276 in the frame side plates 222, 220 for guiding the traveling rack 244 along a linear path extending substantially parallel to the longitudinal axis 228 of the active door locking apparatus 146. In similar fashion, as shown in FIG. 11C the deadbolt 156 includes a pair of protruding guide pins 278 at an interior end thereof, which operatively engage guide slots 280 in the first and second side plates 220, 222 of the frame 216 for guiding the deadbolt 156 along a path extending substantially parallel to the transverse axis 230 of the active door locking apparatus 146. As further shown in FIG. 11C, the deadbolt actuator 235 is attached to the frame 216 for rotation about a deadbolt actuator axis 282. The deadbolt actuator 235 includes a cam pin 286, extending therefrom, and configured to engage with a longitudinally-oriented slot 288 in the deadbolt 156, in such a manner as the deadbolt actuator 235 is rotated about the deadbolt actuator axis 282, the deadbolt actuator cam pin 286 interacts with the slot 288 in the deadbolt 156 to cause linear motion of the deadbolt 156 along the slots 280 in the first and second endplates 220, 222 of the frame 216.

As shown in FIG. 11B, the lock-point drive lever 236 is pivotably attached to the frame 216 for pivoting movement about a lock-point-drive-lever axis 290. A pair of protrusions 292 at one end of the lock-point-drive-lever 236 are configured to engage with notches 294 in the lower end of the first and second handle-motion-control slides 240, 242. An opposite end of the lock-point-drive lever 236 is forked and includes a slot 295 therein, for slideable receipt therein of the lock-point drive pin 238. A pair of guide pins 296 extend in opposite directions, substantially parallel to the thickness axis 232 of the active door locking apparatus 146, and engage a pair of curved slots 298 in the first and second frame side plates 220, 222 for guiding the lock-point drive pin 238 along a curved path defined by the curved slots 298 as the lock-point drive lever 236 pivots about its lock-point drive lever axis 290.

Additional structural details of the exemplary embodiment of the primary active door locking apparatus 146, and operation of the active door locking apparatus 146 will now be presented with reference to the flow chart of FIG. 12 and FIGS. 13A-B, 14A-B, 15A-B, 16A-B, 17A-B, and 18A-B.

Latch-Only Operation

FIGS. 13A-B, 14A-B and 15A-B illustrate the active door locking apparatus 146 in various states, wherein the primary active door locking apparatus 146 is utilized for securing the active door 102 in a closed position, without the deadbolt 156, and with either no locking functionality, or with a latched and armed locking functionality. Operation in the latch-only mode would be used, for example, in normal passage situations to provide unlocked closure of an enclosed space to isolate the space from the elements, while still providing ready ingress and egress into and out of the enclosed space. The latched and armed function would be utilized to provide a first level of security against unwanted entry into the enclosed space through the active door 102.

Figure 13A:
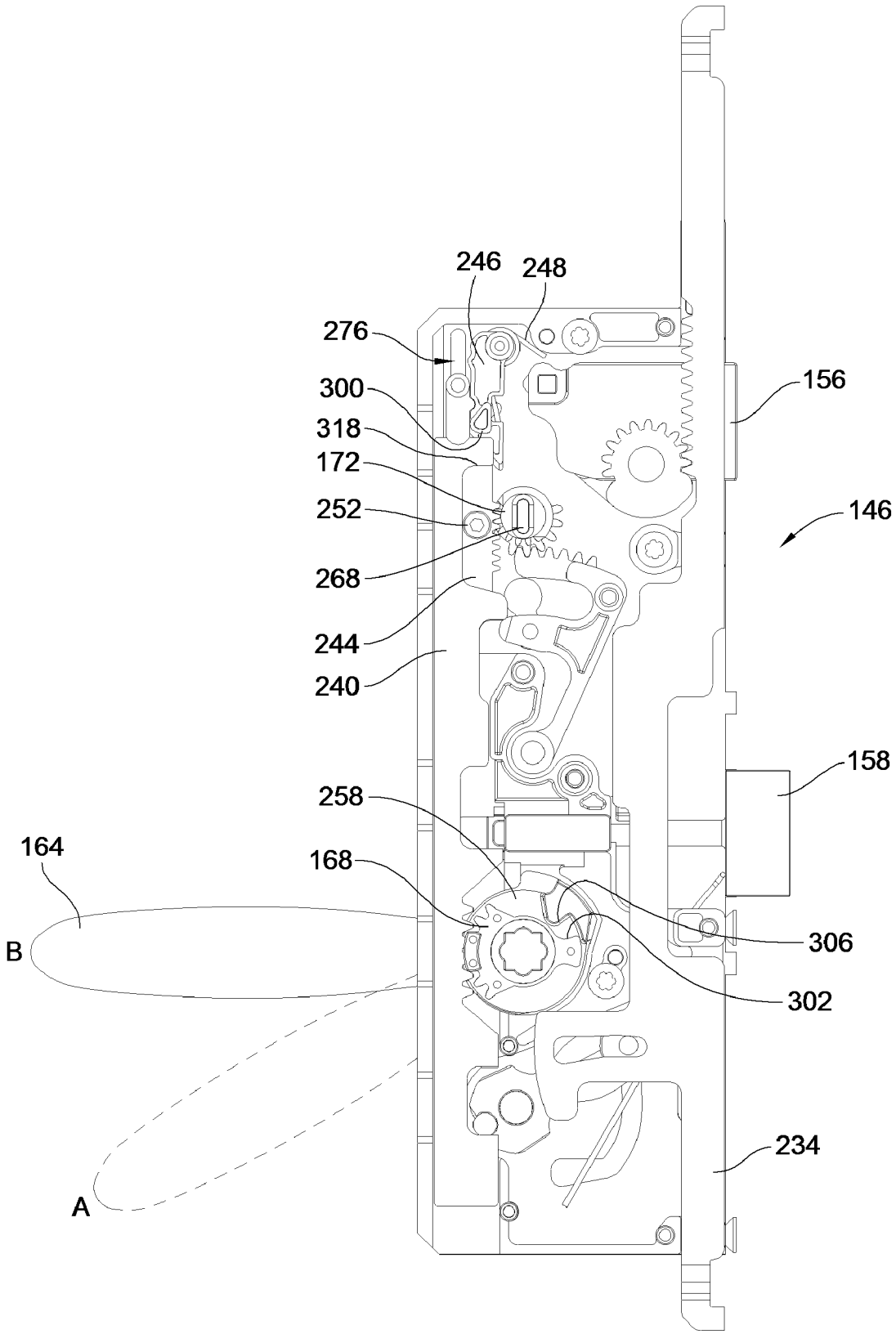
FIGS. 13A-B, 14A-B, and 15A-B, are a series of matching interior and exterior side views of the exemplary embodiment of the primary door-locking apparatus, illustrating operation of the primary active door-locking apparatus in various latch-only operating modes and states.
Figure 13B:
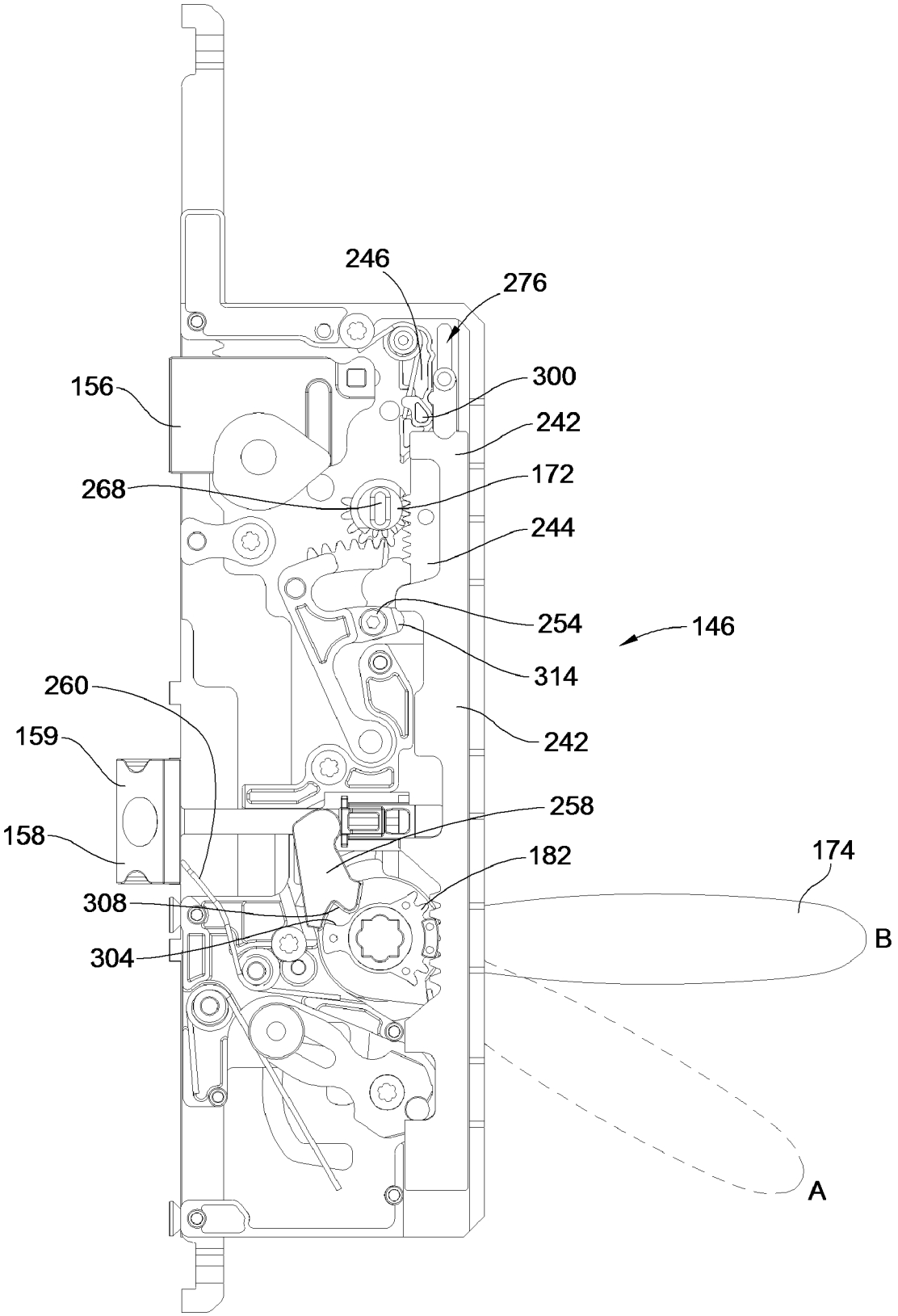

FIGS. 13A and 13B show interior and exterior views of components inside of the active door primary locking apparatus 146, with the locking apparatus 146 in an "at-rest-state," in which the arming hub 172, and the thumb turn 170, are positioned in the disarmed state E, as indicated by the fact that the slot 268 in the arming hub 172 is oriented in a longitudinal direction; the deadbolt 156 is in a retracted, unlocked, position thereof, and the latch 158 is in an extended, latched, position thereof. As shown by solid lines in FIGS. 13A-13B, the inside and outside active door handles 164, 174 are positioned, at rest, in the intermediate position B thereof, and, as indicated by dashed lines in FIGS. 13A and 13B, the inside and outside handles 164, 174 are moveable downward from the intermediate position B to the first position A, for moving the latch 158 to a retracted, unlatched position thereof, as illustrated in FIGS. 14A and 14B.

The positional states shown in FIGS. 13A and 13B would exist, for example, when the active door 102 was standing unattended in a closed position, with the latch 158 extending into the latch receptacle 214 of the inactive door locking apparatus 144, to secure the active door 102 in a latched position against a latch striker plate (not shown) of the inactive door 104, or when the active door 102 was standing in an open position. For embodiments of the invention having only a single active door 102 hinged within a door jamb 108, the states shown in FIGS. 13A-B would also occur when the active door 102 was standing in an open position, or when the latch 158 was resting within a latch receptacle (not shown) attached to the door jamb 108 against a latch strike plate (not shown) also attached to the door jamb 108 of the single door arrangement.

It will be noted, that with the lock-point arming hub 172 disposed in the disarmed position thereof, as shown in FIGS. 13A-B, 14A-B and 15A-B, a gear mesh arrangement between the arming hub 172 and the traveling rack 244 constrains the traveling rack 244 in a lowered, disarmed position thereof, within the longitudinally oriented traveling rack guide slots 276 in the first and second side plates 220, 222 of the frame 216. With the traveling rack 244 thus positioned in its disarmed position, the handle-motion-control-slide stop pivot 246 is held in a substantially longitudinally oriented angular position by the torsion spring 248, in such a manner that a portion of the distal end 300 of the handle-motion-control-slide stop-pivot 246 bears against the upper ends of both the first and second handle-motion-control slides 240, 242. By virtue of the contact of the distal end 300 of the substantially longitudinally oriented stop pivot 246 with the top ends of the both the first and second handle-motion-control-slides 240, 242, it will be recognized that the handle-motion-control-slides 242, 242 cannot be moved longitudinally in the upward direction, which consequently, by virtue of the respective gear mesh relationships between the first input hub 168 and the first handle-motion-control-slide 240, or the gear mesh relationship between the second input hub 182 and the second handle-motion-control-slide 242, precludes movement of either the inside or outside handles 164, 174 to the second positions C thereof, so long as the arming hub 172 is positioned in its disarmed position.

Figure 14A:
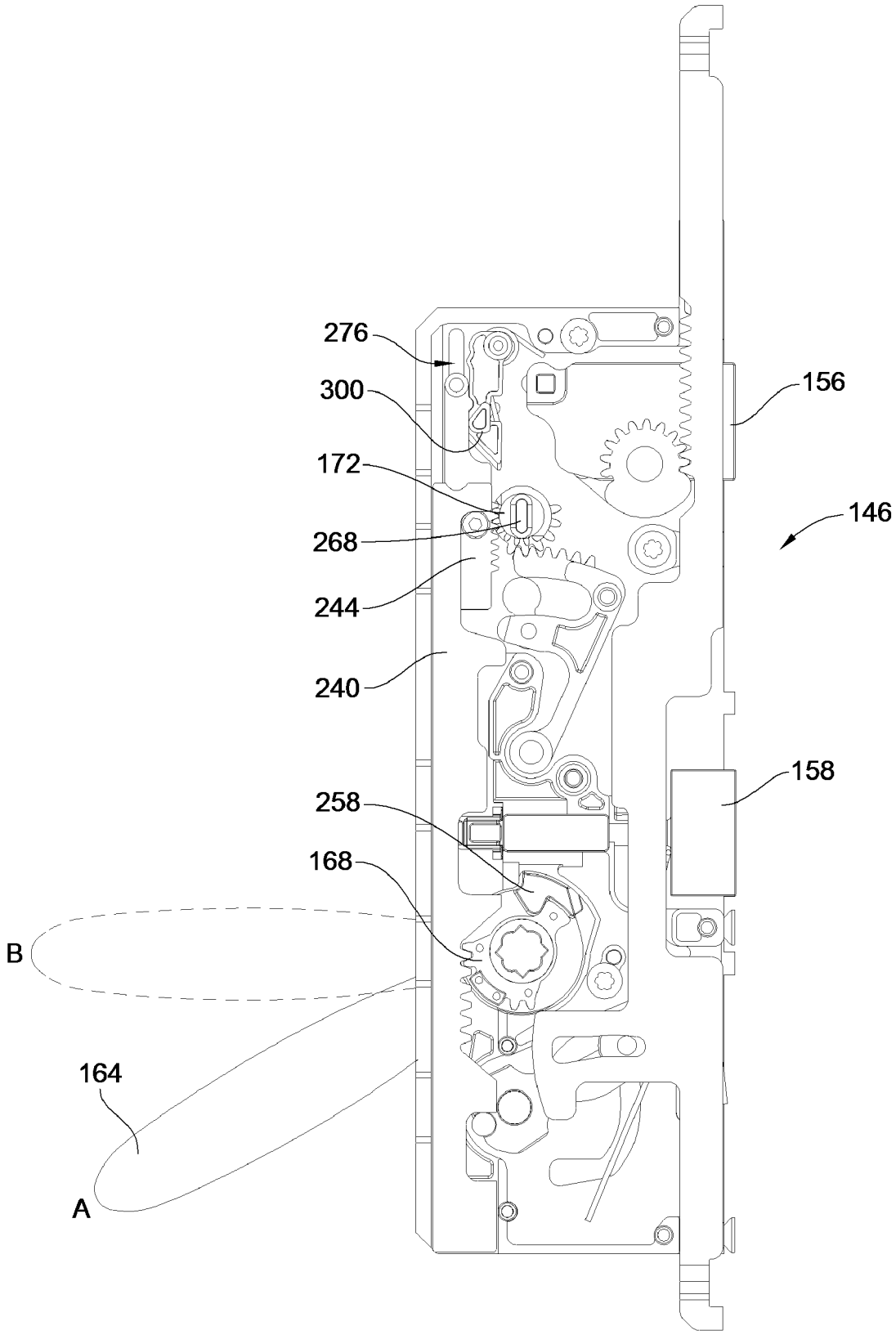
Figure 14B:
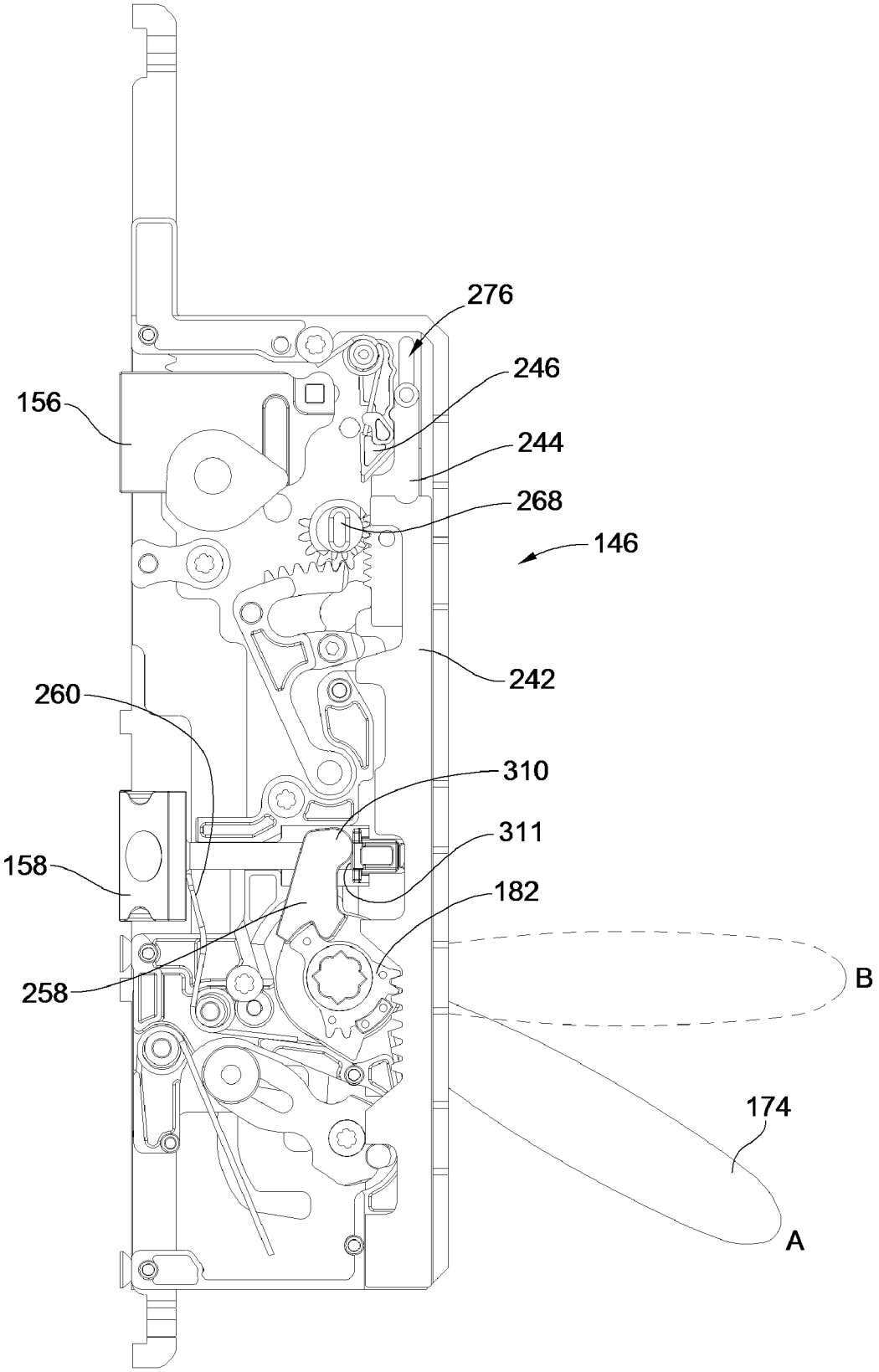

As shown in FIGS. 14A and 14B, independent movement of either of the inside or outside handles 164, 174 of the active door panel 102 downward to the first position A thereof, from the state positions shown in FIGS. 13A and/or 13B, causes the first or second input hubs 168, 182 to rotate about their common axis 264 to an unlatched angular position thereof, with corresponding respective contact between corresponding mating surfaces 302, 306 of the first input hub 168 and the latch drive 258, or corresponding surfaces 304, 308 of the second input hub 182 and the latch drive 258. Contact between one of the corresponding pairs 302, 306 or 304, 308, as either the inside handle 164 or the outside handle 174, of the active door 102, are moved from the intermediate position B to the first position A thereof causes a corresponding rotation of the latch drive 258 about the common axis 264, which in turn causes a latch-drive-arm 310, of the latch drive 258 to exert a transversly directed force against a shoulder 311 for moving the latch 158 from the latched position thereof, as shown in FIGS. 13A-13B, to an unlatched position thereof as shown in FIGS. 14A-14B. When the handle 164 or 174, used for retracting the latch 158, is released, the latch return spring 260 will drive the latch 158, latch drive 258, and the input hub 168 or 182 attached to the handle 164 or 174 from the unlatched position shown in FIG. 14B to the latched position shown in FIG. 13B. In some embodiments of the invention, a handle return spring cartridge (not shown) is used to return the handles 164 or 174 to the intermediate position, and also to aid generally in operation of the active door locking apparatus 146, as is known in the art.

While the arming hub 172 is positioned in the disarmed position thereof, the gear mesh relationships between the input hubs 168, 182 and their respective handle-motion-control-slides 240, 242 will cause a downward movement of the first handle-motion-control-slide 240, when the first handle 164 is moved from the intermediate position B to the first position A thereof as shown in FIG. 14A, or, similarly, a downward motion of the second handle-motion-control-slide 242 as the second handle 174 is moved downward from the intermediate position B thereof to the first position A thereof as shown in FIG. 14B. For latch-only operation, this downward motion of either of the handle-motion-control-slides 240, 242 has no affect on other components within the active door locking apparatus 146.

Figure 15A:
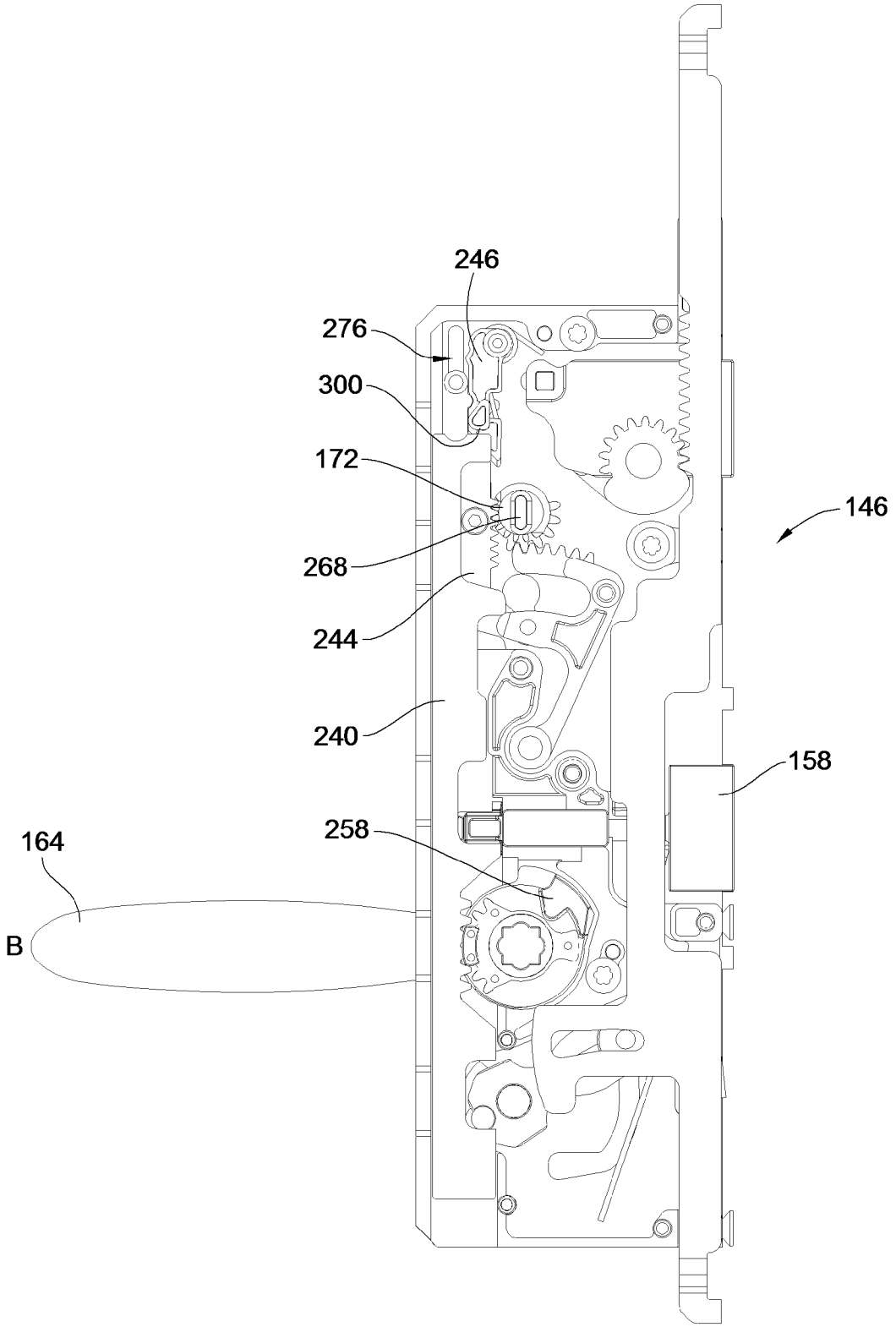
Figure 15B:
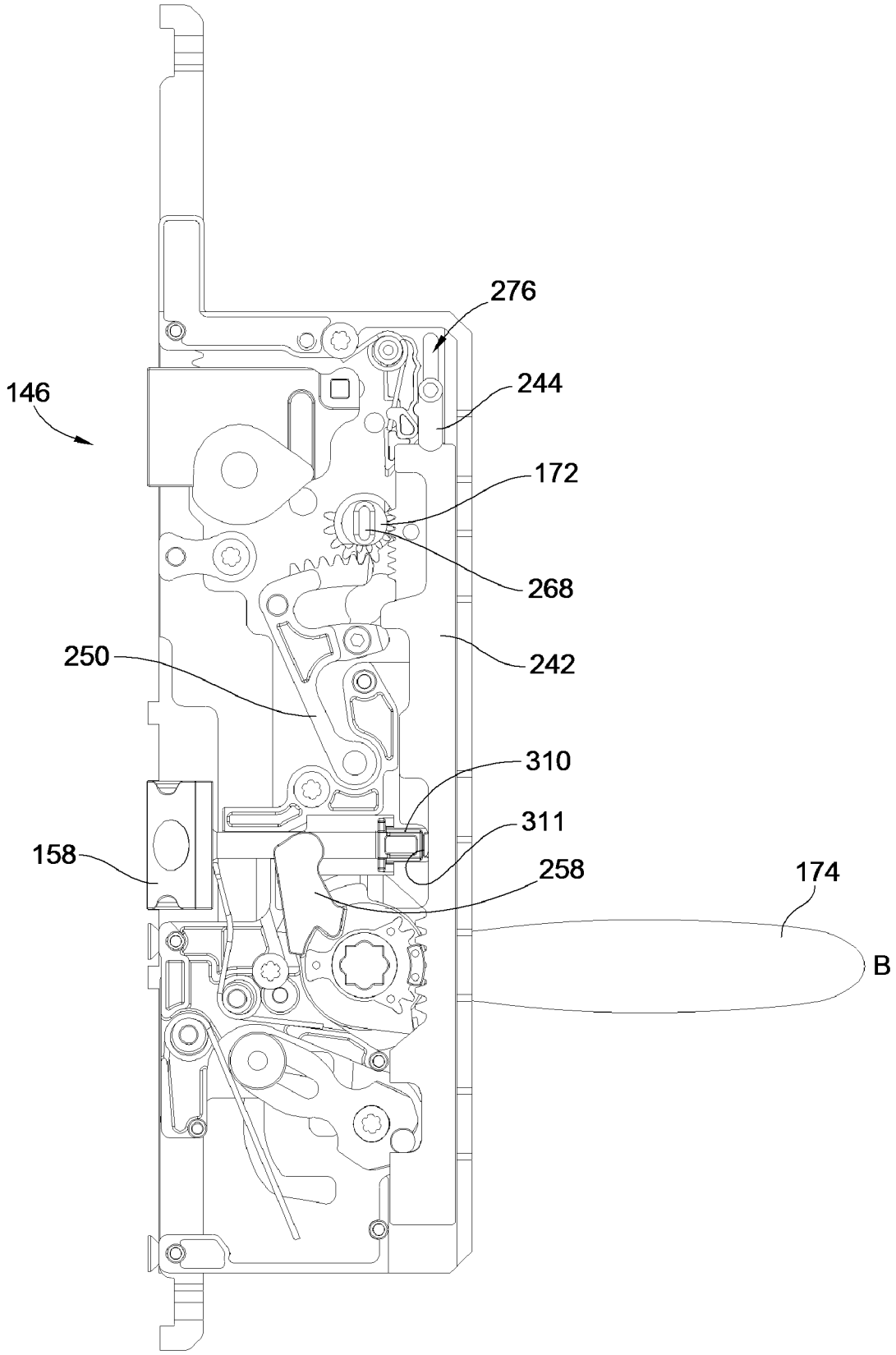

FIGS. 15A and 15B show interior and exterior views respectively illustrating the manner in which the latch 158 can be "pushed-in," without movement of either of the inside or outside handles 164, 174 the positional states illustrated in FIGS. 15A and 15B would typically occur momentarily when the angled face 159 of the latch 159 contacts a latch strike plate, attached to either the inactive door 104 in a double-door installation, or the door jamb 108 in a single door installation, while the active door 102 is being closed without movement of either the inside or outside handles 164, 174.

As will be described in more detail below, with reference to FIG. 29, the "pushed-in" condition of the latch 158 can also occur, in the exemplary embodiment of the door locking apparatus 100, through interaction of a latch blocking feature (364) of the inactive door-locking apparatus 144 with the latch 158 of the active door-locking apparatus 142, if the inactive door 104 is standing in a closed, but unlocked position thereof.

Latched and Armed Operation

Figure 16A:
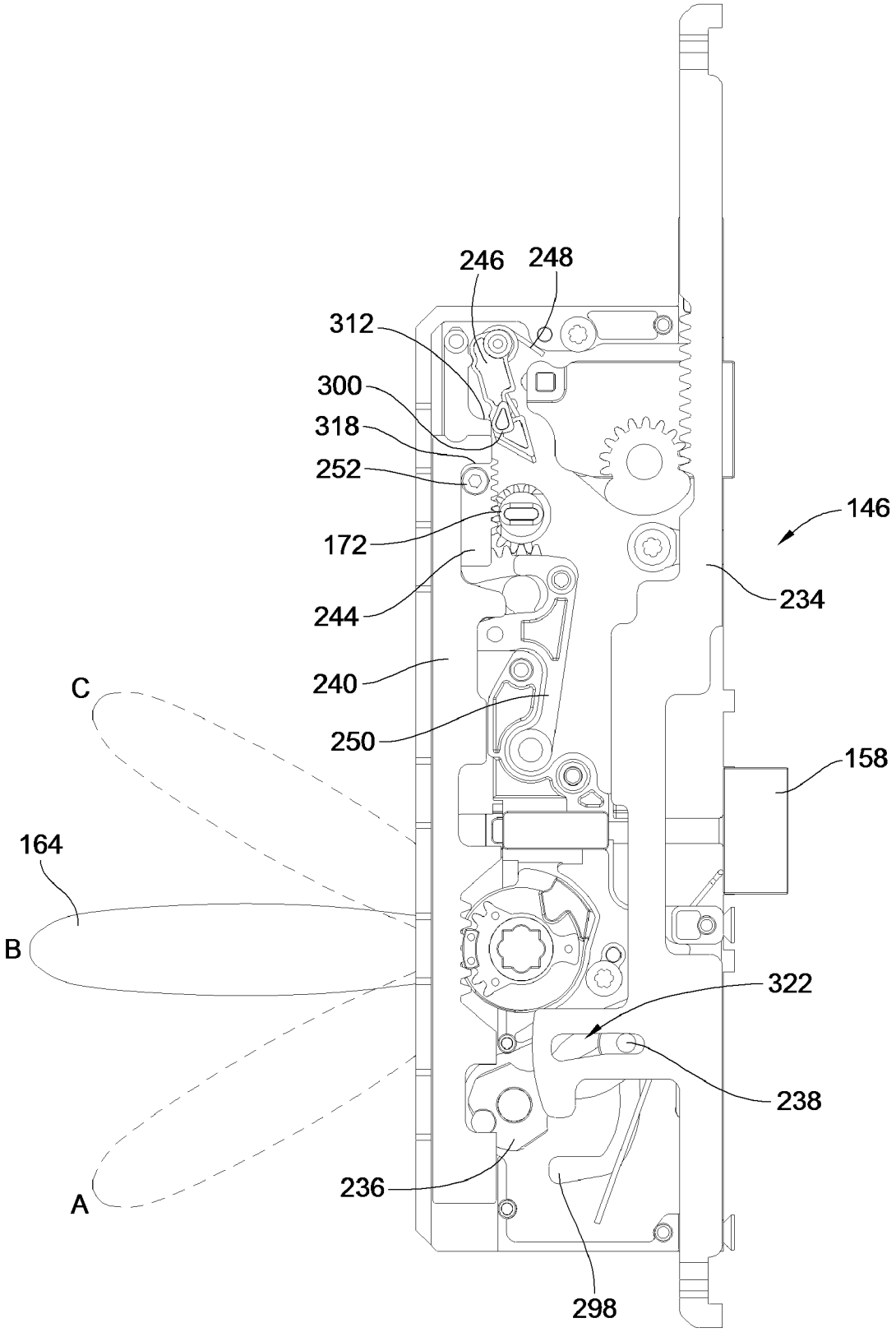
FIGS. 16A and 16B, are interior and exterior side views, respectively, showing the primary active door locking apparatus in a latched and armed operating mode.
Figure 16B:
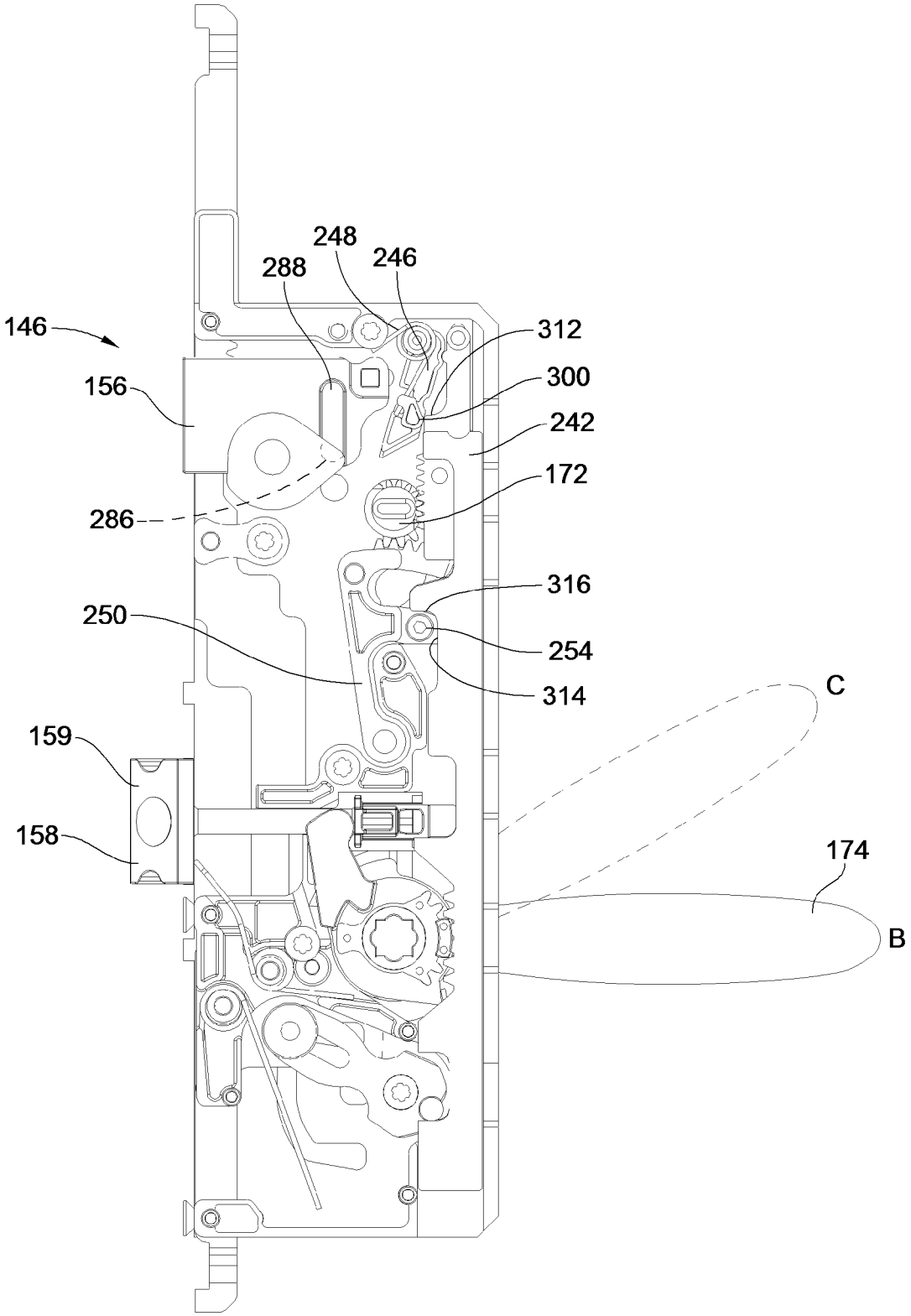

FIGS. 16A and 16B are interior and exterior views of a "LATCHED AND ARMED" positional state of the active door primary door-locking apparatus 146, showing the internal components of the door locking apparatus 146 in their respective positions, where the operational mode of the door locking apparatus originally in the state depicted in FIGS. 13A and 13B has been changed by rotating the lock-point arming hub 172 from the disarmed angular position E thereof, as shown in FIGS. 13A and 13B, to the armed position D thereof, as shown in FIGS. 16A and 16B, without additional movement of either of the inside or outside handles 164, 174 from the intermediate position B thereof. Rotation of the arming hub 172 from the disarmed E to the armed D positions thereof, causes both the handle-motion-control-slide stop pivot 246 and the pivotable gear sector element 250 to pivot out of their respective disarmed positions, as shown in FIGS. 13A, 13B, and 14A, 14B to respective armed positions thereof as shown in FIGS. 16A and 16B. Movement of the stop pivot 246 and the pivotable gear sector element 250 to the armed positions thereof, differentially changes the manner in which each of the first and second handle-motion-control-slides 240, 242 can move within the active door primary locking arrangement 146, with corresponding changes in the manner in which the inside and outside handles 164, 174 can be moved.

Specifically, rotation of the lock-point arming hub 172 from the disarmed to the armed position thereof causes a corresponding upward longitudinal movement of the traveling rack element 244 to an armed position thereof, within the slots 276 in the first and second side plates 220, 222. As seen in FIGS. 16A and 16B, as the traveling rack element 244 moves upward, contact between a shoulder 312 of the traveling rack element 244 and the stop-pivot 246 causes the stop-pivot 246 to pivot about its axis 270, against the force of the stop-pivot return spring 248, in such a manner that the stop-pivot 246 is moved to a non-longitudinally oriented, armed position thereof, wherein the distal end 300 of the stop-pivot 246 no longer prevents upward movement of either of the first and second handle-motion-control-slides 240, 242, resulting from the gear mesh relationship between the arming input hub 172 and the traveling rack 244. With the stop-pivot 246 in its disarmed position, either the inside handle 164 or the outside handle 174 can now be moved to the second position C thereof, in the manner illustrated in FIG. 17A or 17B for deploying the deadbolt 156 and tongue lock-points 148, 150 or other auxiliary lock point styles, in a manner to be described in more detail below.

Rotation of the arming hub 172 from the disarmed to the armed positions thereof, causes a corresponding rotation of the pivotable gear sector element 250 from its disarmed position, as shown in FIGS. 13A and 13B to the armed position thereof, as shown in 16A and 16B, as a result of a gear mesh relationship between the arming hub 172 and the pivotable gear sector element 250. As shown in FIGS. 13B and 16B, the pivotable gear sector element 250 includes a second-stop-pin-support-arm 314, to which the second stop-pin 254 is threadably attached, with the head of the second-stop pin 254 protruding on the outside-handle-side of the primary active door locking apparatus 146.

When the pivotable gear sector element 250 is in its armed position, as shown in FIG. 16B, the protruding head of the second stop-pin 254 will engage a second-stop-pin contact surface 316 of one or the other of the first and second handle-motion-control-slides 240, 242, to thereby prevent downward movement of the handle-motion-control-slide 240 or 242 having its second stop-pin contact surface 316 in contact with the second stop-pin 254. The handle-motion-control-slide 240 or 242 having its stop-pin contact surface 316 adjacent the second stop-pin 254 becomes the outside handle-motion-control-slide, with the corresponding result that the handle 164 or 174 operatively attached to that handle-motion-control-slide becomes the outside handle 174 of the primary active door locking apparatus 146. In the exemplary embodiments, the second stop-pin 254 is positioned to interact with the stop-pin contact surface 316 of the second handle-motion-control-slide 242, in such a manner that the second handle-motion-control-slide 242 cannot move longitudinally downward within the frame 216. As a result, the outside handle 174 cannot be moved downward from the intermediate position B thereof, as indicated in FIG. 16B.

As shown in FIG. 16A, the first handle-motion-control-slide stop-pin 252 is threadably mounted in the traveling rack 244, adjacent the first handle-motion-control-slide, in the exemplary embodiment of the primary active door locking apparatus 146, and protrudes to interact with a first stop-pin contact surface 318 of the first handle-motion-control-slide 240, in such a manner that if the inside handle 164 is moved downward to the first position thereof, while the arming hub 172 is in the armed position thereof, contact between the surface 318 of the first handle-motion-control-slide 240 will pull the traveling rack 244 downward within its longitudinally oriented slot 276 as the inside handle 164 is moved to the first position A thereof. By virtue of the gear mesh relationship that exists between the traveling rack 244 and the arming hub 172, as the traveling rack 244 is pulled downward, the arming input hub 172 is rotated from the armed to the disarmed positions thereof, with a corresponding movement of the pivotable sector gear member 250 from its armed to its disarmed positions, by virtue of the gear mesh relationship between the arming input hub 172 and the pivotable gear sector element 250.

By virtue of the configuration and connection of the first and second stop-pins 252, 254 with mating elements within the primary active door locking apparatus 146, it will be seen that a downward movement of the inside handle 164 from the intermediate position B to the first position A thereof will withdraw the latch 158 and return the arming input hub 172 to its disarmed position, to thereby place the primary active door locking apparatus 146 back in the position previously described with respect to 14A, wherein the active door 102 may be opened from the inside simply by rotating the inside handle 164 to the first position A thereof. This aspect of the invention, therefore, provides a simple, and intuitively straightforward, method of quickly exiting from the enclosed space, by simply pressing down on the inside handle 164, without the need for also simultaneously or previously having to rotate a thumb turn or key-lock in the manner required for retracting deadbolts in prior locking arrangements. The functionality of this aspect of the invention thus makes it possible to exit the enclosed space using only one hand, while the other hand may be occupied for other purposes, such as carrying packages or a child.

With the arming input hub 172 in its armed position, and the primary active door locking apparatus 146 in the positional state shown with respect to FIGS. 16A and 16B, however, the outside handle 174 cannot be moved downward from the intermediate position B thereof to the first position A thereof for retracting the latch 158, in the same manner described above in relation to the operational modes described with reference to FIGS. 13A, 13B and FIGS. 14A, 14B. As a result, once the arming hub 172 is positioned in its armed position, the active door is partially locked in the closed position by the latch 158.

Locked and Latched Operation

Figure 17A:
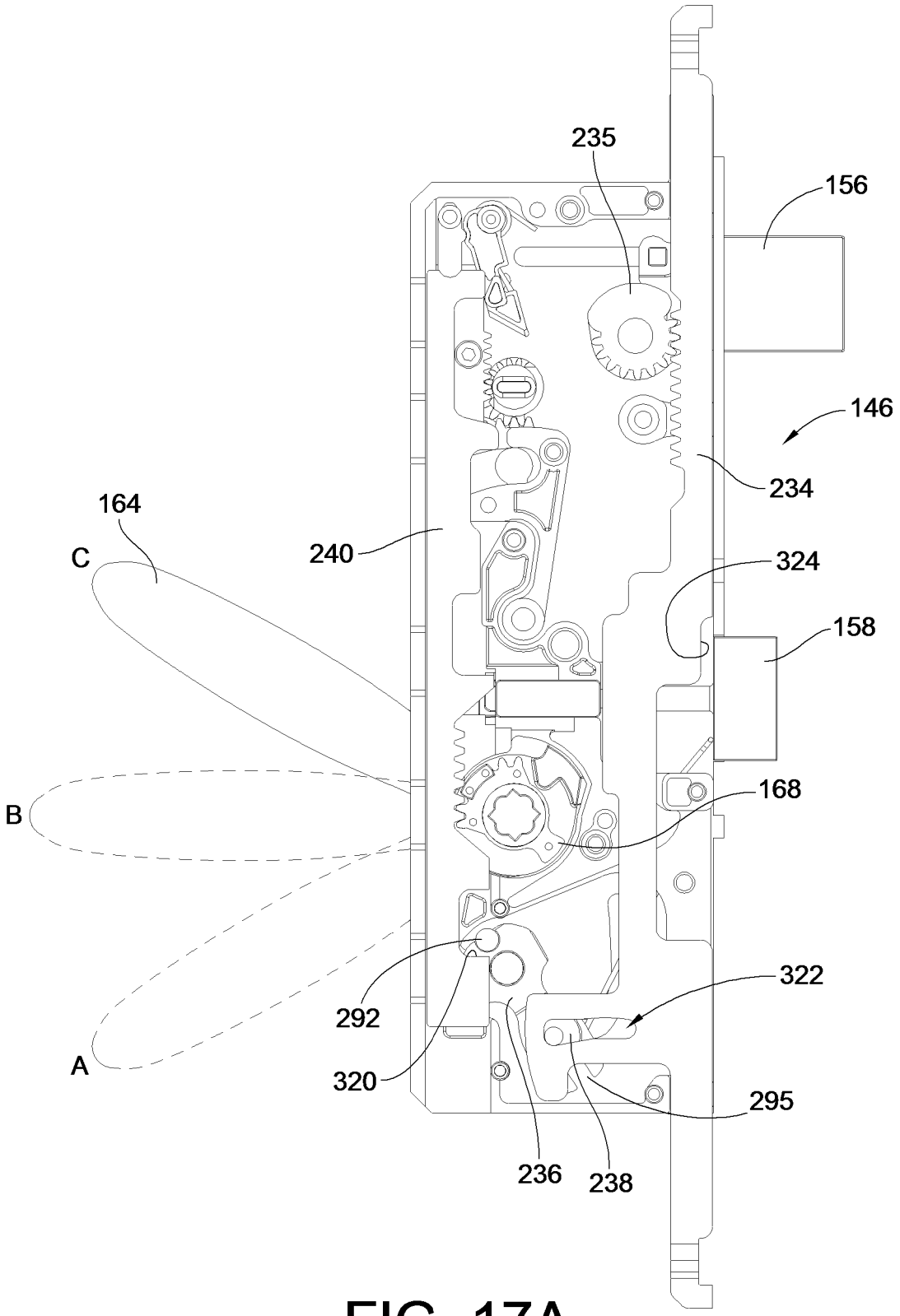
FIGS. 17A-B and FIGS. 18A-B are a series of interior and exterior views of the primary active door-locking apparatus being utilized in a latched-and-locked operating mode.
Figure 17B:
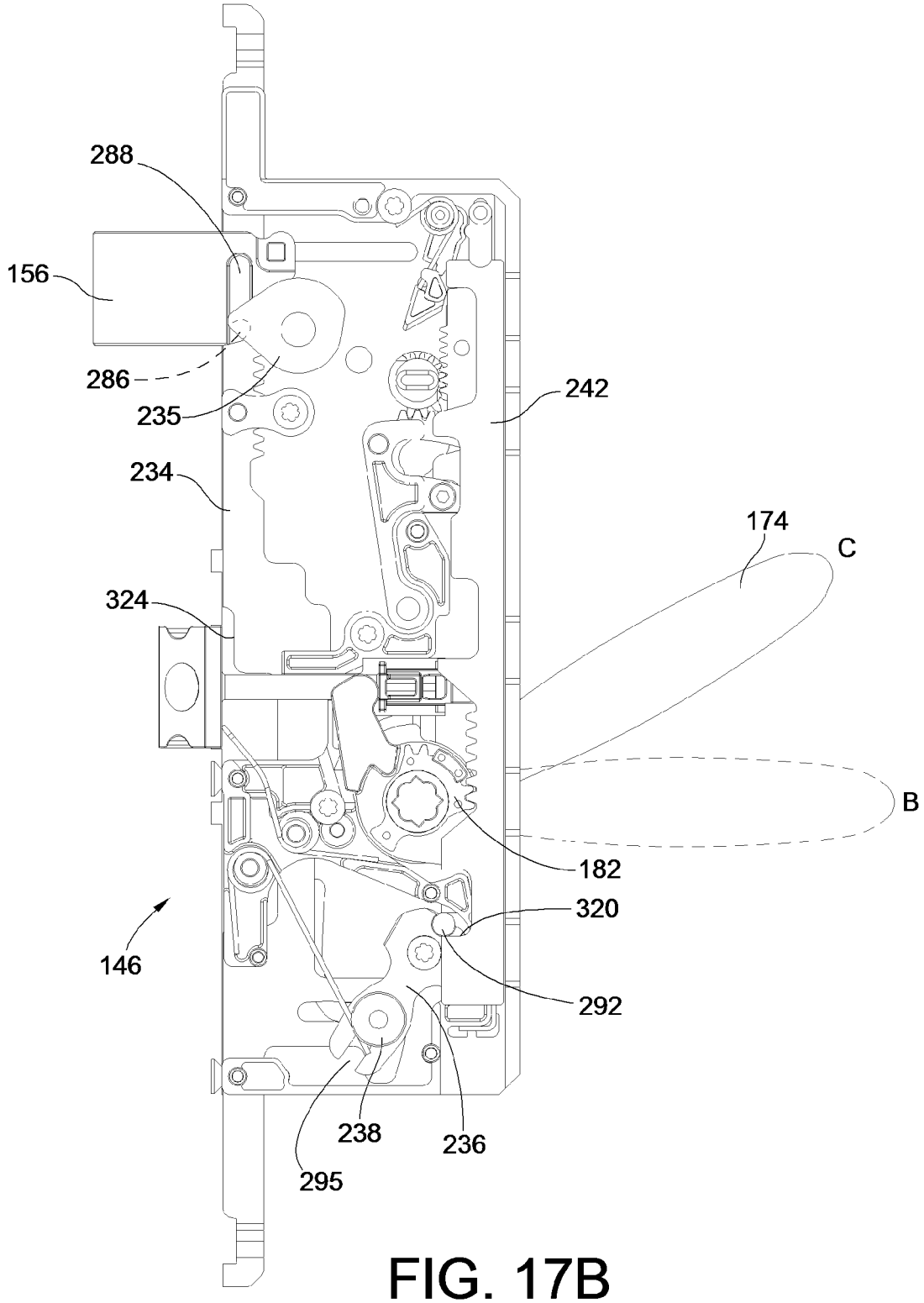

As further indicated in FIGS. 16A and 16B, with the arming hub 172 in its armed position, either the inside or the outside handles 164, 174 may be lifted from the intermediate position B thereof to the second position C thereof to cause the primary active door locking apparatus 146 to be placed into a fully locked and latched state, as illustrated in FIGS. 17A and 17B. As shown in FIGS. 17A and 17B, if either the inside or the outside handle 164, 174 is moved upward to the second position C thereof, with the locking apparatus 146 having been previously configured in the manner described above in relation to FIGS. 16A and 16B, with the arming hub 172 in the armed position thereof, upward movement of one of the handles 164, 174 will result in movement of the deadbolt 156 from the unlocked position thereof, as shown in FIGS. 13A and 13B, to the locked position thereof as shown in FIGS. 17A and 17B. The lock-point actuation slide 234 will also be moved from an unlocked position thereof, as shown in FIGS. 13A and 13B to a locked position thereof, as shown in FIGS. 17A and 17B.

Specifically, rotation of either of the inside or outside handles 164, 174 to the second position C thereof, causes a corresponding rotation of the respective input hub 168, 182 to a second angular position thereof, as shown in FIGS. 17A and 17B. As the respective input hub 168 or 182 rotates to the second position thereof, the gear mesh relationship between that input hub 168 or 182 and its corresponding first or second handle-motion-control-slide 240 or 242 drives that corresponding handle-motion-control-slide 240 or 242 longitudinally upward, within the frame 216. Upward movement of either the first or second handle-motion-control-slides 240, 242 causes a lower contact surface 320 on either the first or second handle-motion-control-slides 240, 242 to bear against and pull upward on the corresponding protrusions 292 at the first end of the drive lever 236. This upward motion causes the drive lever 236 to rotate about its axis 290, with the resulting rotation causing the drive lever 236 to drive the lock-point drive pin 238 along the slot 295 in the second end of the lock-point drive lever 236 and along the curved path defined by the slots 298 in the first and second frame endplates 220, 222. As shown in FIG. 17A, in addition to engaging the slot 294 in the lock-point drive lever 236, and the curved slots 298 in the frame endplates 220, 222, the lock-point drive pin 238 is also configured to engage a slot 322 in the lock-point actuation slide 234, as shown in FIGS. 16A and 17A, in such a manner that, as the lock-point drive lever 236 rotates about its axis 290, the lock-point actuation slide 234 is pulled longitudinally downward, within the frame 216 from its unlocked position, as shown in FIG. 16A, to its locked position as shown in FIGS. 17A and 17B.

As the lock-point actuation slide 234 moves downward, a gear mesh relationship between the lock-point actuation slide and the deadbolt actuator 235 causes the deadbolt actuator 235 to rotate about its axis 282 from an unlocked position thereof, as shown in FIG. 16A to a locked position thereof as shown in FIG. 17A. Rotation of the deadbolt actuator 235, about its axis 282, causes the deadbolt actuator cam pin 286 to rotate and move within the longitudinal slot 288 in the deadbolt 156, in such a manner that the deadbolt actuator cam pin 286 drives the deadbolt in a transverse direction from its unlocked position, as shown in FIGS. 16A and 16B, to its locked position, as shown in FIGS. 17A and 17B.

As further shown in FIGS. 17A and 17B, the lock-point actuation slide 234 includes a latch-contact surface 324 thereof which precludes transverse movement of the latch 158 from the latched to an unlatched position thereof, when the lock-point actuation slide 234 is in its locked position.

Figure 18A:
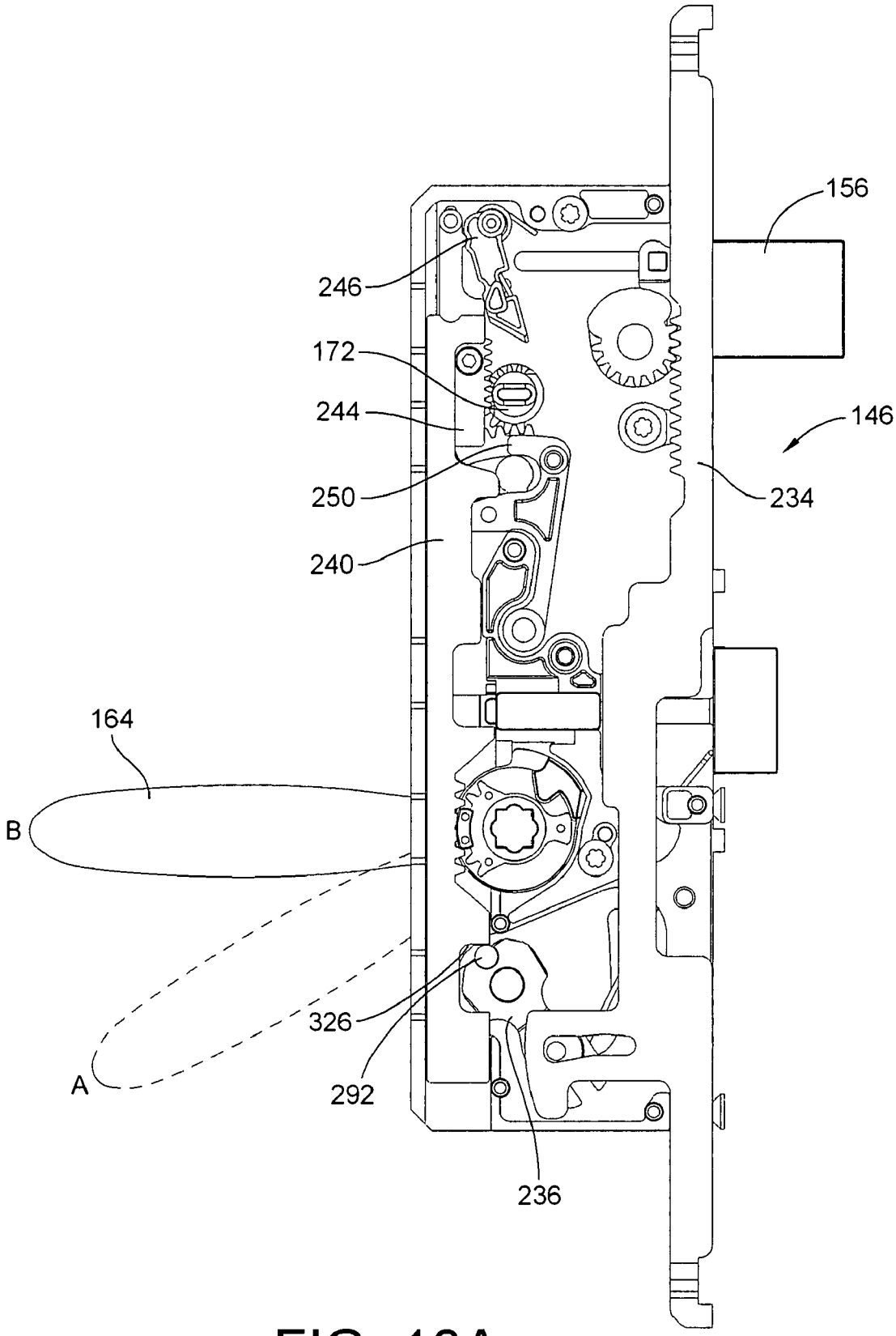
Figure 18B:
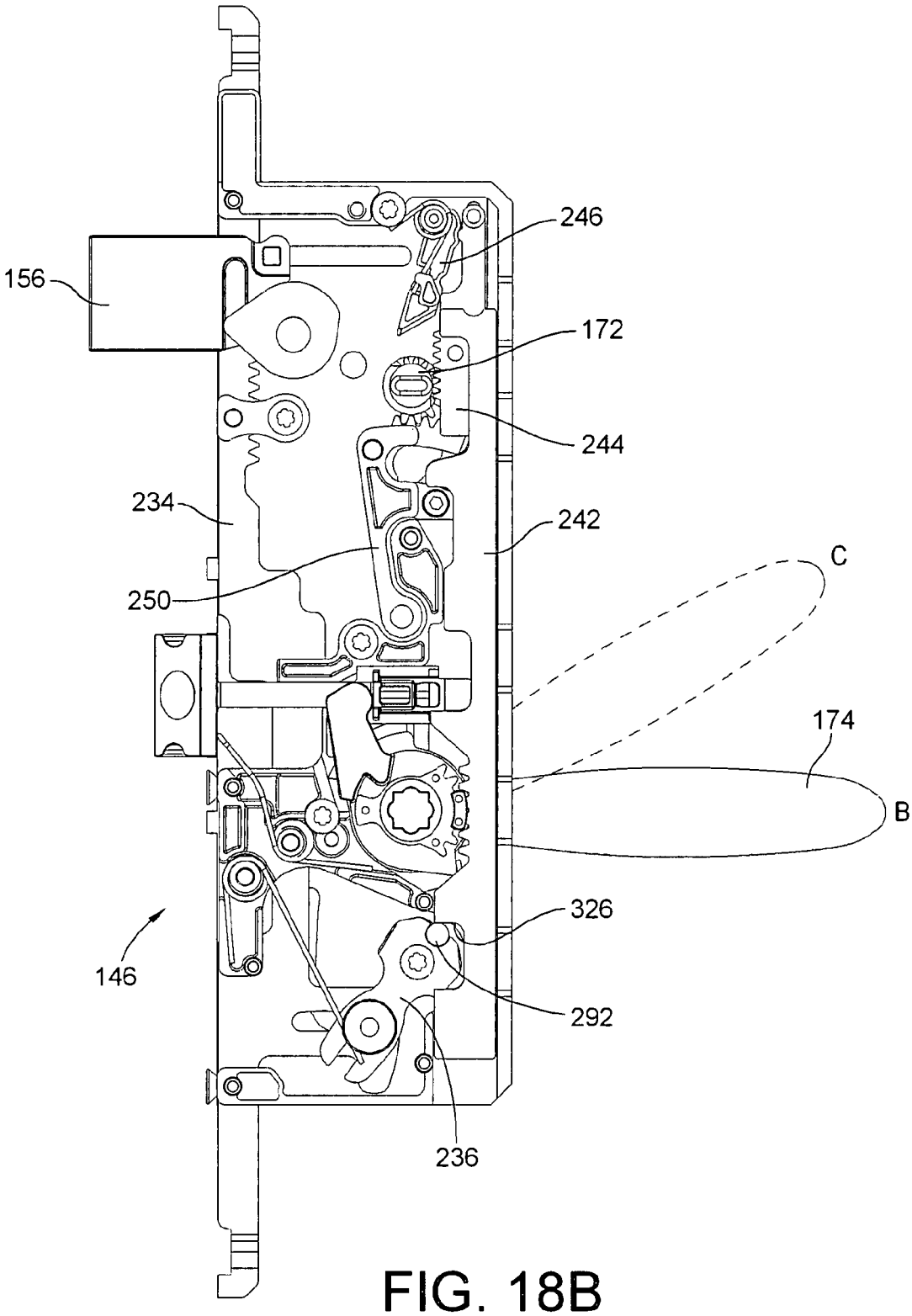
Figure 19A:
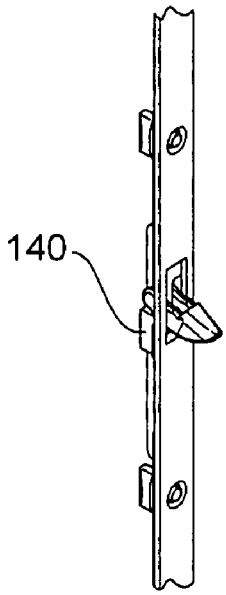
FIGS. 19A-B and 20A-B are perspective illustrations of secondary lock-points of the active door-locking arrangement, showing the secondary lock-points in both locked and unlocked states.
Figure 19B:
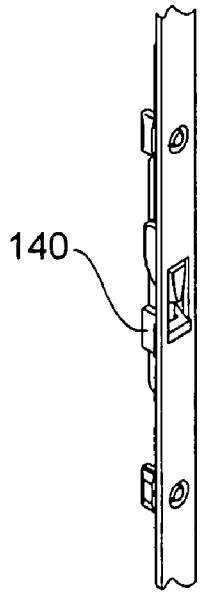
Figure 20A:
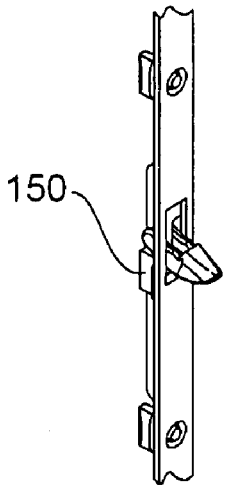
Figure 20B:
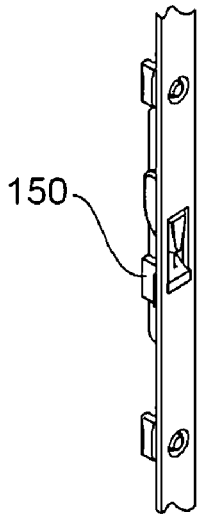

As shown in FIGS. 18A and 18B, after the primary active door locking apparatus 146 has been placed into the fully locked and latched state, shown in FIGS. 17A and 17B, when the inside and outside handles are subsequently returned to their intermediate positions B, the locking apparatus 146 remains in the latched and locked condition until one of the inside and outside handles 164, 174 is moved downward to the first position A thereof. As explained in more detail below, other steps, such as using the keyed cylinder on the outside of the door or the thumb turn on the inside of the door to move the arming hub 172 to its disarmed position D, will need to be performed before the outside handle 174 can be moved downward to the first position A thereof, once the primary door locking apparatus 146 has been placed in the fully locked and latched state.

Specifically, with the arming hub 172 in the disarmed position D, downward movement of either the inside or outside handle 164, 174 from the intermediate position B thereof to the first position thereof causes the corresponding input hub 168, 182 to rotate and drive the corresponding handle-control-motion-slide, 240 or 242, downward until the top surface of the notch on the lower end of the corresponding handle-motion-control-slide, 240 or 242, engages the protrusions 292 on one end of the drive lever 236 to move downward and impart a reverse rotation to the drive lever about its axis 290, which, in turn, causes a reversing of the motion described above with regard to FIGS. 17A and 17B, resulting in the lock-point actuation slide 234 being driven longitudinally upward from its locked to the unlocked position thereof, with a corresponding retraction of the deadbolt 156 from the locked to the unlocked position thereof.

Downward movement of the inside handle 164 from its intermediate position B to its first position A, with the primary active door locking apparatus 146 is allowed, by virtue of the configuration and connection of the components as described above, when the locking apparatus 146 is in its fully locked and latched position, as indicated by dashed lines in FIG. 18A.

In addition to causing the lock-point actuation slide 234 to move from its locked to the unlocked position thereof, downward movement of the first handle-motion-control-slide 240, by virtue of a downward rotation of the inside handle 164 causes the traveling rack 244 to be pulled longitudinally downward to its disarmed position, which results in the arming hub 172, stop pivot 246 and pivotable gear sector element 250 also being returned to their disarmed positions as shown in FIGS. 13A and 13B.

It will be appreciated that, by simply moving the inside handle 164 downward to its first position A, the primary active door locking apparatus 146 may be moved from its fully locked and latched state, as shown in FIGS. 18A and 18B back to a fully unlatched and unlocked state as shown in FIGS. 14A and 14B. This mode of unlocking and unlatching the door with the single step of moving the inside handle of the active door 102 downward to its first position, without having to simultaneously deal with manipulating any other control element on the inside of the door 102, provides a very effective and efficient emergency means of opening the locked and latched door from the inside, to thereby allow a speedy exit from the closed space. Such functionality is also convenient in non-emergency situations, where only a single hand, or a well directed push from an elbow, hip or other body part allows the door to be unlatched or unlocked while the person operating the locking arrangement 142 may have their hands full carrying packages, or a child, for example.

The exemplary embodiment of the primary active door locking apparatus 146 may also be restored from a fully locked and latched state, as shown in FIGS. 18A and 18B, by a person on the inside of the active door 102, by first rotating the thumb turn 170 to move the input arming hub 172 from its armed to its disarmed position, to thereby reposition the traveling rack 244, the stop pivot 246, and the pivotable gear sector element 250 in their disarmed positions, as shown in FIGS. 13A and 13B, and then, or simultaneously with rotation of the thumb turn 170, moving the inside handle 164 downward from the intermediate to the first position A thereof. It should be noted, however, that even if the arming hub 172 is moved to the disarmed position D, the lock points in the primary active door locking apparatus 146 will remain in the locked and latched position thereof, until either the inside or outside handle is moved to the first position A.

From outside of the active door 102, the primary active door locking apparatus 146 can only be unlocked and unlatched from the fully-locked and latched state by first using the keyed lock cylinder 176 to rotate the input arming hub 172 to its disarmed position, which will release the outside (second) handle-motion-control-slide 242 to move downward and thereby allow downward movement of the handle 174, followed by downward movement of the outside handle 174 from its intermediate position B to the first position A thereof.

It will further be understood, by those having skill in the art, that the upper and lower ends of the lock-point actuation slide 234 are adapted for attachment respectively thereto of the upper and lower secondary lock-point drive rails 152, 154, which transfer motion of the lock-point actuation slide 234 to the upper and lower tongue lock-point apparatuses 148, 150, in such a manner that as the lock-point actuation slide 234 moves from the unlocked to the locked positions thereof, corresponding movement of the upper and lower tongue locking apparatuses 148, 150 from their unlocked to locked positions also occurs, in the exemplary embodiment of the multi-point active door locking apparatus 142.

Inactive Door-Locking Apparatus

Figure 10:
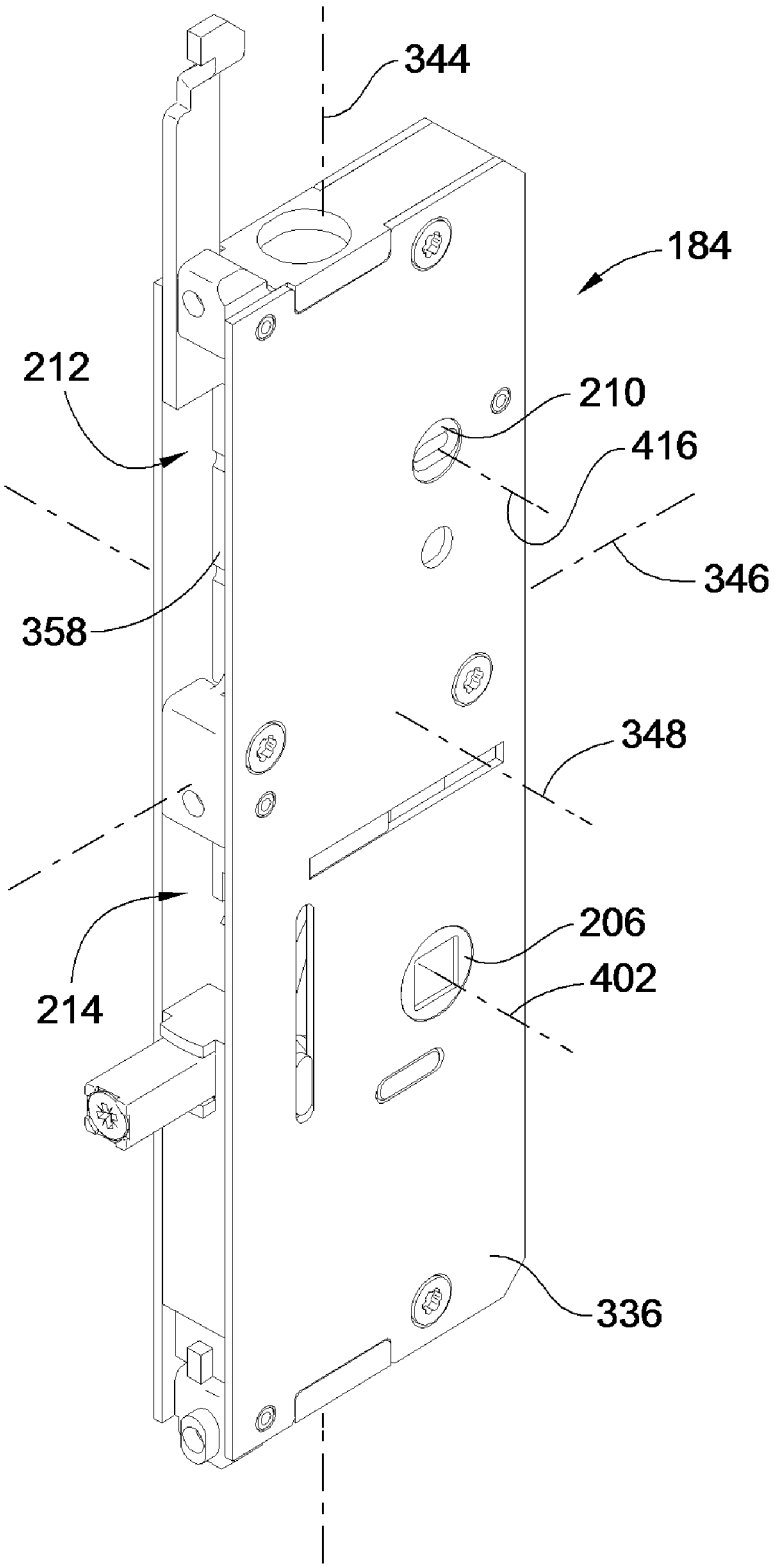
FIG. 10 is a perspective illustration of a primary inactive door-locking apparatus, of the inactive door-locking arrangement of FIG. 9.
Figure 21:
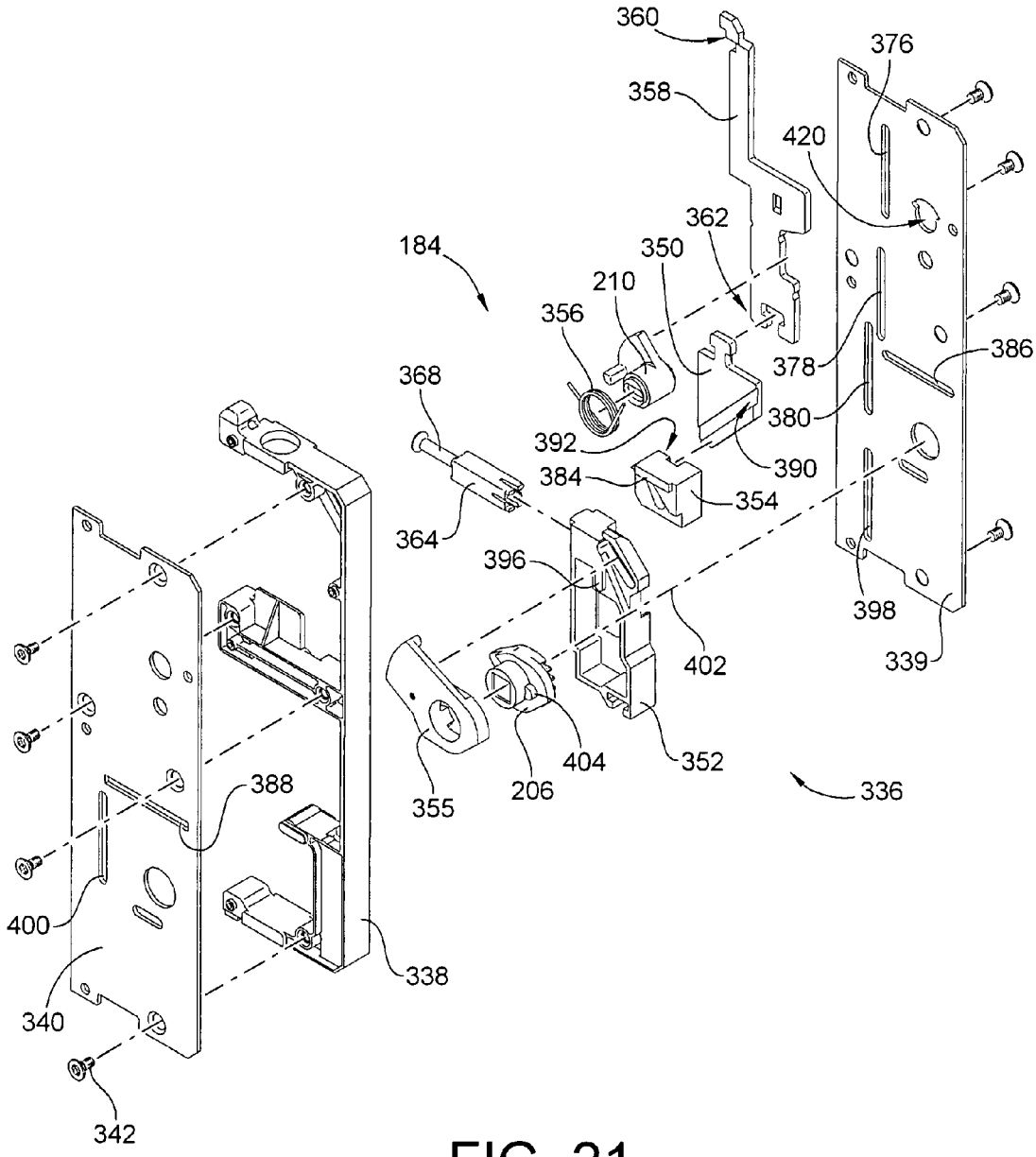
FIG. 21 is an exploded, perspective illustration of the exemplary embodiment of the primary inactive door-locking apparatus shown in FIG. 10.

As shown in FIG. 21, the primary inactive door locking apparatus 184 includes a frame thereof consisting of a center frame section 338, first and second frame side plates 339, 340, and a series of machine screws 342, securing the first and second side plates 339, 340 to the center frame 338 of the frame 336 of the primary inactive door locking apparatus 184. As shown in FIG. 10, the frame 336, of the primary inactive door locking apparatus 184, in the exemplary embodiment of the door locking arrangement 100, defines a longitudinal axis 344, which extends substantially parallel to the hinge axis 112 (FIG. 1) of the inactive door panel 104. The frame 336 further defines a transverse axis 346 and a thickness axis 348 of the primary inactive door locking apparatus 184. The transverse axis 346 and thickness axis 348 extend mutually orthogonally to one another and to the longitudinal axis 344. The transverse axis 346 extends substantially parallel to the transverse width of the inactive door panel 104.

Operatively mounted within the frame 336 of the primary inactive door locking apparatus 184 is, a lock-point actuation arrangement, in the form of a first (upper) lock-point actuation slide 350, a second (lower) lock-point actuation slide 352, a second (lower) lock-point slide drive link 354, and a primary inactive door-locking apparatus drive lever 355. Also operatively mounted within the frame 336 of the primary inactive door locking apparatus 184 are, the handle-actuated input element 206, for the inactive door 104, and the lock-point-arming-input-element 210 for the inactive door 104, together with a torsion spring 356, which is operatively attached between the inactive door lock-point arming input element 210 and the frame 336 of the inactive door locking apparatus 184, for urging the lock-point arming input element 210 toward the armed D position thereof.

The primary inactive door locking apparatus 184, in the embodiment shown in FIG. 21, also includes a drive rail linkage 358, having an exterior end 360 adapted for attachment to the upper drive rail 190 (FIG. 9), and an interior (lower) end 362 thereof, adapted for attachment to the first (upper) lock-point actuator slide 350.

As further shown in FIG. 21, the exemplary embodiment of the primary inactive door locking apparatus 184 also includes a latch blocker extension 364 which is adapted for attachment to the second (lower) lock-point actuation slide 352 with a machine screw 368.

Figure 22A:
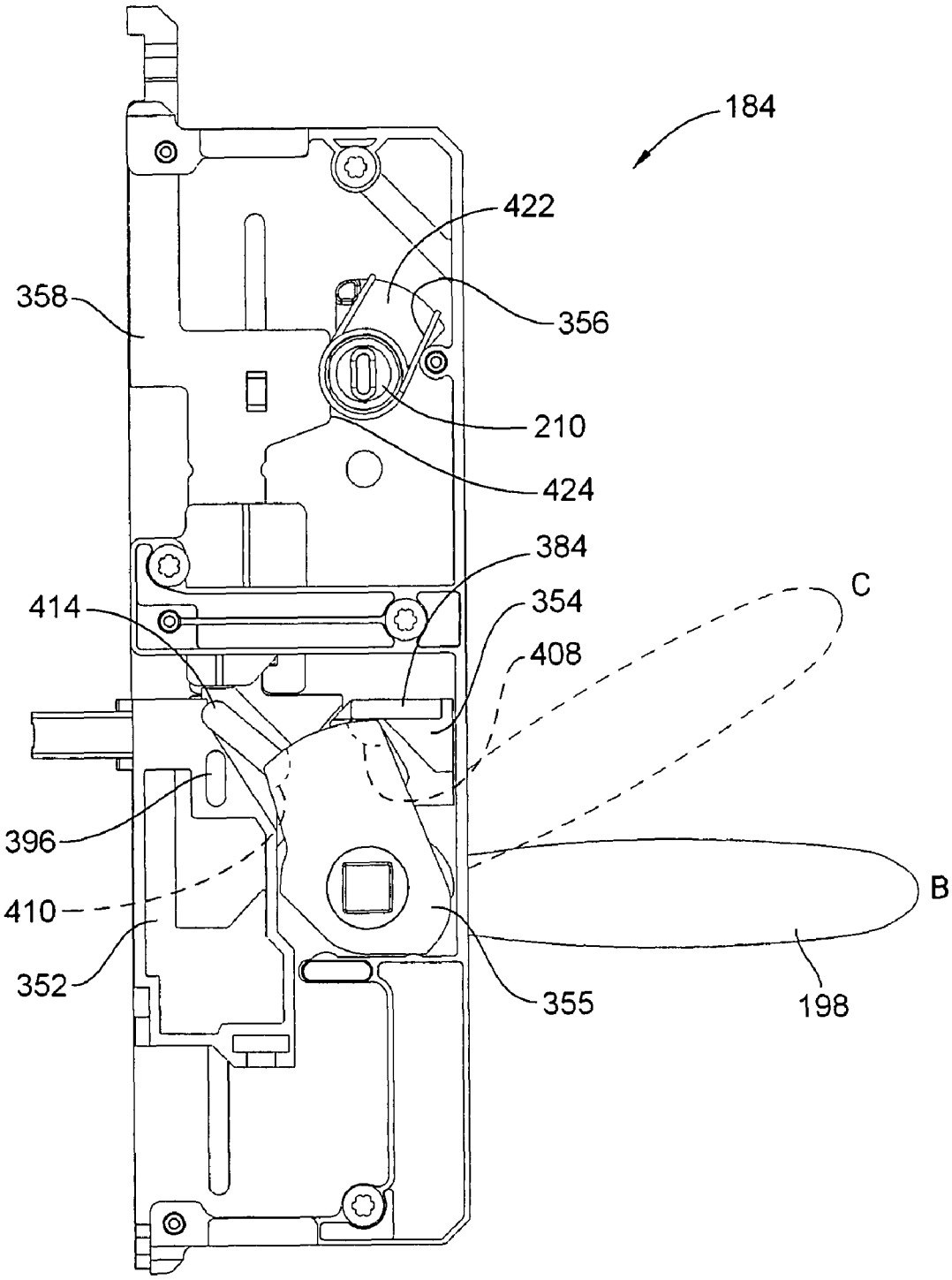
FIGS. 22A and 22B are interior and exterior views, respectively, of the primary inactive door-locking apparatus of FIGS. 10 and 21.
Figure 22B:
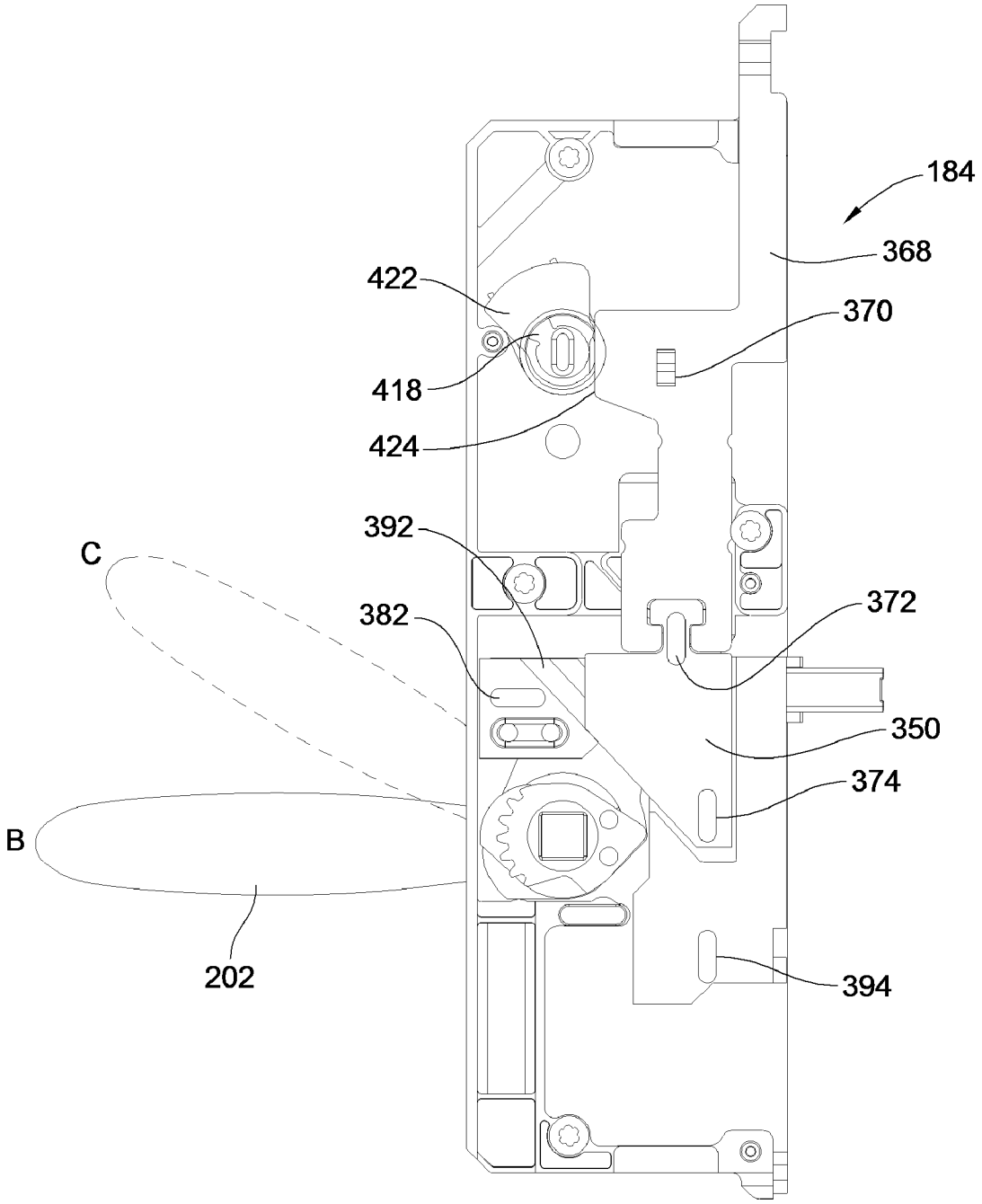

As shown in FIGS. 21, and 22B, the drive rail linkage 358 and the first (upper) lock-point actuation slide 350 have a series of protrusions 370, 372, 374, which engage a trio of longitudinally extending slots 376, 378, 380 in the first side plate 339 of the frame 336 for guiding the first (upper) lock-point actuation slide 350, and the drive rail linkage 358 attached thereto, in a longitudinal direction.

As shown in FIG. 21, and FIGS. 22A and B, the second (lower) lock-point slide drive link 354 includes a first and second protruding guide bars 382, 384, which are configured to respectively slidingly engage transversely extending elongated slots 386, 388 in the first and second side plates 339, 340 of the frame 336 of the primary inactive door locking apparatus 184. As further seen in FIGS. 21 and 22B, the first (upper) lock-point actuation slide 350 includes an angled slot 390 configured to engage with a corresponding angled slot 392 in the second (lower) lock-point slide drive link 354, in such a manner that as the drive link 354 is driven transversely along the slots 386, 388, the first (upper) lock-point actuation slide 350, and the drive rail linkage 358 attached to the first lock-point actuation slide 350, are driven longitudinally along the slots 376, 378, 380 of the first side plate 339 of the frame 336.

As shown in FIG. 21 and FIGS. 22A-22B, the second (lower) lock-point actuation slide 352 includes first and second elongated guide bars 394, 396, which operatively engage longitudinally directed elongated guide slots 398, 400, in the first and second side plates 339, 340, for guiding the second (lower) lock-point actuation slide 352 in a longitudinal direction within the frame 336.

As shown in FIG. 21, the handle actuated-input-element 206, and the lock-point drive lever 355 are mounted about a common axis 402, as the inside and outside handles 198, 202 (see FIG. 9) are rotated between the first, intermediate, and second angular positions A, B, C, thereof, (see FIGS. 6 and 7).

Figure 23:
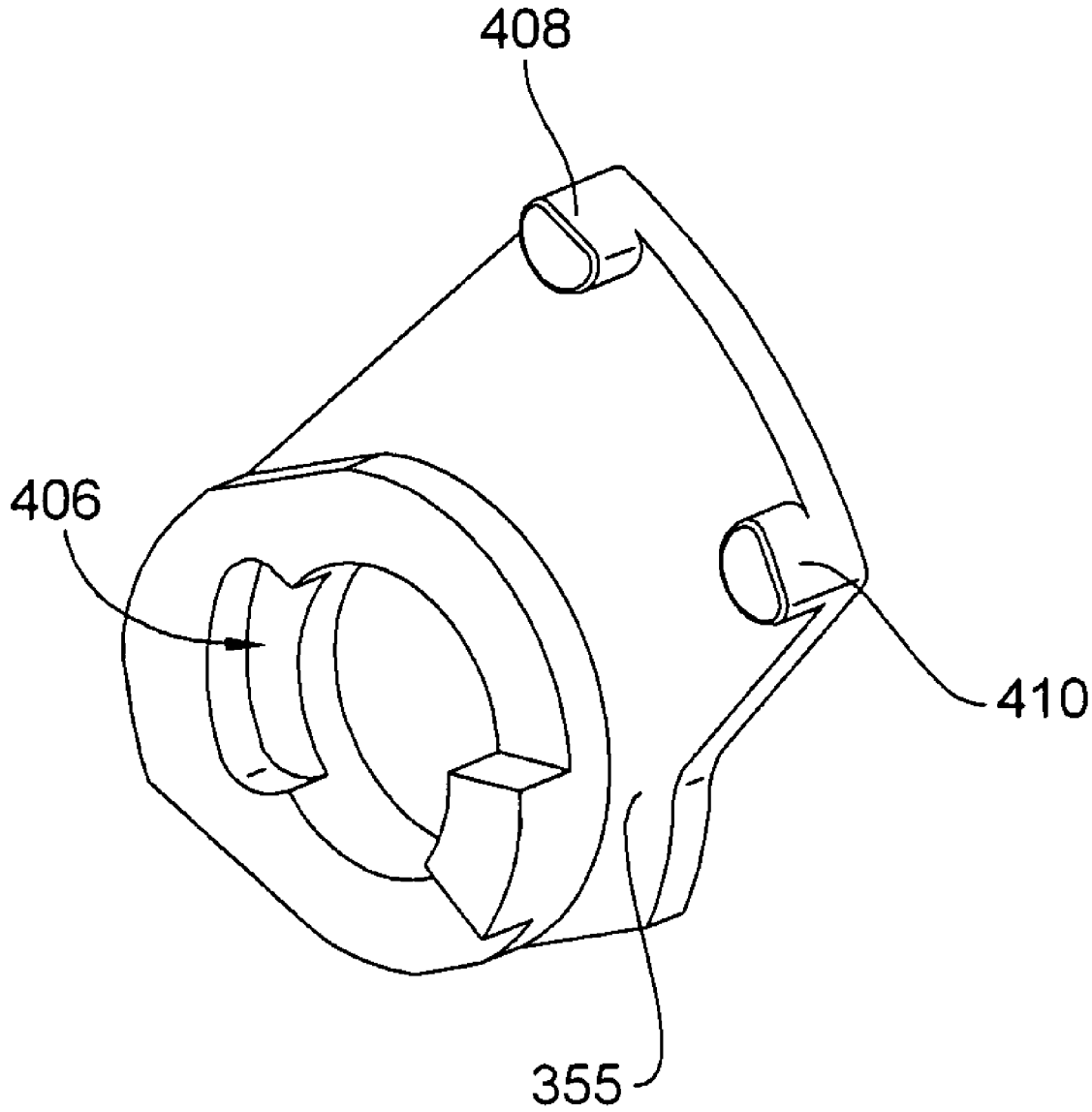
FIG. 23 is a perspective illustration of a lock-point drive lever, of the primary inactive door-locking apparatus of FIGS. 10 and 21.
Figure 24A:
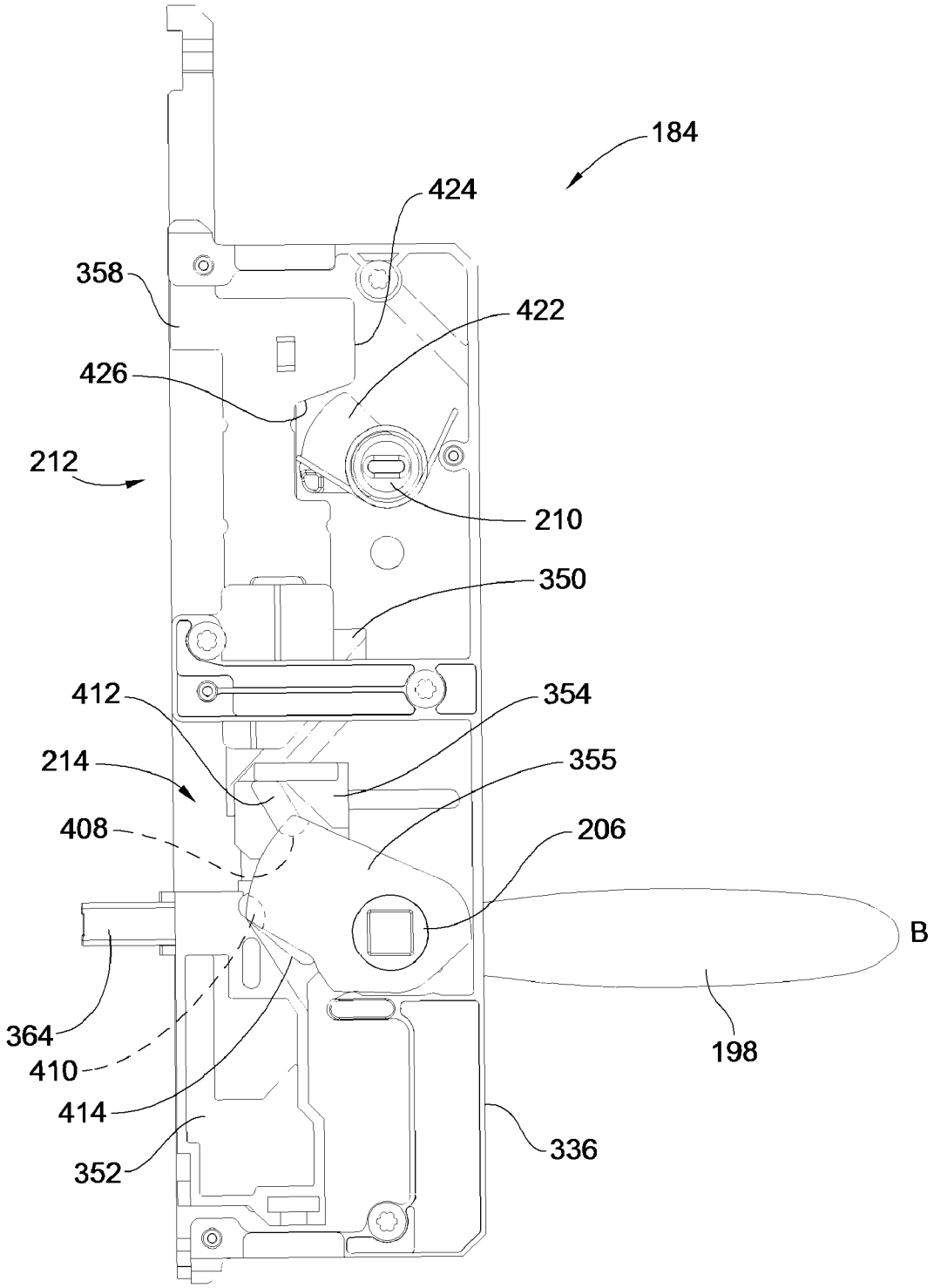
FIGS. 24A and 24B are interior and exterior views of the primary inactive door locking apparatus, of FIGS. 10 and 21, in a locked position thereof.

As shown in FIGS. 21 and 23, the handle-actuated-input element 206 includes a drive lug 404, configured for engaging a drive recess 406 (FIG. 23) in the lock-point drive lever 355, in such a manner that as the input-drive-element 206 is moved between the intermediate and second positions B, C thereof, the lock-point drive lever 355 is moved from an unlocked position thereof, as shown in FIG. 22A, to a locked position thereof, as shown in FIG. 24A.

Figure 24B:
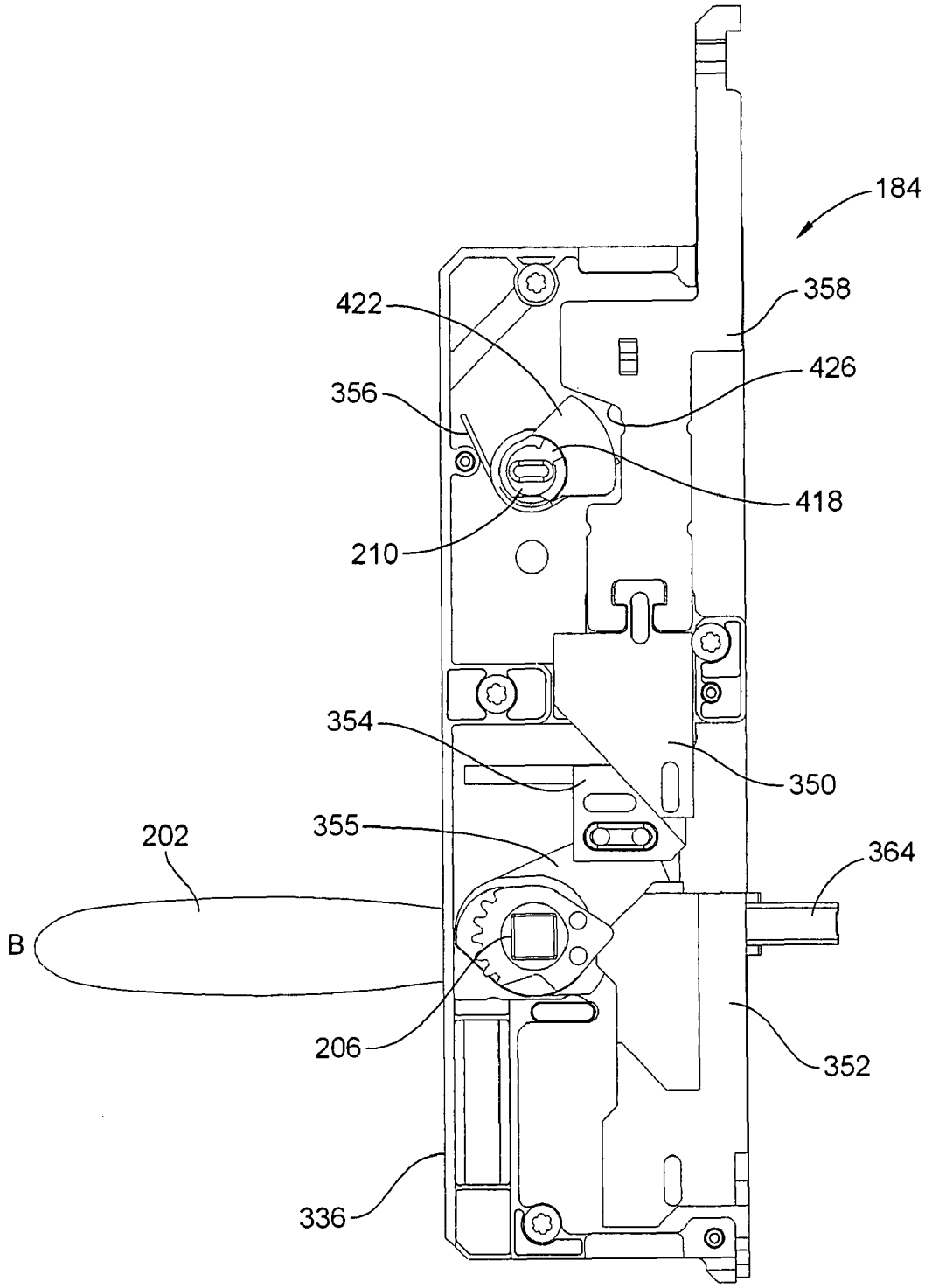

As shown in FIG. 23, the lock-point drive lever 355 also includes a first slide drive lug 408, and a second slide drive lug 410. As best seen in FIG. 24A, the first slide drive lug 408 engages an angled slot 412 in the second (lower) lock-point slide drive-link 354, and the second slide drive lug 410, of the lock-point drive lever 355, slideably engages an angled slot 414 in the second (lower) lock-point actuation slide 352, in such a manner that as the lock-point drive lever 355 is moved from the unlocked position thereof, as shown in FIGS. 22A and 22B, to the locked position thereof, as shown in FIGS. 24A and 24B, the first (upper) lock-point actuation slide 350, with the drive rail linkage 358 attached thereto, and the second (lower) lock-point actuation slide 352 are driven longitudinally in opposite directions, such that the first and second lock-point actuation slides 350, 352 are moved from the unlocked positions thereof, as shown in FIG. 22A, to locked positions thereof, as shown in FIGS. 24A and 24B.

As shown in FIG. 10, the lock-point arming input element 210, for the inactive lock apparatus 184, is mounted within the frame 336 for rotation about an axis 416, extending substantially parallel to the thickness axis 348 of the locking apparatus 184. As shown in FIGS. 22B and 24B, the arming input element 210 has a motion limiting key 418 thereof configured to interact with sidewall stops in an inverted keyhole-shaped opening 420 extending through the first side plate 339 of the frame 336, in such a manner that rotation of the input element about its axis 416 from an armed position of the arming element 210, as shown in FIG. 24B to a disarmed position, as shown in FIG. 22B are limited by the edges of the keyhole-shaped opening 420.

As will be understood from an examination of FIGS. 21, 22A and B, and FIGS. 24A and B, the lock-point arming input element 210, and the drive rail linkage 358 are configured in such a manner that, with the lock-point arming input element 210 in its disarmed position, as shown in FIGS. 22A and 22B, a locking cam portion 422 rides against a raised segment 424 of the drive-rail linkage 358, in such a manner that the drive rail linkage may move freely outward substantially parallel to axis 344 from the unlocked to the locked position thereof. The peripheral edge of the drive rail linkage 358 also includes a notch 426 therein, adjacent the raised segment 424, with the notch 426 being configured to receive the locking cam portion 422 of the input arming element 210, when the input arming element 210 is rotated to the armed position D, thereof, as shown in FIGS. 24A and 24B. The torsion spring 356 is operatively connected between the frame 336 and the input arming element 210 in such a manner that the input arming element 210 is biased toward movement from the disarmed position E to the armed position D thereof, as the drive rail linkage 358 moves outward from its unlocked to its locked position.

With the lock-point arming input element 210 in its armed position, interaction between the sidewalls of the notch 426 in the drive rail linkage 358, the locking cam portion 422 of the input arming element 210, is transferred to a corresponding interaction between the key 418, of the input arming element 210 and the sidewalls of the inverted-keyhole-shaped hole 420 in the first side plate 339 of the frame 336, in such a manner that the handle-actuated input-drive element 206 cannot be used for retracting the first and second lock-point actuation slides 350, 352 and the drive rail linkage 358, until the input arming element 210 is first rotated from the armed position D to the disarmed position E thereof, and held in the disarmed position E thereof, via the thumb turn 200 as either the inside or outside handle 198, 202 is moved downward from the intermediate position B to the first position A thereof.

It will be noted, by those having skill in the art, that the input arming element 210, of the inactive locking apparatus 184, does not have a direct connection for moving the lock-point actuation slides 350, 352, but, rather, acts to limit the allowable motion of the inside and outside inactive door handles 198, 202, in a similar manner to that previously described herein above, with respect to the lock-point arming input element 172 in the active door locking apparatus 142.

As shown in FIGS. 25A, 25B, and 26A, 26B, as the lock-point drive lever 355 and second (lower) lock-point actuator slide 352 move from a retracted position thereof, as shown in FIGS. 22A and 22B to an extended position thereof as shown in FIGS. 24A and 24B, the upper and lower shoot-bolts 186, 188 also move from an unlocked to a locked position thereof.

Additional functional and structural aspects of the exemplary embodiment of the door locking arrangement 100, according to the invention, will now be described with reference to FIGS. 27-29.

Double Door Operation Locking the Inactive Door Panel

Starting from an initial condition where both the active and inactive door panels 102, 104 are open, as shown in FIG. 4, the inactive door 104 is closed first, and either the inside or outside handle of the inactive door 104 is then lifted, to move the drive rail linkage 358, the second (lower) lock-point actuation slide 352, from the unlocked position, shown in FIGS. 22A and B to the locked position shown in FIGS. 24A and B, with the corresponding outward motion of the drive rail linkage 358 and second (lower) lock-point actuation slide 352 causing a corresponding movement of the upper and lower shoot-bolts 186, 188 from the unlocked to the locked positions thereof, with the shoot-bolts 186, 188 in the locked position engaging strikes (not shown) in the header and sill of the door frame 108 and securing the inactive door panel 104 in the closed position within the door frame 108. As previously described, as the drive rail linkage 358 moves outward, to its locked position, the torsion spring 356 causes the lock-point arming input element 210 of the primary inactive lock apparatus 184 to move from its disarmed position E to the armed position D, thereof, and brings the locking cam portion 422 of the inactive door lock-point arming input element 210 into position within the notch 426 in the drive rail linkage 358 to thus prevent further movement of either the inside or outside handles 198, 202 of the inactive door panel 104, so long as the inactive door lock-point arming input element 210 remains in the armed position.

Operation of the Active Door

With the inactive door 104 locked in place in the closed position, the active door 102 may be closed, and operated in either of the latched only or latched and armed modes, or moved to a fully latched and locked position thereof, with the latch 158 engaging the latch receptacle 214, of the inactive locking apparatus 184, and the deadbolt 156 of the active lock apparatus 146 extending into the deadbolt receptacle 214 of the inactive lock apparatus 184, and with both the latch 158 and deadbolt 156 bearing against respective strike plates (not shown) attached to the inactive door 104.

Figure 27:
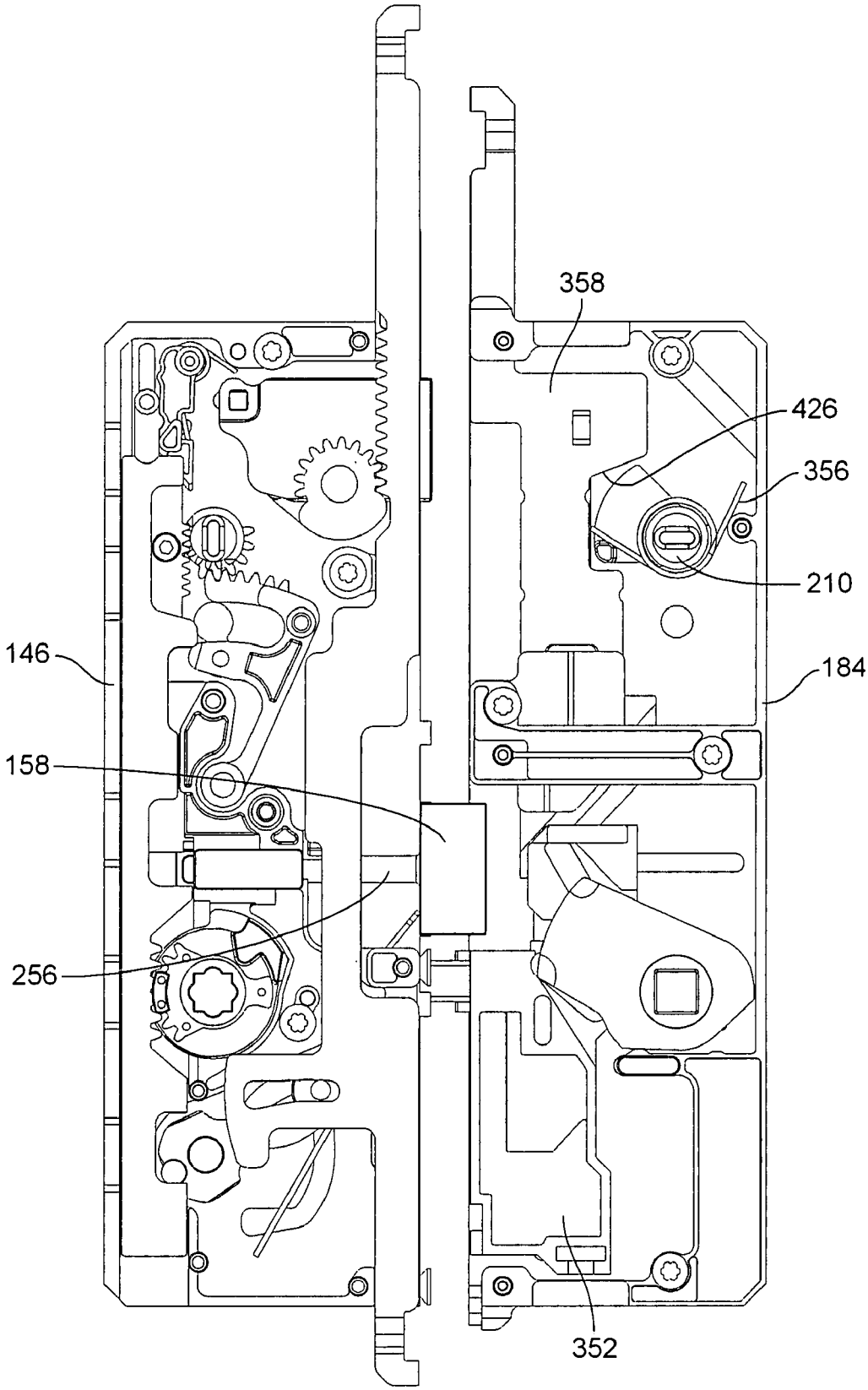
FIGS. 27-29 are interior side views showing the interaction of the primary active door-locking apparatus with the primary inactive door-locking apparatus, in various operational modes thereof.
Figure 28:
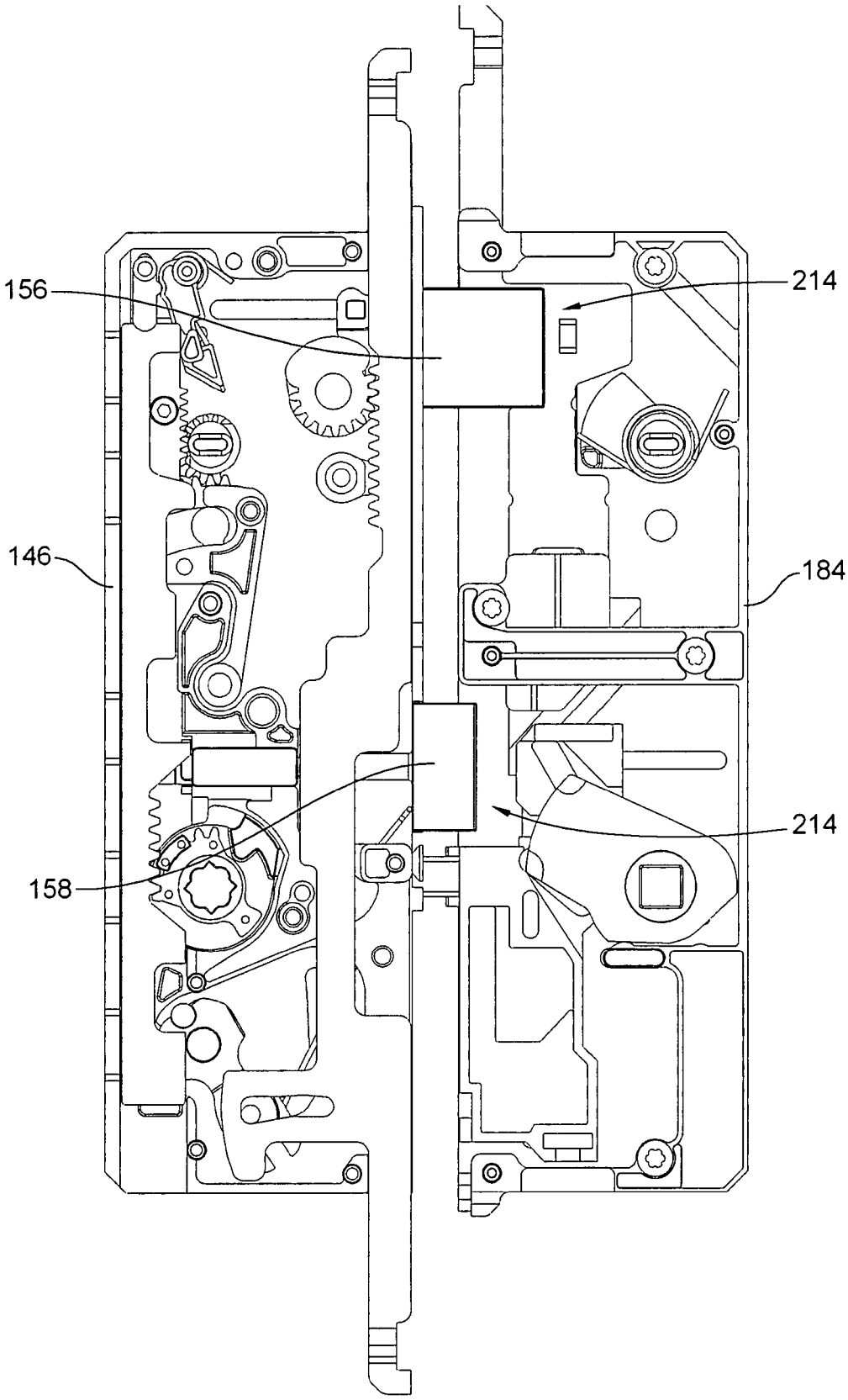

As shown in FIG. 27, anytime that the latch 158 is in its extended position, a top surface of the second lock-point actuation slide 352 impacts against a lower surface of the latch 158, if an attempt is made to unlock the inactive door-locking apparatus 184 while the latch 158 is engaging the latch recess 214 of the inactive door-locking apparatus 184. In accordance with this aspect of the invention, therefore, the inactive door-locking apparatus 184 is precluded from being inadvertently, or improperly unlocked, while the latch 158 of the active door locking apparatus 146 is extending into the latch recess 214 of the inactive door-locking apparatus.

Latch Blocking Function

Figure 29:
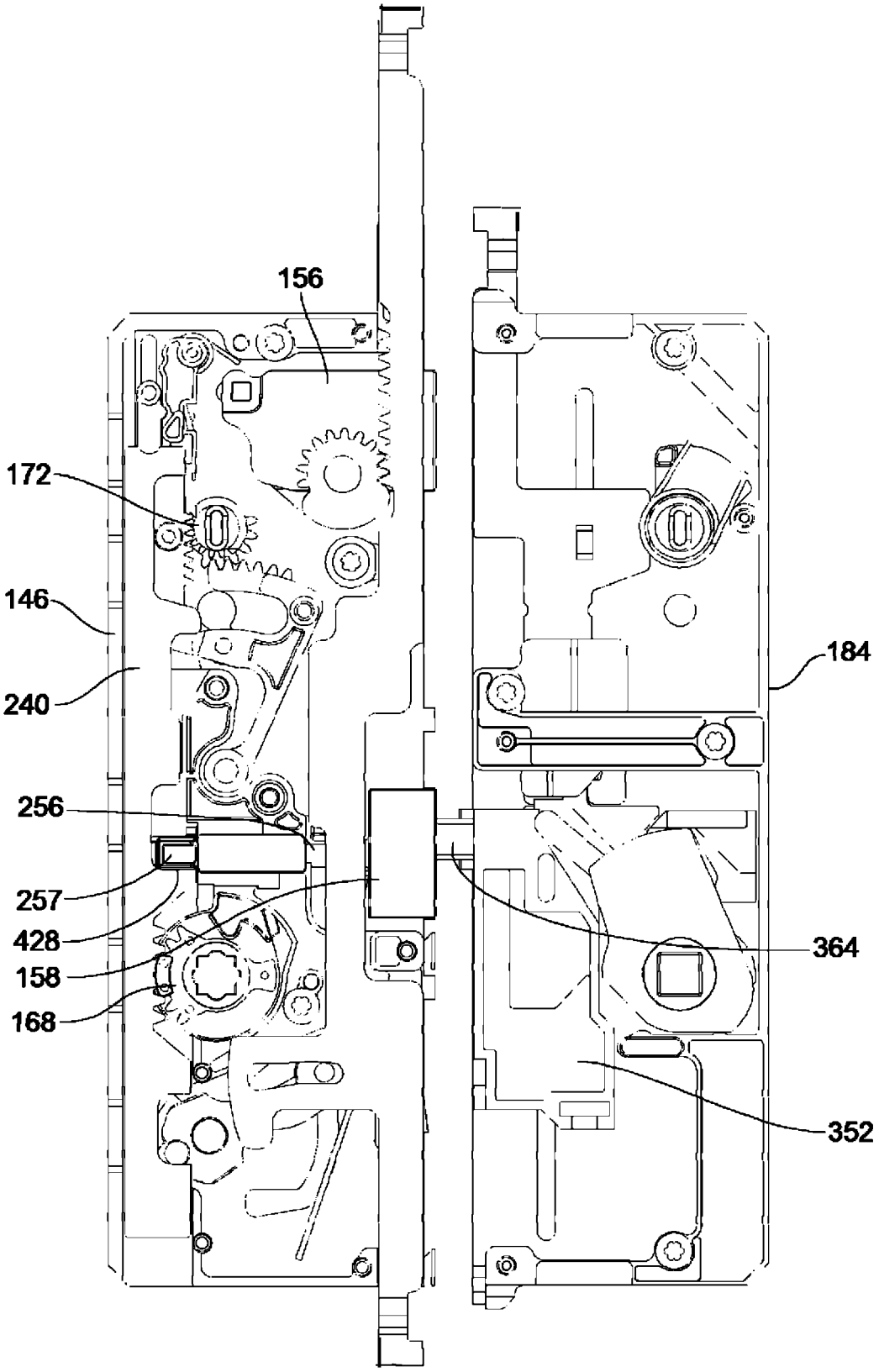

As shown in FIG. 29, however, if the active door 102 is closed while the inactive door locking apparatus 184 is still in the unlocked position, and the second (lower) lock-point actuation slide 352 is still in a retracted position, the second (lower) lock-point actuation slide 352 and/or the latch blocker extension 364, extending from the second lock-point actuation slide 352 will contact the latch 158, of the active door, as the active door 102 is closed, and force the latch element 256 toward the retracted position of the latch element 256, in such a manner that an interior end 257 of the latch element 256 engages a latch-blocking slot 428, 430 (FIG. 11A) in each of the first and second handle-motion control slides 240, 242, in such a manner that neither the first nor the second handle-motion control slides 240, 242 can be moved from the intermediate position B thereof to the second position C thereof, to move the deadbolt 156 from its unlocked to the locked position thereof or the latch 158 from the unlatched to the latched position thereof. By virtue of this arrangement, improper locking of the doors is precluded, to thereby both protect the operator of the doors from mistakenly thinking that the doors are locked when they are not, and the integrity of the locks 100 is also protected.

With the locking apparatuses 146 and 184 in the active and inactive doors positioned in the latch-blocking state, as shown in FIG. 29, if the inner door handle 198 or outer door handle 202 of the inactive door panel 184 is raised from the intermediate position to the second position B, C, to thereby lock the inactive panel 104 to the frame 108, the latch 158 of the door locking apparatus 146 will be unblocked, and the door may be operated in a normal latch only, latch locked, or latched and locked mode.

Locking of Active Door

Once the inactive door 104 is locked in position, the active door locking apparatus 142 may be operated in any of the operational modes described above, with reference to FIGS. 13A-B, 14A-B, 15A-B, 16A-B, 17A-B, and 18A-B.

Figure 25A:
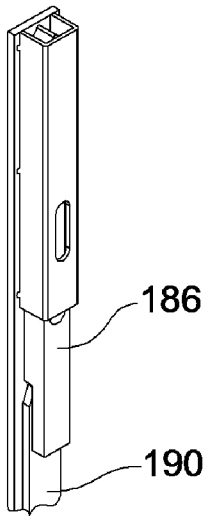
FIGS. 25A-B and 26A-B are perspective illustrations of secondary inactive door lock-points, in the form of shoot-bolts, showing the shoot-bolts in locked and unlocked positions thereof.
Figure 25B:
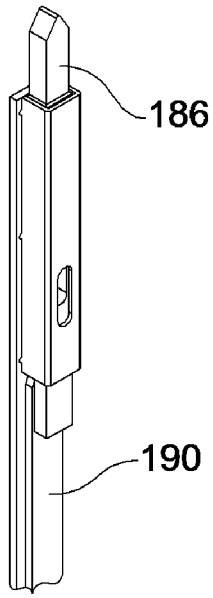
Figure 26A:
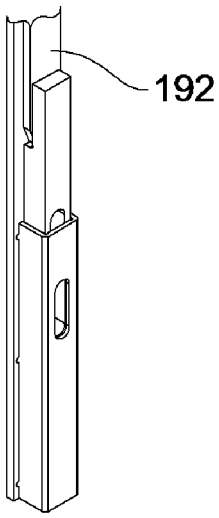
Figure 26B:
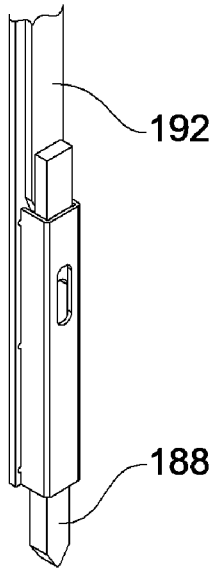
Figure 30:
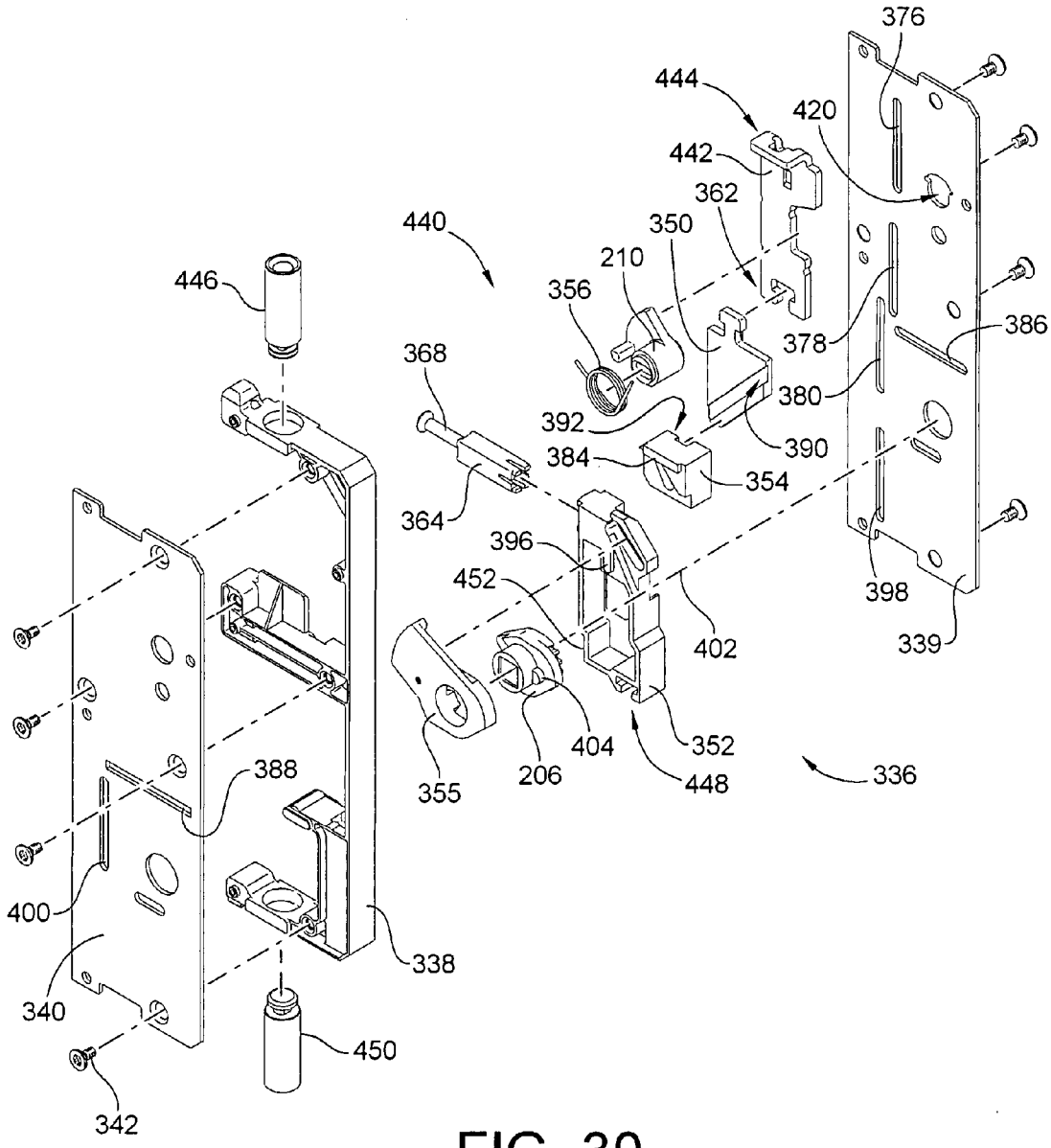
FIG. 30 is an exploded perspective view of the second exemplary embodiment of a primary inactive door-locking apparatus, according to the invention.
Figure 31:
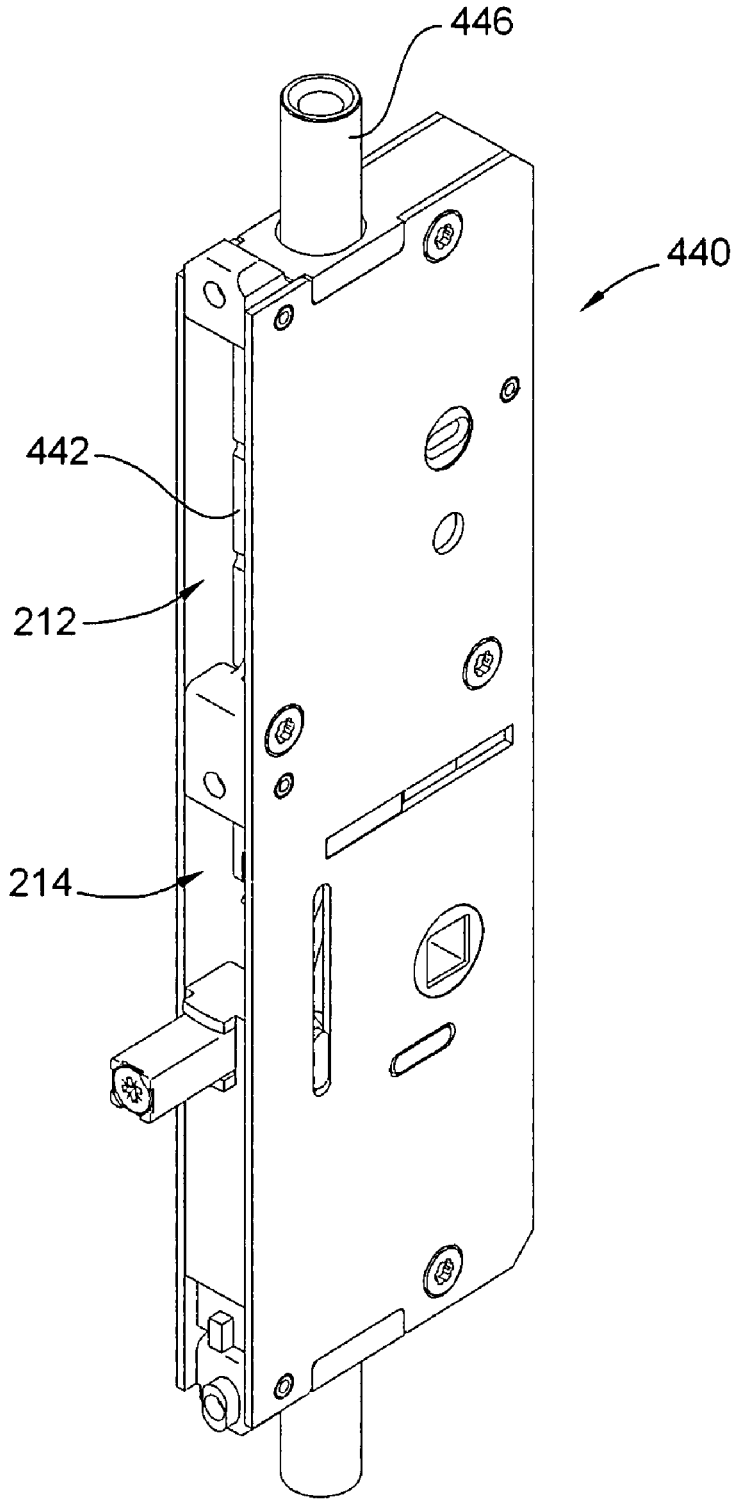
FIG. 31 is a perspective illustration of the second exemplary embodiment of the primary inactive door-locking apparatus, of FIG. 30.

FIGS. 30 and 31 shown an alternate embodiment of a primary inactive door locking apparatus 440, according to the invention, which is essentially identical to the first exemplary embodiment of a primary inactive door locking apparatus 184, as described herein above, with the exception that in the second embodiment 440, the drive rail linkage 358, of the first exemplary embodiment of the primary inactive door-locking apparatus 184 is replaced with an alternate form of a drive rail linkage 442, having an outer end 444 thereof configured to interface with a tubular-shaped upper drive rail, in the form of a coupling 446, rather than the rectangular-shaped upper drive rail 190, of the first exemplary embodiment, as illustrated in FIGS. 9, 25B, and 26B. It will be noted that in all other respects, the first and second exemplary embodiments of the inactive drive door locking apparatus 184, 440 are substantially identical. It will be specifically noted, that in both the first and second exemplary embodiment of the inactive door locking apparatuses, according to the invention 184, 440, the outer (lower) end of the second (lower) lock-point actuation slide 352 has a first connecting point 448 thereof, as shown in FIG. 30, adapted for attachment thereto of a tubular-shaped lower drive rail in the form of a coupling 450, and a second portion 452 thereof adapted for attachment thereto of the rectangular-shaped type of lower drive rail 192, described above with respect to the first exemplary embodiment of the primary inactive door apparatus 184, according to the invention.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A door locking arrangement, including a door locking apparatus for moving at least one lock-point between a locked and an unlocked position thereof , the door locking arrangement comprising:

at least one handle-actuated control element, .a lock-point actuation apparatus adapted for attachment thereto of the at least one lock-point, and a lock-point arming input element that is selectively movable between an armed and a disarmed position thereof;

the at least one handle-actuated control element being selectively movable between first and second angular positions thereof and an intermediate angular position thereof disposed between the first and second angular positions;

the door locking apparatus being configured such that moving the at least one lock-point from the unlocked to the locked position thereof is accomplished only by moving the at least one handle-actuated control element from the intermediate position thereof to the second position thereof;

the door locking apparatus also being configured such that moving the at least one lock-point from the locked to the unlocked position thereof is accomplished only by moving the at least one handle-actuated control element from the intermediate position thereof to the first position thereof; and the lock point arming input element being configured and operatively connected to the at least one handle-actuated control element for controlling movement of the at least one handle-actuated control element, between the first, second and intermediate positions of the at least one handle-actuated control element, as a function of whether the lock-point arming input element is positioned in the armed or the disarmed position thereof.

2. The door-locking arrangement of claim 1, wherein:

the at least one handle-actuated control element comprises an inside handle-actuated control element, and an outside handle-actuated control element;

the lock-point apparatus includes the at least one lock-point;

the inside and outside handle-actuated control elements are each selectively movable between respective first and second angular positions thereof and respective intermediate angular positions thereof disposed between the respective first and second angular positions; and the door locking apparatus is configured such that moving the at least one lock-point from the unlocked to the locked position thereof is accomplished only by, first moving the lock-point arming input element from the unarmed to the armed position thereof, and then moving one of the handle-actuated control elements from the intermediate position thereof to the second position thereof.

3. The panel locking arrangement of claim 1, wherein, the panel locking arrangement includes an inactive panel locking apparatus, comprising:

an inactive lock-point apparatus frame defining longitudinal, transverse and thickness axes thereof, first and second lock-point actuation slides movable substantially longitudinally; and a mechanical drive operatively connecting the first and second lock-point actuation slides and the handle-actuated control element in such a manner that movement of the handle-actuated control element between the first and second angular positions thereof causes corresponding oppositely directed longitudinally directed motion of first and second lock-point arming slides from a closely spaced unlocked position thereof, to a widely spaced locked position thereof;

the lock-point arming input element including a cam locking portion thereof;

one of the first and second lock-point actuation slides including a raised peripheral section thereof and a notch in the periphery thereof adjacent the notch;

the raised portion of the periphery engaging the cam locking portion while the one of the first and second slides is not in the locked position thereof, to hold the lock-point arming input element in the disarmed position thereof;

the notch in the periphery being configured for receiving and retaining therein the cam locking portion, while the one of the first and second slides is in the locked position thereof, the lock-point arming input element holding the one of the first and second slides in the locked position thereof, by precluding movement of the handle-actuated control element from the intermediate to the first angular position thereof so long as the locking cam portion of the lock-point arming input element is disposed in the notch in the one of the first and second lock-point actuation slides.

4. The door locking arrangement of claim 3, wherein, the door locking apparatus further comprises a return spring operatively connected between the frame and the lock-point arming input element, for urging the lock-point arming input element to rotate from the disarmed to the armed position thereof in such a manner that the locking cam portion of the lock-point arming input element is biased into contact with the raised portion of the lock-point actuation slide, as the lock-point actuation slide is moved from the unlocked to the locked position thereof, and further such that the locking cam portion moves into and engages with the notch in the lock-point actuation slide as the lock-point actuation slide approaches the locked position thereof.

5. The door locking arrangement of claim 3, wherein, lock-point arming input element is configured and connected such that:

moving the lock-point arming input element from the armed to the disarmed positions thereof, while the locking apparatus is in its locked position, does not move the lock-point actuation slides; and moving the lock-point actuation slides from the locked to the unlocked positions thereof requires that the lock-point arming input element be moved to and held in the disarmed position thereof, while the handle-actuated control element is rotated to the first angular position thereof.

6. The door locking arrangement, of claim 1, comprising an active door-locking apparatus and an inactive door locking apparatus, each according to claim 1 wherein:

the active door-locking apparatus is further configured such that moving the at least one lock-point of the active door-locking apparatus from the unlocked to the locked position thereof is accomplished only by, first moving the lock-point arming input element of the active door-locking apparatus to the armed position thereof, to thereby enable movement of the handle-actuated control element of the active door-locking apparatus to the second position thereof, and then, while the lock-point-arming input element of the active door-locking apparatus remains in the armed position thereof, moving the handle-actuated control element of the active door-locking apparatus from the intermediate position thereof to the second position thereof; and the inactive door-locking apparatus is further configured such that moving the at least one lock-point of the inactive door-locking apparatus from the unlocked to the locked position thereof is accomplished only by, first moving the handle-actuated control element of the inactive door-locking apparatus from the intermediate position thereof to the second position thereof, while the lock-point arming input element of the inactive door-locking apparatus is in the disarmed position thereof, and then moving the lock-point arming input element of the inactive door-locking apparatus to the armed position thereof, to thereby preclude movement of the handle-actuated control element of the inactive door-locking apparatus back to the first position thereof, while the lock-point-arming input element of the inactive door-locking apparatus remains in the armed position thereof.

7. The door locking arrangement of claim 6, wherein, the active and inactive door locking apparatuses are mutually configured in such a manner that, when the active and inactive door-locking apparatuses are in engagement with one another, the active door-locking apparatus cannot be locked unless the inactive door-locking apparatus has previously been locked.

8. The door locking arrangement of claim 7, wherein, the inactive door locking apparatus is configured in such a manner that it cannot be unlocked, until the active door-locking apparatus is unlocked, and moved out of engagement with the inactive door-locking apparatus.

9. The door locking arrangement of claim 7, wherein:

the active door-locking apparatus further comprises a latch, operable by the handle-actuated control element;

the inactive door-locking apparatus further comprises a latch receptacle, for receiving the latch; and the latch receptacle is precluded from receiving the latch unless the inactive door-locking apparatus is in the locked condition thereof.

10. The panel locking arrangement of claim 1, wherein, the inactive panel locking apparatus, comprises:

an inactive lock-point apparatus frame defining longitudinal, transverse and thickness axes thereof, first and second lock-point actuation slides movable substantially longitudinally; and a mechanical drive operatively connecting the first and second lock-point actuation slides and the handle-actuated control element in such a manner that movement of the handle-actuated control element between the first and second angular positions thereof causes corresponding oppositely directed longitudinally directed motion of first and second lock-point arming slides from a closely spaced unlocked position thereof, to a widely spaced locked position thereof;

the lock-point arming input element including a cam locking portion thereof;

one of the first and second lock-point actuation slides including a raised peripheral section thereof and a notch in the periphery thereof adjacent the notch;

the raised portion of the periphery engaging the cam locking portion while the one of the first and second slides is not in the locked position thereof, to hold the lock-point arming input element in the disarmed position thereof;

the notch in the periphery being configured for receiving and retaining therein the cam locking portion, while the one of the first and second slides is in the locked position thereof, the lock-point arming input element holding the one of the first and second slides in the locked position thereof, by precluding movement of the handle-actuated input element from the intermediate to the first angular position thereof so long as the locking cam portion of the lock-point arming input element is disposed in the notch in the one of the first and second lock-point actuation slides.

11. The door-locking arrangement of claim 6, wherein, the active door-locking apparatus further comprises:

an inside handle-actuated control element, an outside handle-actuated control element, a lock-point actuation apparatus having at least one lock-point that is movable between a locked and an unlocked position thereof, and a lock-point arming input element that is selectively movable between an armed and a disarmed position thereof;

the handle-actuated control elements being selectively movable between respective first and second angular positions thereof and respective intermediate angular positions thereof disposed between the first and second angular positions;

the door locking apparatus being configured such that moving the at least one lock-point from the unlocked to the locked position thereof is accomplished only by, first moving the lock-point arming input element from the unarmed to the armed position thereof, and then moving one of the handle-actuated control elements from the intermediate position thereof to the second position thereof.

12. A door locking arrangement, including a door locking apparatus for moving at least one lock-point between a locked and an unlocked position thereof , the door locking arrangement comprising:

at least one handle-actuated control element, a lock-point actuation apparatus adapted for attachment thereto of the at least one lock-point, and a lock-point arming input element that is selectively movable between an armed and a disarmed position thereof;

the at least one handle-actuated control element being selectively movable between first and second angular positions thereof and an intermediate angular position thereof disposed between the first and second angular positions;

the door locking apparatus being configured such that moving the at least one lock-point from the unlocked to the locked position thereof is accomplished only by, first moving the lock-point arming input element from the unarmed to the armed position thereof, and then moving the at least one handle-actuated control element from the intermediate position thereof to the second position thereof.

13. The door locking arrangement of claim 12, wherein:

the at least one handle-actuated control element comprises an inside handle-actuated control element, and an outside handle-actuated control element;

the lock-point acutation apparatus includes the at least one lock point;

the handle-actuated control elements are each selectively movable between respective first and second angular positions thereof and respective intermediate angular positions thereof disposed between the first and second angular positions; and the door locking apparatus is configured such that moving the at least one lock-point from the unlocked to the locked position thereof is accomplished only by, first moving the lock-point arming input element from the unarmed to the armed position thereof, and then moving one of the handle-actuated control elements from the intermediate position thereof to the second position thereof.

14. The door locking arrangement of claim 13, wherein, the door locking apparatus further comprises one or more of the group consisting substantially of:

an inside handle operatively connected to the inside handle-actuated control element;

an outside handle operatively connected to the outside handle-actuated control element;

a thumb-turn operatively connected to the lock-point arming input element;

a lock cylinder operatively connected to the lock-point arming input element;

multiple lock-points;

connecting and mounting elements for operatively connecting multiple lock-points to one another; and decorative hardware.

15. The door locking arrangement of claim 13, wherein, the door locking apparatus is further configured such that, moving the inside handle-actuated control element from the intermediate position thereof to the first angular position thereof retracts the at least one lock-point and moves the lock-point arming input element from the armed to the disarmed position thereof.

16. The door locking arrangement of claim 13, wherein, the door locking apparatus is further configured such that the outside handle-actuated control element is blocked against movement from the intermediate position thereof to the first position thereof when the lock-point arming input element is in the armed position.

17. The door locking arrangement of claim 16, wherein, the door locking apparatus is further configured such that, moving the inside handle-actuated control element from the intermediate position thereof to the first angular position thereof retracts the at least one lock-point and moves the lock-point arming input element from the armed to the disarmed position thereof.

18. The door locking arrangement of claim 13, wherein, the inside and outside handle-actuated control elements may be selectively reconfigured in such a manner that the inside handle-actuated control element becomes an outside handle-actuated control element, and the outside handle-actuated control element becomes an inside handle-actuated control element.

19. The door locking arrangement of claim 13, wherein, the door locking apparatus further comprises a latch that is selectively movable between a fully extended latched position thereof and a retracted position thereof through movement of:

either of the inside or outside handle-actuated control element from the intermediate to the first position thereof, when the lock-point arming input element is in the disarmed position thereof and only the inside handle-actuated control element from the intermediate to the first position thereof, when the lock-point arming input element is in the armed position thereof.

20. The door locking arrangement of claim 19, wherein the door locking apparatus is further configured such that movement of the inside and outside handle-actuated control elements from the intermediate to the second positions thereof can only move the at least one lock-point from the unlocked to the locked position thereof when the latch is substantially in the fully extended latched position thereof.

21. The door locking arrangement of claim 20, wherein, the door locking apparatus of claim 12 is an active door locking apparatus, and the door locking apparatus further comprises an inactive door locking apparatus.

22. The door locking arrangement of claim 21, wherein, the inactive door locking apparatus further comprises one or more of the members of a group consisting substantially of:

an inside handle operatively connected to the inactive door handle-actuated control element;

an outside handle operatively connected to the inactive door handle-actuated control element;

a thumb-turn operatively connected to the inactive door lock-point arming input element;

multiple inactive door lock-points;

connecting and mounting elements for operatively connecting multiple inactive door lock-points to one another; and decorative hardware.

23. The door locking arrangement of claim 21, wherein:

the inactive door locking apparatus comprises at least one inactive door lock-point, an inactive door lock-point actuation apparatus, and an active door lock-point blocker movably disposed in the latch receptacle;

the at least one inactive door lock-point being operatively connected to the inactive door lock-point actuation apparatus for selectively moving the at least one inactive door lock-point between the locked and an unlocked position thereof; and the active door lock-point blocker being operatively configured and connected to the inactive door lock-point in such a manner that the lock-point of the active door locking apparatus is precluded from movement to the locked position thereof when the inactive door lock-point is not in the locked position thereof.

24. The door locking arrangement of claim 21, wherein, the active door locking apparatus includes multiple active door lock-points which are all blocked against movement to their respective locked positions when the inactive door lock-point is not in the locked position thereof.

25. The door locking arrangement of claim 21, wherein, the door locking apparatus of claim 13 is an active door locking apparatus, and the door locking apparatus further comprises:

a latch receptacle configured for receiving therein the latch of the active door locking apparatus, and a latch blocker movably disposed in the latch receptacle;

the latch blocker being operatively connected to the inactive door lock-point in such a manner that the latch of the active door locking apparatus is precluded from extending substantially fully into the latch receptacle when the inactive door lock-point is not in the locked position thereof.

26. The door locking arrangement of claim 25, wherein, the active door locking apparatus includes multiple lock-points, and the multiple active door lock-points are all blocked against movement to their respective locked positions when the inactive door lock-point is not in the locked position thereof.

27. The door locking arrangement of claim 20, wherein, the door locking apparatus of claim 6 is an active door locking apparatus, and the door locking apparatus further comprises:

an inactive door locking apparatus having at least one inactive door lock-point, an inactive door lock-point actuation apparatus, a latch receptacle configured for receiving therein the latch of the active door locking apparatus, and a latch blocker movably disposed in the latch receptacle;

the at least one inactive door lock-point being operatively connected to the inactive door lock-point actuation arrangement for selectively moving the at least one inactive door lock-point between the locked and an unlocked positions thereof; and the latch blocker being operatively connected to the inactive door lock-point in such a manner that the latch of the active door locking apparatus is precluded from extending substantially fully into the latch receptacle when the inactive door lock-point is not in the locked position thereof.

28. The door locking arrangement of claim 27, wherein the inactive door locking apparatus further comprises:

a handle-controlled actuation apparatus, selectively movable between a first position thereof, a second position thereof, and an intermediate position thereof disposed between the first and second positions of the handle-controlled actuation apparatus; and an inactive door lock-point arming arrangement, including an inactive door lock-point arming input element that is movable from an armed to a disarmed position thereof;

the handle-controlled actuation apparatus and inactive door lock-point arming input device being configured and operatively connected such that, to move the inactive door lock-point from the unlocked to the locked position thereof, the handle-actuated input element is moved from the intermediate position to the second position thereof.

29. The door locking arrangement of claim 28, wherein, the inactive door handle-controlled actuation apparatus and inactive door lock-point arming arrangement are further configured and operatively connected such that movement of the inactive door lock-point to the locked position thereof urges the inactive door lock-point arming input element to move to the armed position thereof and secure the inactive door lock-point in the locked position thereof.

30. The door locking arrangement of claim 29, wherein, the inactive door handle-controlled actuation apparatus and inactive door lock-point arming arrangement are further configured and operatively connected such that, with the inactive door lock-point in the locked position, moving the inactive door lock-point arming input element to the disarmed position thereof does not move the inactive door lock-point to the unlocked position thereof.

31. The door locking arrangement of claim 30, wherein, the inactive door lock-point arming input element is spring-biased in such a manner that it is urged to move to the armed position thereof, whereby, when the inactive door lock-point is moved to the locked position, or is in the locked position, the inactive door lock-point arming input element is biased to move toward the armed position thereof.

32. The door locking arrangement of claim 30, wherein, the inactive door locking apparatus is configured such that, to move the inactive door lock-point from the locked to the unlocked position thereof, the inactive door lock-point arming input element must be moved to, and held in, the disarmed position thereof, while the inactive door handle-controlled input element is moved to the second position thereof.

33. The door locking arrangement of claim 32, wherein, the active and inactive door locking apparatuses are cooperatively configured, such that the inactive door handle-controlled input element is blocked against movement from the intermediate position thereof whenever a latch or a lock-point of the active door locking apparatus is disposed within a corresponding receptacle of the inactive door locking apparatus.

34. The door locking arrangement of claim 13, wherein:

the door locking apparatus is a primary lock apparatus adapted for operative attachment to a door hinged to a door jamb for swinging motion about a door hinge axis from a closed to an open position of the door, with the door defining an inside and an outside surface thereof joined by oppositely disposed lock-side and hinge-side door edges, with the door having a longitudinal door length extending in a direction substantially parallel to the door hinge axis, a transverse door width extending substantially between the lock-side and hinge-side door edges, and a door thickness extending between the inside and outside surfaces of the door; and the primary lock apparatus further comprises an active door lock frame having operatively attached thereto, a lock-point actuation apparatus including the at least one lock-point, independently operable first and second handle-actuated actuation apparatuses respectively including the first and second handle-controlled input elements, and a handle-motion control apparatus including the lock-point arming input element;

the primary lock frame defining mutually orthogonally directed longitudinal, transverse, and thickness axes of the active door lock apparatus, with the longitudinal active door lock axis extending substantially parallel to the door hinge axis and the transverse active door lock axis aligning respectively perpendicular to the door hinge axis and parallel to the width of the door when the active door lockset is operatively attached to the active door;

the lock-point actuation apparatus being operatively connected to the first and second handle-operable actuation apparatuses and includes a lock-point actuation slide that is movable along substantially linear path in a direction substantially parallel to the longitudinal axis of the primary lock apparatus between a locked and an unlocked position of the lock-point actuation slide;

the configuration and interconnection of the first and second handle-actuated actuation apparatuses and the lock-point actuation apparatus being such that the lock-point actuation slide is urged to move from the locked to the unlocked position thereof by movement of the input element of either of the first and second handle-actuated control elements to the first position thereof, and such that the lock-point actuation slide is urged to move from the unlocked to the locked position thereof by movement of the input element of either of the first and second handle-actuated control elements to the second position thereof;

the configuration and interconnection of the handle-motion control apparatus and the first and second handle-actuated control apparatuses being such that movement of the lock-point arming element between the armed and disarmed positions thereof controls selective movement of the control elements of the first and second handle-controlled actuation apparatuses, to thereby control movement of the lock-point actuation slide, and further being such that movement of the lock-point arming element between the armed and disarmed positions thereof does not move the lock-point actuation slide.

35. The locking arrangement of claim 34, wherein:

the first and second handle-controlled actuation apparatuses of the primary locking apparatus respectively comprise first and second input hubs respectively forming the first and second handle-actuated control elements, first and second handle-motion control slides;

the first and second input hubs being rotatably mounted for independent rotation about a common input hub axis extending substantially parallel to the thickness axis;

the first handle-motion control slide being connected in gear mesh relationship with the first input hub in such a manner that application of torque in a first direction to the first input hub urges angular motion of the first input hub in the first direction, to thereby impart linear motion in a first direction to the first handle-motion control slide, and such that application of torque in a second direction to the first input hub urges angular motion of the first input hub in the second direction, to thereby impart linear motion in a second direction to the first handle-motion control slide; and the second handle-motion control slide being connected in gear mesh relationship with the second input hub in such a manner that application of torque in a first direction to the second input hub urges angular motion of the second input hub in the first direction, to thereby impart linear motion in a first direction to the second handle-motion control slide, and such that application of torque in a second direction to the second input hub urges angular motion of the second input hub in the second direction, to thereby impart linear motion in a second direction to the second handle-motion control slide;

the first and second handle-motion control slides both being operatively connected to the lock-point actuation slide in such a manner that the lock-point actuation slide is urged to move from the locked to the unlocked position thereof by movement of the input hub of either of the first and second handle-motion control apparatuses to the first position thereof, and such that the lock-point actuation slide is urged to move from the unlocked to the locked position thereof by movement of the input hub of either of the first and second handle-motion control apparatuses to the second position thereof.

36. The locking arrangement of claim 35, wherein, the lock-point arming input element is operatively connected to both the first and second lock-point actuation slides in such a manner that:

both the first and the second lock-point actuation slides are precluded from moving to the second position thereof when the lock-point arming input element is in the disarmed position thereof; and both the first and the second lock-point actuation slides may be selectively and independently moved to the first position thereof when the lock-point arming input element is in the disarmed position thereof.

37. The locking arrangement of claim 35, further comprising:

a lock-point arming apparatus operatively connected to the frame, and including the lock-point arming input element in the form of an arming hub operatively attached to the frame for selective rotation about an arming hub axis extending substantially parallel to the thickness axis for selective rotation from an armed to a disarmed angular position of the arming hub;

the lock-point arming apparatus further comprising a traveling rack element, a handle-motion-control-slide stop-pivot element, a torsion spring, a pivotable gear sector element, and first and second selectively movable handle-motion control slide stop-pins;

the traveling rack element being connected in a gear mesh relationship with the arming hub and slidably mounted in the frame for substantially linear movement between armed and disarmed linear positions of the traveling rack corresponding respectively to the armed and disarmed positions of the arming hub, in such a manner that moving the arming hub between the armed and disarmed positions of the arming hub urges a corresponding movement of the traveling rack element between the armed and disarmed positions thereof;

the stop-pivot element being pivotably attached to the frame for pivotable movement between armed and disarmed angular positions thereof, and configured such that when positioned in the disarmed position the stop-pivot engages and precludes movement of either of the first and/or the second handle-control slides to the respective second positions of the handle-control slides;

the stop-pivot element being further pivotably attached and configured such that when positioned in the armed position thereof the stop-pivot element disengages from and does not preclude movement of either of the first and/or the second handle-control slides to the respective second positions of the handle-control slides;

the traveling rack element and stop-pivot-element being cooperatively configured and mounted for sliding engagement with one another such that movement of the traveling rack element toward the disarmed position thereof urges the stop-pivot element to engage with the first and second handle-control slides, and such that movement of the traveling rack element toward the armed position thereof urges the stop-pivot element to disengage from the first and second handle-control slides;

the stop-pivot return spring being operatively connected between the frame and the stop-pivot element to provide a biasing force for urging the stop-pivot toward a position of sliding engagement with the traveling rack element;

the pivotable gear sector element being pivotably mounted to the frame and operatively connected in a gear mesh relationship to the arming hub in such a manner that the movement of the arming hub to the armed position thereof moves the pivotable gear sector to an armed position thereof;

the pivotable gear sector including a stop-pin support arm adapted for removable attachment thereto of the second stop-pin and configured for bringing the second stop-pin into alignment with a notch in one of the first and/or second handle-motion control slides, when the pivotable sector gear is in the armed position thereof for precluding linear movement of the slide to the first position thereof; and the first stop-pin being attached to the traveling rack element for operative engagement with the other of the first and/or second handle-motion control slides in such a manner that when the arming hub is in the armed position, either of the slides may move to the second position thereof to fully lock and latch the active lock apparatus, but such that movement of the other of the slides to the first position thereof moves the traveling rack element linearly in such a manner that the gear mesh relationships between the traveling rack element and the arming hub rotates the arming hub from the armed to the disarmed positions thereof, with rotation of the arming hub simultaneously pivoting the pivotable gear sector element from the armed to the disarmed positions thereof.

38. The locking arrangement of claim 37, wherein, the first and second stop pins are mountable on opposite sides of slider and gear sector arm to define inside and outside handle-actuator mechanisms.

39. The panel locking arrangement of claim 35, wherein:

the primary lock-point is a deadbolt configured and connected to the frame for substantially linear movement, between the extended and retracted positions thereof, along a deadbolt path extending substantially parallel to the transverse axis of the primary locking apparatus; and the lock-point actuation apparatus further comprises a deadbolt actuator operatively connected to the frame for rotatable movement about a deadbolt actuator axis extending substantially parallel the thickness axis;

the deadbolt actuator also being operatively connected in gear mesh relationship with the lock-point slide in such a manner that the deadbolt actuator is rotated between a locked and an unlocked angular position thereof by corresponding linear movement of the lock-point actuation slide between the locked and unlocked linear positions of the lock-point actuation slide;

the deadbolt actuator and deadbolt being further cooperatively configured and operatively connected through a cam and follower arrangement, in such a manner that rotation of the deadbolt actuator between its locked and unlocked angular positions is transformed into respective corresponding linear motion of the deadbolt between the locked and unlocked positions of the deadbolt.

40. The panel locking arrangement of claim 35, wherein, the lock-point actuation apparatus further comprises:

a drive-lever and a drive pin;

the drive lever being pivotably connected to the frame for pivoting motion between locked and unlocked angular positions thereof about a drive lever axis oriented substantially parallel to the thickness axis;

the drive lever also being configured and operatively connected between the both the first and second handle-control slides in such a manner that linear movement of either of the first or second handle-control slides between the locked and unlocked positions thereof causes a corresponding angular movement of the drive lever from the locked to the unlocked positions thereof;

the drive-pin being configured and operatively connected in a sliding relationship with the frame and drive lever in such a manner that angular movement of the drive-lever between the locked and unlocked positions thereof causes a corresponding movement of the drive pin along a substantially curved drive-pin-path between a locked and an unlocked position of the drive-pin;

the drive-pin and lock-point actuation slide being further cooperatively configured and slidingly interconnected in such a manner that movement of the drive pin along the drive-pin-path between the locked and unlocked positions of the drive-pin causes a corresponding linear motion of the lock-point actuation slide between the locked and unlocked positions thereof.

41. The locking arrangement of claim 40, wherein, the primary locking apparatus further comprises:

a latch apparatus comprising a latch element, a latch drive, and a latch return spring;

the latch element having a latch striker at an exposed axial end thereof and a handle-control-slide-blocker at an opposite axial end thereof, with the latch element being configured and operatively connected to the frame for substantially linear movement, between a latched and an unlatched position of the latch element along a latch element axis extending substantially parallel to the transverse axis;

the latch-drive being configured and operatively connected to the frame and both the inside and outside handle-input-hubs for angular rotation about the handle-input-hub-axis between a first and a second angular position of the latch-drive corresponding to the first and second angular positions of both the first and second handle-input-hubs;

the latch-drive and latch element being cooperatively configured and connected in a lever arrangement such that pivoting motion of the latch-drive between the latched and unlatched positions of the latch drive urges a respective corresponding linear movement of the latch-element between the latched and unlatched positions thereof;

the latch return spring being operatively connected between the latch-drive and the frame for urging the latch-drive toward the latched angular position thereof;

the first and second handle-control-slides and the handle-control-slide-blocker at the opposite axial end of the latch-element being configured and operatively interconnected in such a manner that the handle-control-slide-blocker interacts with both the first and second handle-control-slides, to preclude linear movement thereof from the unlocked to the locked positions thereof whenever the latch element is not substantially in the latched position thereof.

42. The locking arrangement of claim 41, wherein, the lock-point actuation slide is adapted for operative attachment thereto of secondary-lock-point apparatuses.

43. A method for operating a door locking apparatus of a door locking arrangement having at least one lock-point, to move the at least one lock-point between a locked and an unlocked position thereof, wherein:

the door locking arrangement, includes a door locking apparatus having, at least one handle-actuated control element, a lock-point actuation apparatus adapted for attachment thereto of the at least one lock-point, and a lock-point arming input element that is selectively movable between an armed and a disarmed position thereof;

the at least one handle-actuated control element is selectively movable between first and second angular positions thereof and an intermediate angular position thereof disposed between the first and second angular positions;

the door locking apparatus is configured such that moving the at least one lock-point from the unlocked to the locked position thereof is accomplished only by moving the at least one handle-actuated control element from the intermediate position thereof to the second position thereof;

the door locking apparatus is also configured such that moving the at least one lock-point from the locked to the unlocked position thereof is accomplished only by moving the at least one handle-actuated control element from the intermediate position thereof to the first position thereof; and the lock point arming input element is configured and operatively connected to the at least one handle-actuated control element for controlling movement of the at least one handle-actuated control element, between the first, second and intermediate positions of the at least one handle-actuated control element, as a function of whether the lock-point arming input element is positioned in the armed or the disarmed position thereof; and the method comprises, controlling movement of the at least one handle-actuated control element, between the first, intermediate and second angular positions thereof, by selectively positioning the lock point arming input element in either the armed or the disarmed position thereof, to thereby regulate movement of the at least one lock-point between the unlocked and the locked position thereof.

44. The method of claim 43, further comprising, moving the lock-point from the unlocked to the locked position thereof, by first moving the lock-point arming input element from the unarmed to the armed position thereof, and then moving the handle-actuated control element from the intermediate position thereof to the second position thereof.

45. The method of claim 43, further comprising, moving the lock-point from the unlocked to the locked position thereof, by first moving the handle-actuated control element from the intermediate position thereof to the second position thereof, while the lock-point arming input element is restrained in the disarmed position thereof, and then moving the lock-point arming input element from the disarmed to the armed position thereof, to thereby preclude movement of the handle-actuated input element to the first position of the handle-controlled input element.

46. The method of claim 43, wherein:

the at least one handle-actuated control element comprises an inside handle-actuated control element, and an outside handle-actuated control element;

the lock-point actuation apparatus includes the at least one lock point;

the handle-actuated control elements are selectively movable between respective first and second angular positions thereof and respective intermediate angular positions thereof disposed between the first and second angular positions;

the door locking apparatus is configured such that moving the at least one lock-point from the unlocked to the locked position thereof is accomplished only by, first moving the lock-point arming input element from the unarmed to the armed position thereof, and then moving one of the handle-actuated control elements from the intermediate position thereof to the second position thereof; and the method further comprises, first moving the lock-point arming input element from the unarmed to the armed position thereof, and then moving one of the handle-actuated control elements from the intermediate position thereof to the second position thereof.

47. The method of claim 43, wherein:

the door locking arrangement includes a panel locking apparatus, having, an inactive lock-point apparatus frame defining longitudinal, transverse and thickness axes thereof, first and second lock-point actuation slides movable substantially longitudinally, and, a mechanical drive operatively connecting the first and second lock-point actuation slides and the handle-actuated control element in such a manner that movement of the handle-actuated control element between the first and second angular positions thereof causes corresponding oppositely directed longitudinally directed motion of first and second lock-point arming slides from a closely spaced unlocked position thereof, to a widely spaced locked position thereof, the lock-point arming input element includes a locking cam portion thereof;

one of the first and second lock-point actuation slides including a raised peripheral section thereof and a notch in the periphery thereof adjacent the notch;

the raised portion of the periphery engages the locking cam portion while the one of the first and second slides is not in the locked position thereof, to hold the lock-point arming input element in the disarmed position thereof, the notch in the periphery is configured for receiving and retaining therein the cam locking portion, while the one of the first and second slides is in the locked position thereof, the lock-point arming input element holding the one of the first and second slides in the locked position thereof, by precluding movement of the handle-actuated input element from the intermediate to the first angular position thereof so long as the locking cam portion of the lock-point arming input element is disposed in the notch in the one of the first and second lock-point actuation slides; and the method further comprises, moving the lock-point actuation slides from the unlocked to the locked positions thereof, by first moving the handle-actuated control element from the intermediate position thereof to the second position thereof, while the lock-point arming input element is restrained in the disarmed position thereof, and then moving the lock-point arming input element from the disarmed to the armed position thereof, to thereby preclude movement of the handle-actuated input element to the first position of the handle-controlled input element.

48. The door locking arrangement of claim 2, wherein, once the lock-point arming input element has been moved to the armed position thereof, moving the outside handle-actuated control element from the intermediate to the second angular position thereof moves the at least one lock point to the locked position thereof.

* * * * *

UNITED STATES PATENT AND TRADEMARK OFFICE

CERTIFICATE OF CORRECTION

PATENT NO. : 7,878,034 B2
APPLICATION NO. : 11/701914
DATED : February 1, 2011
INVENTOR(S) : Helmut Alber et al.

It is certified that error appears in the above-identified patent and that said Letters Patent is hereby corrected as shown below:

In the specification:

Column 12, Lines 14-16

"to one another, inside and outside surfaces 128, 130 thereof, joined by oppositely disposed lock-side and" should read --to one another.--.

Column 12, Line 17

"defines hinge-side" should read --defines inside and outside surfaces 128, 130 thereof, joined by oppositely disposed lock-side and hinge-side--.

In the claims:

Column 27, Line 58

"control element, .a lock-point" should read --control element, a lock point--.

Signed and Sealed this
Twenty-seventh Day of December, 2011

David J. Kappos

David J. Kappos
*Director of the United States Patent and Trademark Office*